US007336921B2

(12) United States Patent
Suzuki et al.

(10) Patent No.: US 7,336,921 B2
(45) Date of Patent: Feb. 26, 2008

(54) SHEET FINISHER WITH SHEET FOLDING CAPABILITY AND IMAGE FORMING SYSTEM USING THE SAME

(75) Inventors: Nobuyoshi Suzuki, Tokyo (JP); Masahiro Tamura, Kanagawa (JP); Hiromoto Saitoh, Kanagawa (JP); Shuuya Nagasako, Tokyo (JP); Naohiro Kikkawa, Tokyo (JP); Hiroki Okada, Kanagawa (JP); Junichi Iida, Kanagawa (JP); Kenji Yamada, Tokyo (JP); Junichi Tokita, Kanagawa (JP); Akihito Andoh, deceased, late of Kanagawa (JP); by Rika Andoh, legal representative, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/640,044

(22) Filed: Aug. 14, 2003

(65) Prior Publication Data

US 2004/0104525 A1 Jun. 3, 2004

(30) Foreign Application Priority Data

Aug. 14, 2002 (JP) ..... 2002-236664
Aug. 26, 2002 (JP) ..... 2002-245195
Oct. 31, 2002 (JP) ..... 2002-318281

(51) Int. Cl.
*G03G 15/00* (2006.01)

(52) U.S. Cl. ..... 399/407; 399/408

(58) Field of Classification Search ..... 399/407, 399/408, 410; 271/292, 293, 288; 270/58.08, 270/58

See application file for complete search history.

(56) References Cited

U.S. PATENT DOCUMENTS 3,802,781 A * 4/1974 Wright ..... 356/618
4,073,369 A * 2/1978 Nordskog ..... 188/5
4,273,055 A * 6/1981 Borgeaud et al. ..... 105/190.2
5,123,357 A * 6/1992 Fujita et al. ..... 104/290
5,421,267 A * 6/1995 Mesko et al. ..... 104/168

(Continued)

FOREIGN PATENT DOCUMENTS

JP 04-333469 11/1992

(Continued)

OTHER PUBLICATIONS

U. S. Appl. No. 11/682,238, filed Mar. 5, 2007, Iida et al.
U. S. Appl. No. 11/519,039, filed Sep. 12, 2006, Yamada, et al.
U.S. Appl. No. 11/267,403, filed Nov. 7, 2005, Tokita et al.
U.S. Appl. No. 11/273,301, filed Nov. 15, 2005, Iida et al.

*Primary Examiner*—Anthony H. Nguyen
(74) *Attorney, Agent, or Firm*—Oblon, Spivak, McClelland, Maier & Neustadt, P.C.

(57) ABSTRACT

A sheet folding device for folding a sheet or a sheet stack conveyed thereto of the present invention includes a path along which the sheet or the sheet stack to be folded is conveyed. A fold plate is movable in a direction perpendicular to the above path for forming a fold in the sheet or the sheet stack. A pair of rotatable fold rollers face the fold plate and are positioned one above the other. Pressing members exerts, when the fold is to be formed, a pair of equal pressing forces on the fold rollers to thereby maintain the nip between the fold rollers on a line including the locus of movement of the fold plate.

55 Claims, 55 Drawing Sheets

U.S. PATENT DOCUMENTS

| | | | | |
|---|---|---|---|---|
| 5,826,158 | A * | 10/1998 | Hirano et al. | 399/410 |
| 5,852,765 | A * | 12/1998 | Yamashita et al. | 399/407 |
| 6,076,817 | A * | 6/2000 | Kobayashi et al. | 270/58.09 |
| 6,231,045 | B1 | 5/2001 | Yamada et al. | 271/292 |
| 6,264,191 | B1 | 7/2001 | Suzuki et al. | 271/189 |
| 6,322,070 | B2 | 11/2001 | Yamada et al. | 271/293 |
| 6,343,785 | B1 | 2/2002 | Yamada et al. | 270/58.09 |
| 6,394,448 | B2 | 5/2002 | Suzuki et al. | 271/189 |
| 6,416,052 | B2 | 7/2002 | Yamada et al. | 271/292 |
| 6,494,449 | B2 | 12/2002 | Tamura et al. | 271/214 |
| 6,494,453 | B1 | 12/2002 | Yamada et al. | 271/288 |
| 6,526,256 | B2 * | 2/2003 | Yoshie et al. | 399/407 |
| 6,527,269 | B2 | 3/2003 | Yamada et al. | 271/221 |
| 6,549,734 | B2 | 4/2003 | Yamada et al. | 399/81 |
| 6,631,896 | B2 | 10/2003 | Yamada et al. | 270/58.09 |
| 6,666,443 | B2 * | 12/2003 | Shida et al. | 270/58.11 |
| 6,712,349 | B2 * | 3/2004 | Watanabe | 270/37 |
| 6,829,998 | B1 * | 12/2004 | Kickbush | 104/26.2 |
| 6,868,253 | B2 * | 3/2005 | Ueda et al. | 399/407 |
| 6,921,069 | B2 * | 7/2005 | Suzuki et al. | 271/207 |
| 2002/0022069 | A1 * | 2/2002 | Kasal et al. | 425/593 |
| 2004/0104525 | A1 | 6/2004 | Suzuki et al. | |

FOREIGN PATENT DOCUMENTS

| | | |
|---|---|---|
| JP | 09-002735 | 1/1997 |
| JP | 09-165139 | 6/1997 |
| JP | 09-183567 | 7/1997 |
| JP | 09-183568 | 7/1997 |
| JP | 10-109820 | 4/1998 |
| JP | 10-279177 | 10/1998 |
| JP | 11-29259 | 2/1999 |
| JP | 11-246114 | 9/1999 |
| JP | 2000-118850 | 4/2000 |
| JP | 2000-143088 | 5/2000 |
| JP | 2000-211805 | 8/2000 |
| JP | 2000-327209 | 11/2000 |

* cited by examiner

SHEET FINISHER WITH SHEET FOLDING CAPABILITY AND IMAGE FORMING SYSTEM USING THE SAME

BACKGROUND OF THE INVENTION

1. Field of the Invention

The present invention relates to a sheet folding for folding a sheet or recording medium or a sheet stack carrying images thereon, a sheet finisher constructed integrally with or operatively connected to an image forming apparatus for sorting, stacking, stapling, center-stapling, folding or otherwise finishing the sheet or the sheet stack, and an image forming system consisting of the sheet finisher and image forming apparatus.

2. Description of the Background Art

A sheet finisher positioned at the downstream side of a copier, printer or similar image forming apparatus for stapling or otherwise finishing a sheet stack is well known in the art.

It is a common practice with a sheet finisher to staple a sheet stack at the center and then fold the sheet stack in two at the center. To fold the sheet stack, use is made of a fold plate configured to push the stapled portion of the sheet stack toward the nip of a pair of fold rollers while contacting the sheet stack substantially perpendicularly thereto. The sheet stack thus pushed is passed through the nip between the fold rollers and folded thereby. The prerequisite with such center stapling and center folding is that the sheet stack be folded by the fold roller pair at the position accurately coincident with the stapled position. A sheet stack so folded is attractive and can be smoothly spread.

To meet the above requisite, it has been proposed to press the two fold rollers with respective springs in such a manner as to maintain the nip between the rollers at the center of a folding position. Japanese Patent Laid-Open Publication Nos. 2000-143088 and 2000-211805, for example, each use a pair of fold rollers for folding the center of a sheet stack in the direction of conveyance and sheet pushing means including a push plate that pushes the fold of the sheet stack toward the nip between the fold rollers while moving toward the nip. The fold rollers are constantly biased toward each other by biasing means.

Before starting pressing the sheet stack, the fold rollers are held stationary at preselected positions by a stop member, which is fixed in place, while adjoining or lightly contacting each other so as not to exert excessive pressure. In this condition, the push plate is accurately moved toward the nip between the fold rollers to thereby accurately fold the sheet stack. Further, after the trailing edge of the sheet stack has moved away from the fold rollers, the fold rollers are prevented from hitting against each other.

However, in the configuration described above, the fold rollers adjoin or lightly contact each other only when a sheet stack is absent therebetween. When a sheet stack enters the nip between the fold rollers, the weight of the lower fold roller acts in a direction in which the force of the associated spring decreases while the weight of the upper fold roller acts in a direction in which the force of the associated spring increases. As a result, the pressing forces of the springs are brought out of balance with each other. Consequently, the lower fold roller is spaced from the pressing position more than the upper fold roller, so that the nip between the fold rollers is shifted from the center of the pressing position. This prevents the folded position of a sheet stack from accurately coinciding with the stapled position of the same and thereby makes the folded sheet stack unattractive.

Japanese Patent Laid-Open Publication No. 10-279177 discloses a sheet folding device configured to move, when a sheet stack is passed through a pair of fold rollers, one fold roller in unison with, but in the opposite direction to, the other fold roller. This, according to the above document, allows the center of a gap formed between the fold rollers to constantly coincide with the position of a line tangential to both of the rollers when the rollers contact each other. More specifically, a pair of swing arms respectively support the fold rollers at one end thereof and are swingable about respective fulcrums at the other end. A gear train or similar connecting means is arranged between the fulcrums to cause, when one of the swing arms swing, the other swing arm to swing in the opposite direction by the same angle. In this configuration, the fold rollers press a sheet stack while moving symmetrically to each other with respect to the center of a fold, so that the sheet stack can be folded at the same position as the stapled position.

However, a problem with the above sheet folding device is that the gear train or similar connecting means cannot be accurately positioned due to backlash and irregularity among parts. This not only makes it difficult to allow the folded position to accurately coincide with the stapled position, but also makes the resulting sheet stack unattractive.

Further, to sharply fold a sheet stack, it is generally necessary to increase the pressing force in accordance with the thickness of the sheet stack. However, the gear train or similar connecting means, used to move the fold rollers, is limited in strength, so that the pressing force of the fold roller pair must also be relatively weak. Consequently, the range over which the fold rollers can fold a sheet stack is limited. A sheet stack with a loose fold is not only unattractive as a bound matter, but also collapses when stacked together with the other sheet stacks.

Moreover, a fold roller pair, exerting a strong pressing force, is optimum in sharpening the fold of a sheet stack. However, when a sheet stack folded by such a fold roller pair is conveyed, the fold of the sheet stack again expands outward and again becomes loose because the innermost sheet is conveyed more than the outermost sheet little by little. In the worst case, the sheet stack is creased or broken. In addition, the fold rollers are apt to hit against each other when the trailing edge of the sheet stack moves away from the nip. The resulting impact is likely to damage the finisher while producing noise.

Technologies relating to the present invention are also disclosed in, e.g., Japanese Patent Laid-Open Publication No. 2000-211805.

SUMMARY OF THE INVENTION

It is an object of the present invention to provide a sheet folding device capable of neatly, sharply folding a sheet or a sheet stack with fold rollers.

It is another object of the present invention to provide a sheet finisher capable of sharply folding a sheet stack, which is stapled at the center, with fold rollers while causing a folded position to accurately coincide with a stapled position, and allowing a plurality of such sheet stacks to be neatly stacked without collapsing.

It is a further object of the present invention to provide an image forming system consisting of the above sheet finisher and an image forming apparatus that outputs sheets carrying toner images thereon.

A sheet folding device for folding a sheet or a sheet stack conveyed thereto of the present invention includes a path along which the sheet or the sheet stack to be folded is conveyed. A fold plate is movable in a direction perpendicular to the above path for forming a fold in the sheet or the sheet stack. A pair of rotatable fold rollers face the fold plate and are positioned one above the other. Pressing members exerts, when the fold is to be formed, a pair of equal pressing forces on the fold rollers to thereby maintain the nip between the fold rollers on a line including the locus of movement of the fold plate.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
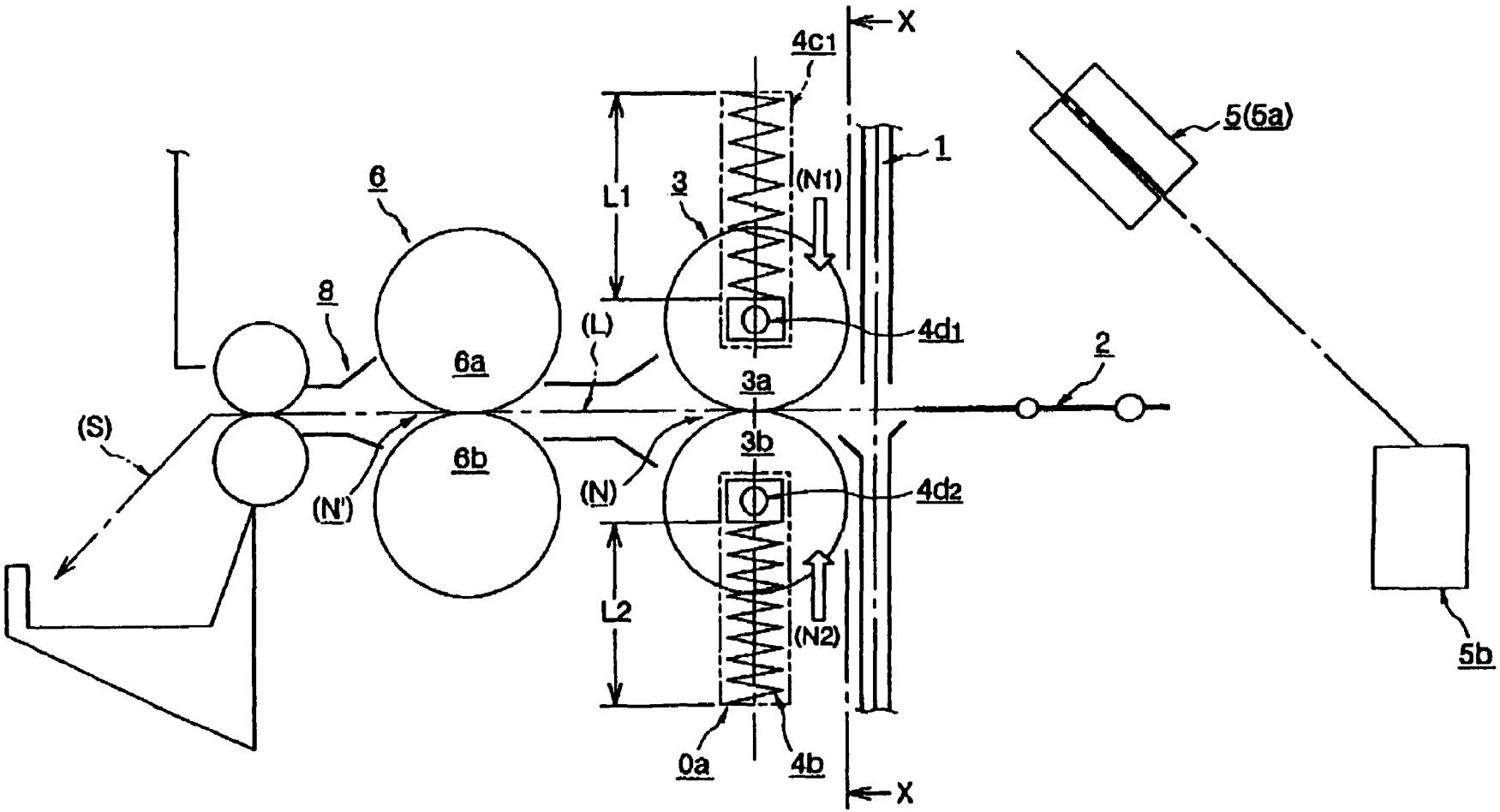
FIG. 1 is a view showing a first embodiment of the sheet folding device in accordance with the present invention.

Preferred embodiments of the present invention will be described hereinafter. It is to be noted that the reference numerals used in each embodiment are independent of the reference numerals of the other embodiments, i.e., the same reference numerals do not always designate the same structural elements.

First Embodiment

Figure 2:
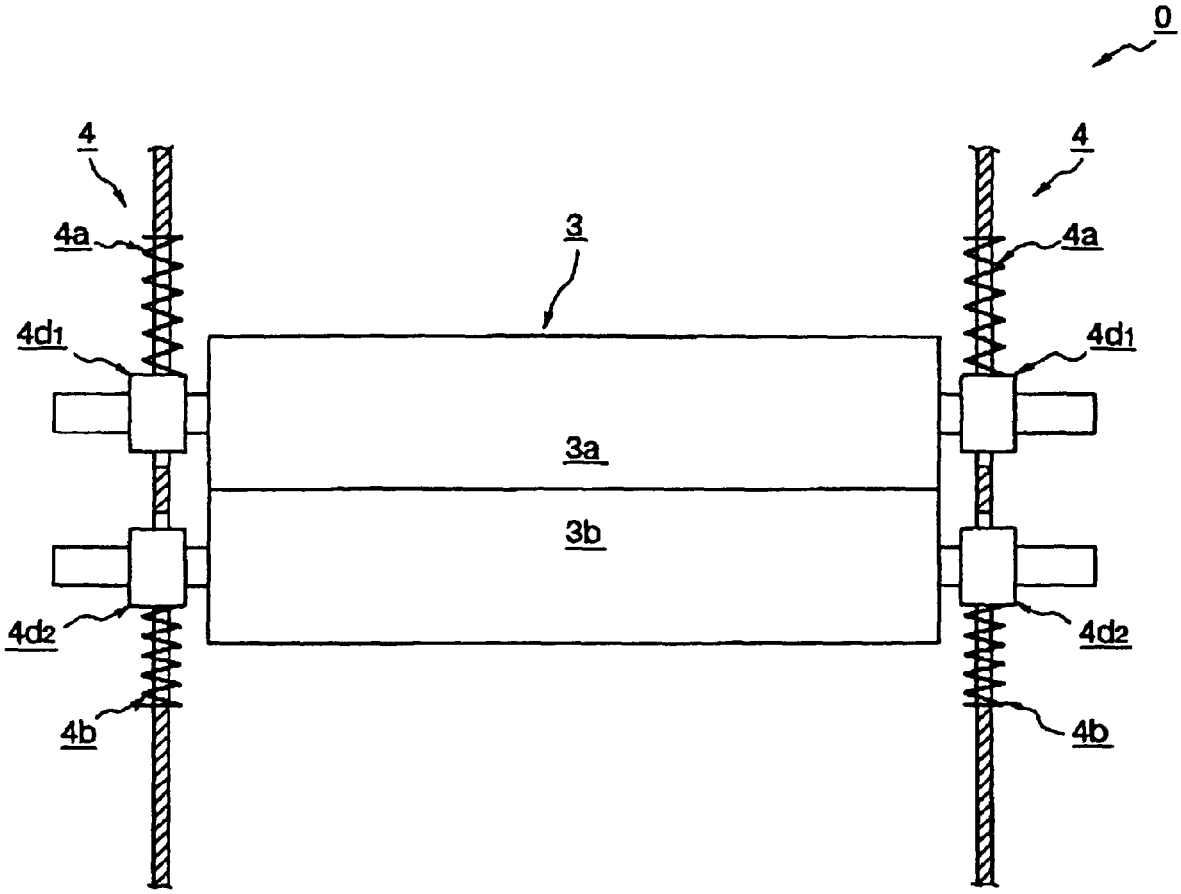
FIG. 2 is a section along line X-X of FIG. 1.

Referring to FIGS. 1 and 2 of the drawings, a sheet folding device embodying the present invention is shown and generally designated by the reference numeral 0. As shown, the sheet folding device 0 includes a path 1 along which a sheet S or a sheet stack S, stapled at the center by a center stapler 5*a* or stapled at one edge by an edge stapler 5*b*, is conveyed. The center stapler 5*a* and edge stapler 5*b* belong to binding means 5. A fold plate 2 is movable substantially perpendicularly to the path 1 for folding the sheet S or the sheet stack S. A pair of rotatable fold rollers 3*a* and 3*b* are positioned one above the other to face the fold plate 2 and are movable into and out of contact with each other in the up-and-down direction. Pressing means 4 includes upper pressing means 4*a* and lower pressing means 4*b* for exerting a pair of equal pressing forces on the fold rollers 3*a* and 3*b*, respectively, when the sheet or the sheet stack S is to be folded. With this configuration, the pressing means maintains a nip N between the fold rollers 3*a* and 3*b* on a line L including the locus of movement of the fold plate 2.

The fold rollers 3*a* and 3*b* can easily fold the sheet S or the sheet stack S at an accurate position. The resulting fold of the sheet S or the sheet stack S is sharp and neat, so that a plurality of sheet or sheet stacks can be sequentially stacked without collapsing. An upper bearing 4*d*1 and a lower bearing 4*d*2, collectively 4*d*, are movably received in an upper and a lower guide hole 4*c*1 and 4*c*2, respectively, which are formed in opposite side walls, not shown, of a device body 0*a*. The upper and lower fold rollers 3*a* and 3*b* are movably supported by the upper and lower bearings 4*d*1 and 4*d*2, respectively. The pressing means 4*a* and 4*b*, which are implemented by durable, low cost, easily adjustable springs, press the fold rollers 3*a* and 3*b* against each other in such a manner as to maintain the nip N on the line L.

In the above configuration, the fold rollers 3*a* and 3*b* exert pressing forces N1 and N2, respectively, which are expressed as:

$$N1 = (\text{free length of spring } 4a - \text{loaded length } L1) \times \text{spring constant } K1 + \text{weight of roller } 3a$$

$$N2 = (\text{free length of spring } 4b - \text{loaded length } L2) \times \text{spring constant } K2 + \text{weight of roller } 3b$$

The loaded lengths L1 and L2 are selected such that the spring constants K1 and K2 are equal to each other and such that the pressing forces N1 and N2 are equal to each other.

The fold rollers 3*a* and 3*b* move, even when conveying the sheet S or the sheet stack S, upward or downward symmetrically to each other with respect to the line L while being balanced with each other. The fold rollers 3*a* and 3*b* are therefore capable of conveying the sheet S or the sheet stack S without shifting the center of the sheet S or the sheet stack S without regard to the number of sheets constituting the sheet stack S. This allow the stapled position of the sheet stack S stapled by the center stapler 5*a* to accurately coincide with the folded position of the same.

The fold rollers 3*a* and 3*b* withstand even heavy loads because gears or similar connecting means are not used. The sheet S or the sheet stack S can therefore be stably, accurately positioned only by the accuracy of the springs 4*a* and 4*b*, so that the configuration is simple, low cost and stable. Further, the fold rollers 3*a* and 3*b* can fold the sheet S or the sheet stack S under adequate conditions without having their pressing forces limited by short mechanical strength.

The bearings 4*d*1 and 4*d*2, respectively supporting the fold rollers 3*a* and 3*b* and movable along the guide holes 4*c*1 and 4*c*2, maybe replaced with movable arms, if desired. The springs, constituting the pressing means 4*a* and 4*b*, may, of course, be implemented by tension springs in place of compression springs shown and described.

A path 8 is positioned downstream of the fold roller pair 6 and also aligned with the line L including the locus of movement of the fold plate 2. Another pair of fold rollers or reinforce rollers 6*a* and 6*b*, collectively 6, are positioned on the path 8 downstream of the fold rollers 3*a* and 3*b* in the direction of sheet conveyance. When the leading edge or fold of the sheet S or the sheet stack S, coming out of the nip N between the fold rollers 3*a* and 3*b*, enters a N' between the fold rollers (reinforce rollers hereinafter) 6*a* and 6*b*, the reinforce rollers 6*a* and 6*b* are caused to stop rotating. Subsequently, on the elapse of a preselected period of time, the reinforce rollers 6*a* and 6*b* are caused to rotate in the forward and reverse directions within a range that prevents the sheet or the sheet stack from slipping out of the nip N', thereby reinforcing the fold of the sheet or the sheet stack.

Figure 3:
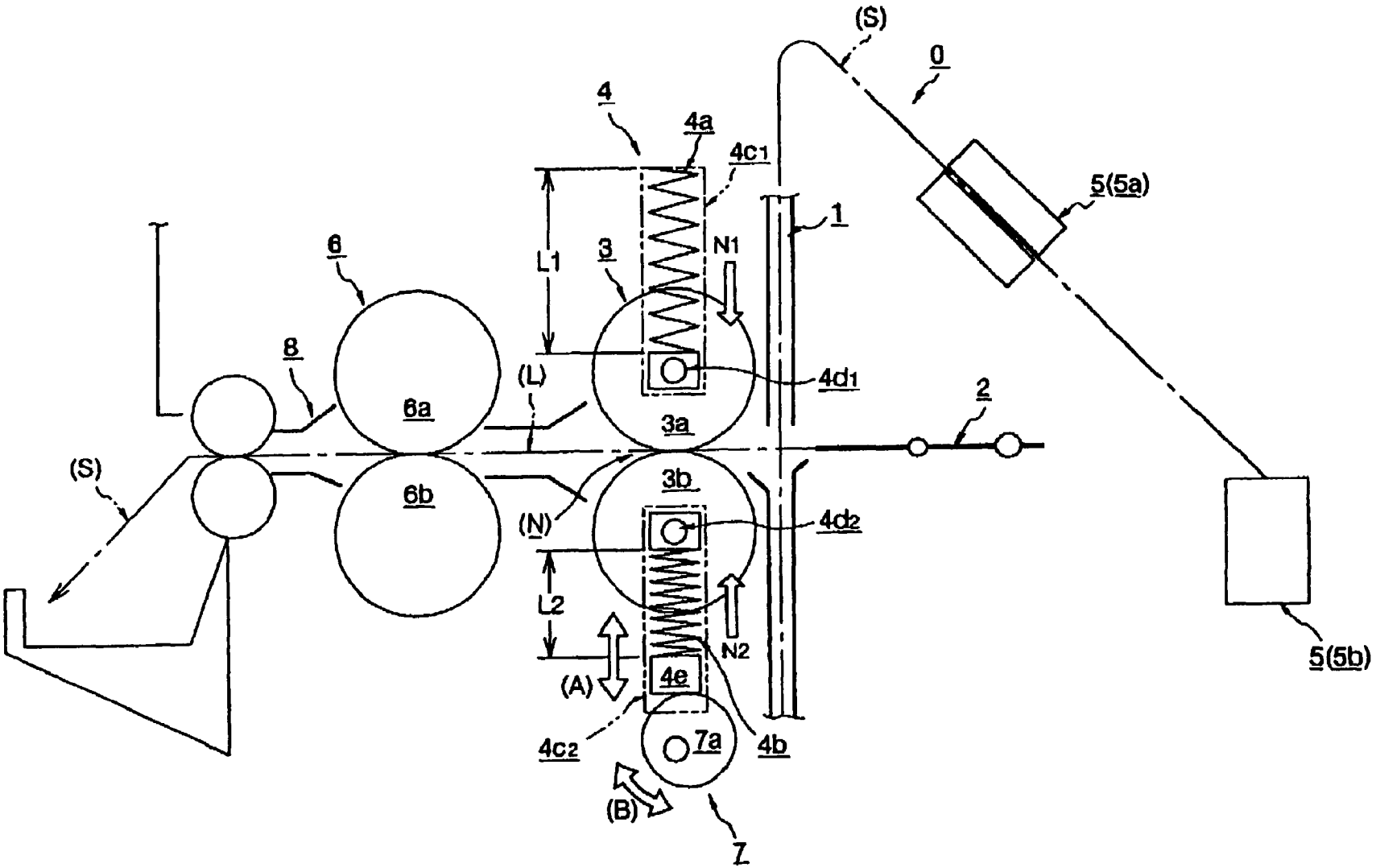
FIG. 3 is a view showing a modification of the first embodiment.
Figure 4:
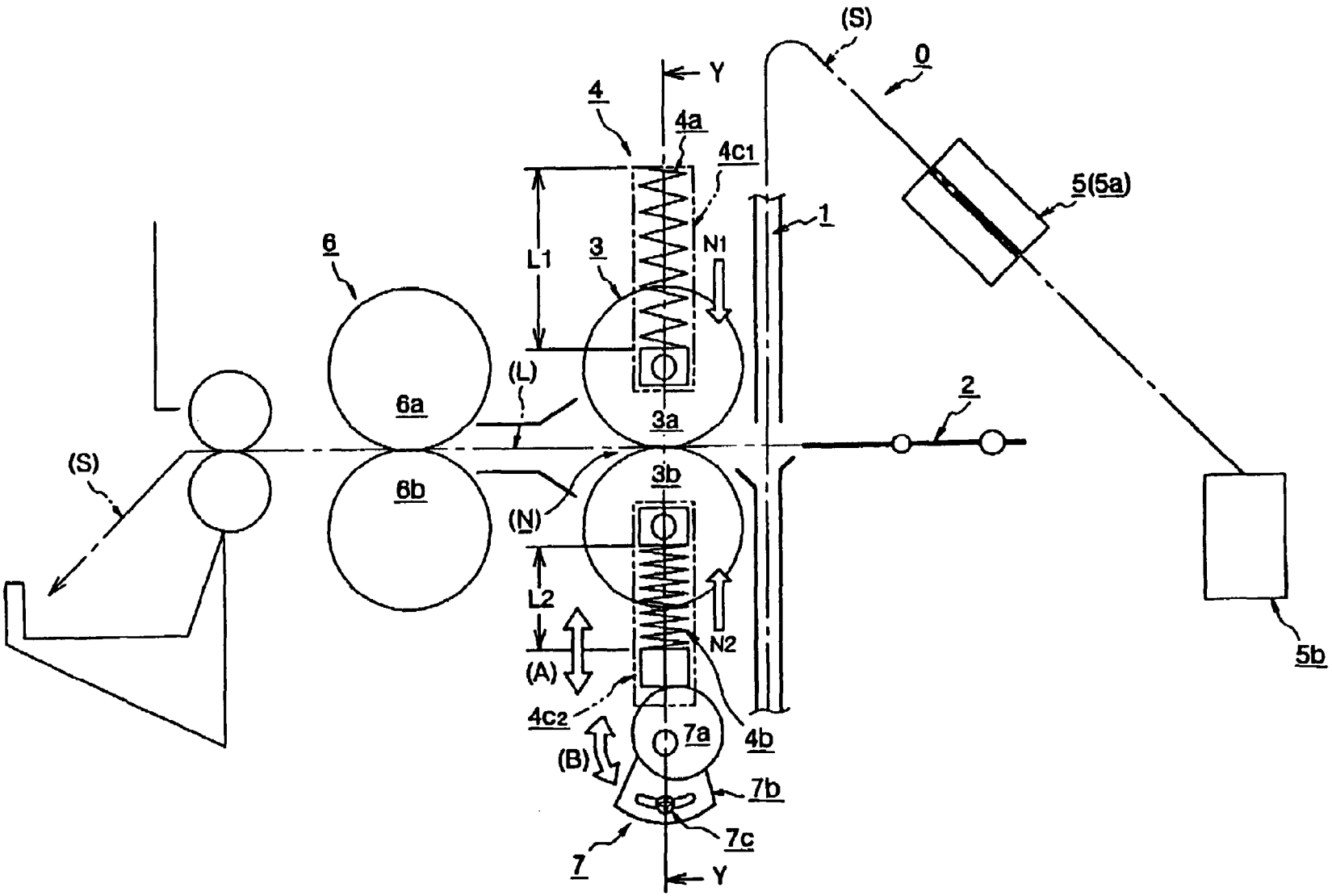
FIG. 4 is a view showing another modification of the first embodiment.
Figure 5:
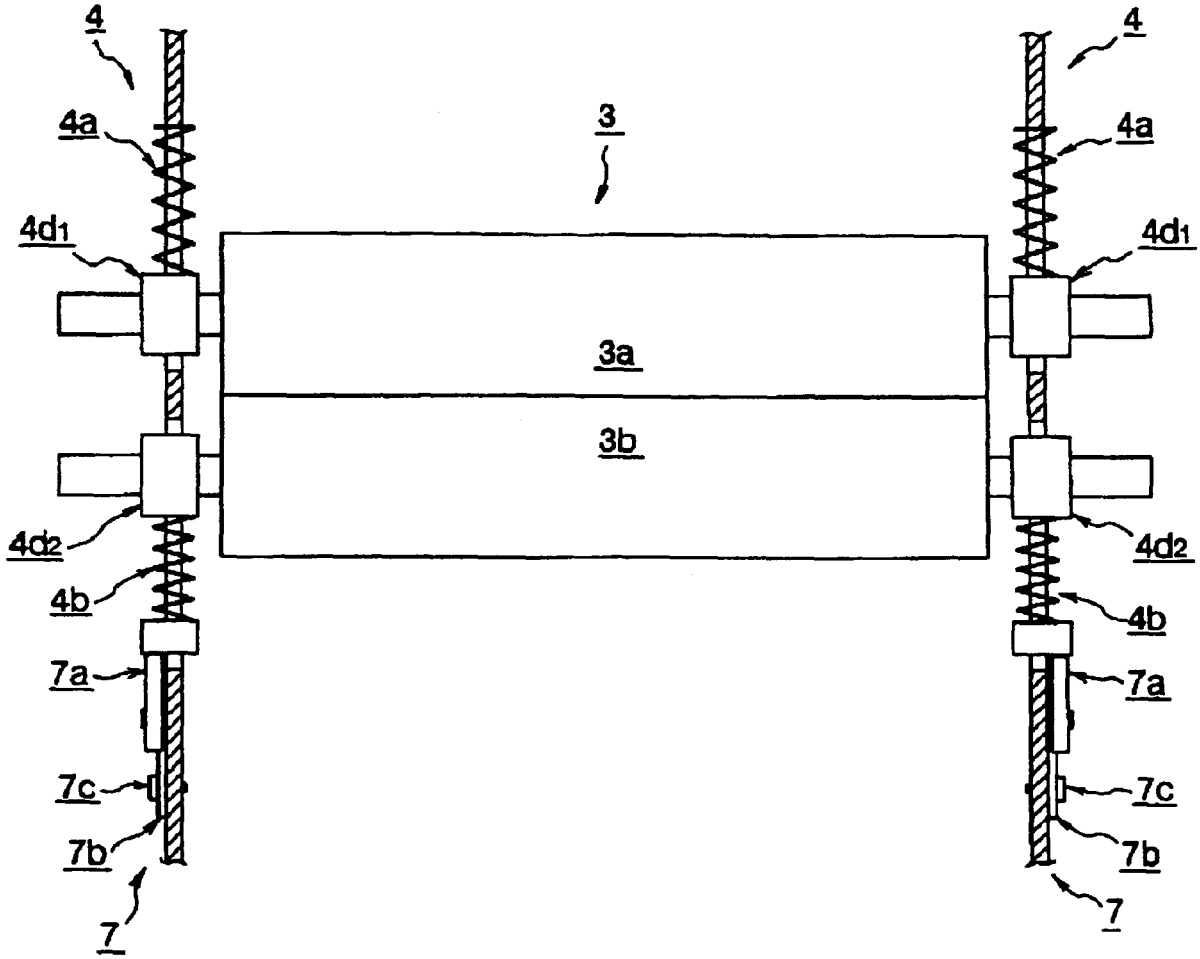
FIG. 5 is a section along line Y-Y of FIG. 4.

Reference will be made to FIGS. 3 through 5 for describing a modification of the illustrative embodiment. As shown in FIG. 3, the spring or lower pressing means 4*b* is anchored at one end to the lower bearing 4*d*2 and at the other end to a spring support member 4*e*, which is guided by the lower guide hole 4*c*2 in such a manner as to be movable in a direction indicated by an arrow A. The spring support member 4*e* is supported by an eccentric cam 7*a* included in pressure adjusting means 7. The eccentric cam 7*a* is rotatable in a direction indicated by an arrow B in FIG. 3 to thereby adjust the loaded length L2 of the spring 4*b*. The modification can therefore easily adjust the loaded length L2 with a simple configuration. As shown in FIGS. 4 and 5, after the adjustment of the loaded length L2, the eccentric cam 7*a* is locked at the adjusted position with a lock handle 7*b* being fastened by a screw 7*c*.

Therefore, even if the nip N between the fold rollers 3*a* and 3*b* is shifted from the line L after the assembly of the folding device 0, the nip N can be immediately adjusted. It follows that the nip N can be accurately positioned at all times and allows the stapled position implemented by, e.g., the center stapler 5*a* to accurately coincide with the folding position. This allows the sheet folding device 0 to provide the sheet or the sheet stack with a sharp fold for thereby allowing a plurality of stacks to be safely stacked without collapsing.

Figure 6:
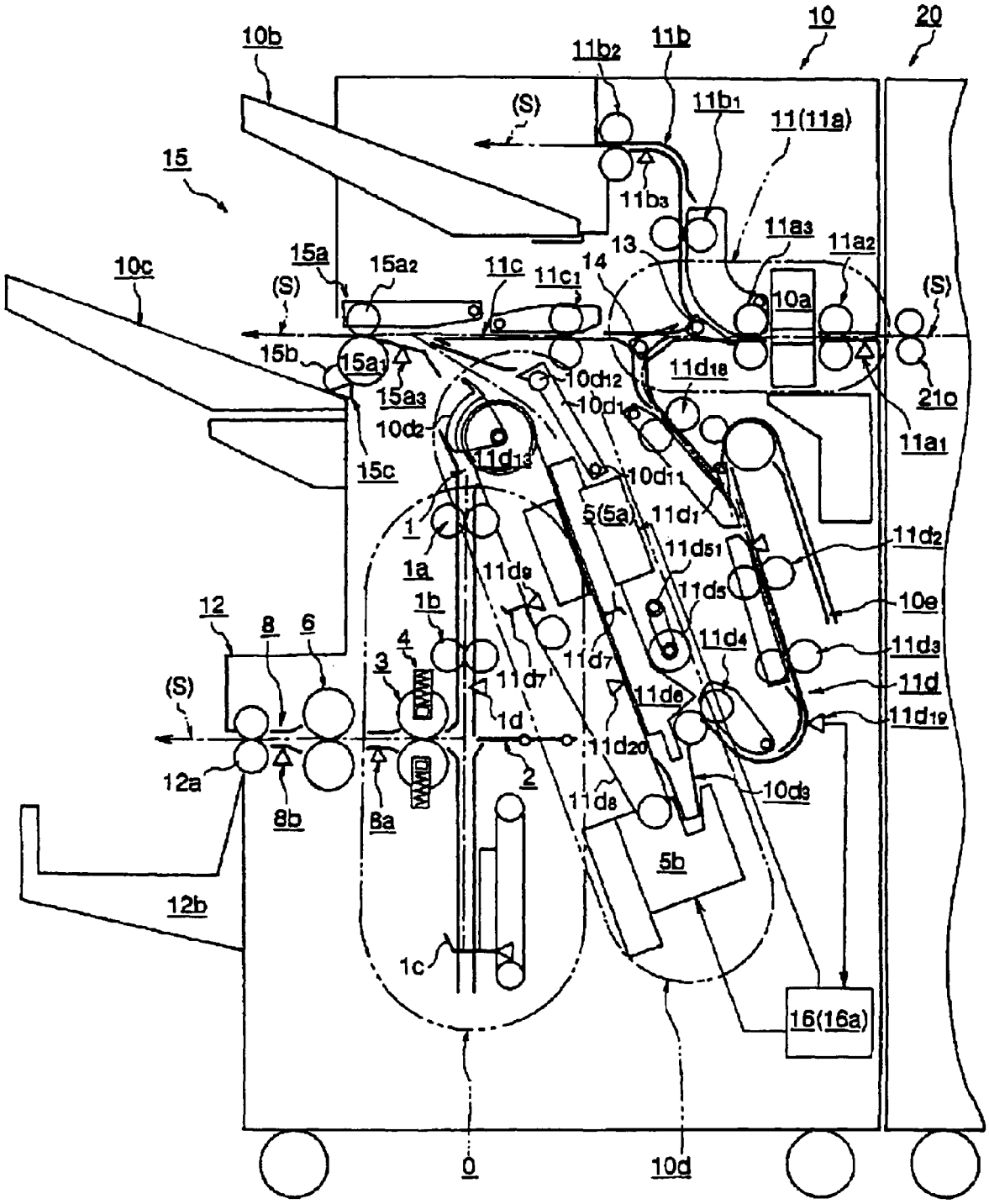
FIG. 6 is a view showing a sheet finisher including any one of the first embodiment and modifications thereof.

Referring to FIG. 6, a sheet finisher for finishing sheets will be described hereinafter. As shown, the finisher, generally 10, is operatively connected to an image forming apparatus 20. A sheet or recording medium S, carrying an image thereon and driven out of the image forming apparatus 20 via an outlet roller pair 210, is introduced into the sheet finisher 10 via an inlet. In the sheet finisher 10, a path 11*a* extends from the inlet and includes finishing means for finishing a single sheet. In the illustrative embodiment, this finishing means is implemented as a punch unit 10*a*. Path selectors 13 and 14 steer the sheet S coming in through the path 11*a* to any one of a path 11*b* terminating at an upper tray 10*b*, a path 11*c* terminating at a shift tray 10*c*, and a processing tray 10*d*. The processing tray 10*d* is used to position, staple or otherwise process a sheet or sheets and, in this sense, will be referred to as a staple tray hereinafter.

Sheets sequentially brought to the staple tray 10*d* via the paths 11*a* and 11*d* are positioned one by one, stapled or otherwise processed, and then steered by a guide plate 10*d*1 and a movable guide 10*d*2 to either one of the path 11*c* and folding device 0. The sheets folded by the folding device 0 are guided to a lower tray 12*b* via a path 8. The path lid includes a path selector 11*d*1 constantly biased to a position shown in FIG. 6 by a light-load spring not shown. An arrangement is made such that after the trailing edge of a sheet has moved away from the path selector 11*d*1, among a prestack roller, rollers 11*d*2 and 11*d*3 and a staple outlet roller 11*d*4, at least the prestack roller and roller 11*d*2 are rotated in the reverse direction to convey the trailing edge of the sheet to a prestacking portion 10*e* and cause the sheet to stay there. In this case, the sheet can be conveyed together with the next sheet superposed thereon. Such an operation may be repeated to convey two or more sheets together.

On the path 11*a*, merging into the paths 11*b*, 11*c* and 11*d*, there are sequentially arranged an inlet sensor 11*a*1 responsive to a sheet introduced into the finisher 20, an inlet roller pair 11*a*2, the punch unit 10*a*, a waste hopper, roller pair 11*a*3, and the path selectors 13 and 14. Springs, not shown, constantly bias the path selectors 13 and 14 to the positions shown in FIG. 6. When solenoids, not shown, are energized, the path selectors 13 and 14 rotate upward and downward, respectively, to thereby steer the sheet to desired one of the paths 11*b*, 11*c* and 11*d*.

More specifically, to guide a sheet to the path 11*b*, the path selector 13 is held in the position shown in FIG. 6 while the solenoid assigned thereto is deenergized. To guide a sheet to the path 11*c*, the solenoids are energized to rotate the path selectors 13 and 14 upward and downward, respectively. Further, to guide a sheet to the path 11*d*, the path selector 14 is held in the position shown in FIG. 6 while the solenoid assigned thereto is turned off; at the same time, the solenoid assigned to the path selector 13 is turned on to rotate it upward.

A shift tray outlet section 15, is located at the most downstream position of the sheet finisher 10 and includes a pair of shift outlet rollers 15*a*1 and 15*a*2, collectively 15, a return roller 15*b*, a sheet surface sensor 15*c*, and the shift tray 10*c*. The shift tray outlet section 15 additionally includes a shifting mechanism 15*e*, see FIGS. 10 through 12, and a shift tray elevating mechanism 15*d*, see FIGS. 7 through 9.

Figure 7:
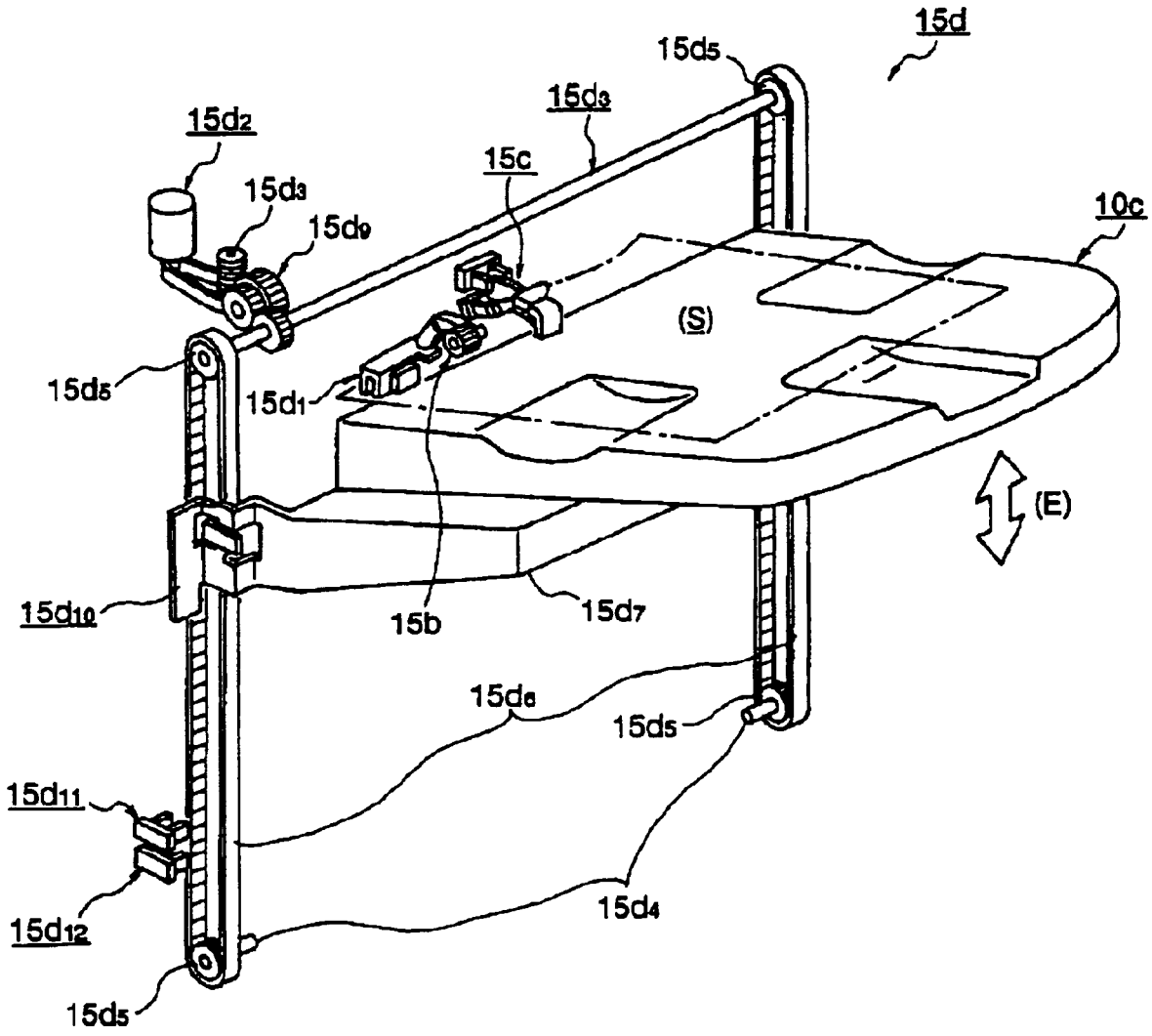
FIGS. 7 through 35 are views for describing the construction and operation of the sheet finisher shown in FIG. 6.
Figure 8:
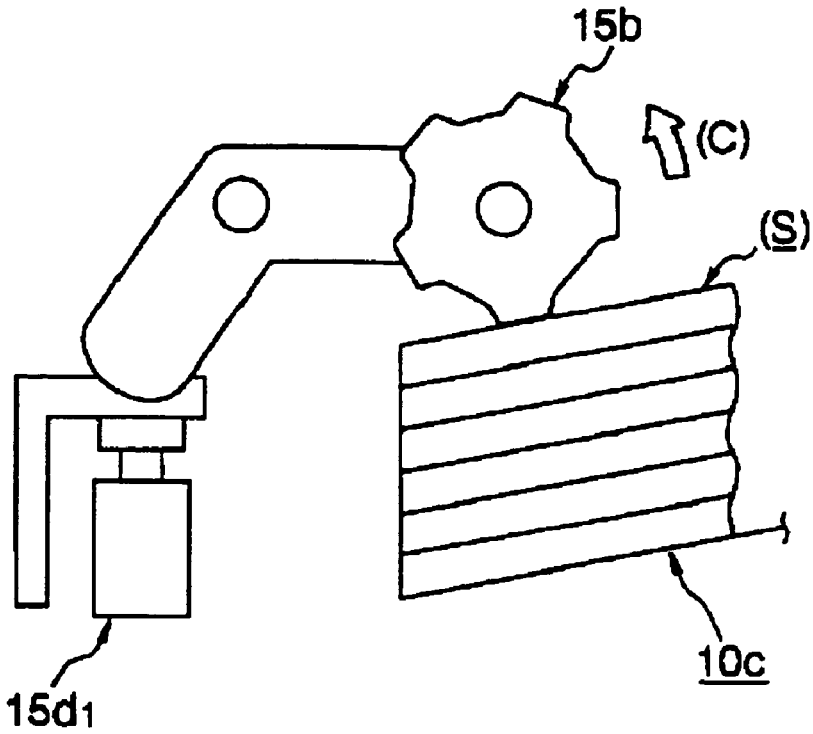

As shown in FIGS. 7 and 8, the return roller 15*b* contacts a sheet driven out by the shift outlet roller pair 15*a* and causes the trailing edge of the sheet to abut against an end fence, not shown, for thereby positioning it. The return roller 15*b* is formed of sponge and caused to rotate by the shift outlet roller pair 15*a*. A limit switch 15*d*1 is positioned in the vicinity of the return roller 15*b* such that when the shift tray 10*c* is lifted and raises the return roller 15*b*, the limit switch 15*d*1 turns on, causing a tray elevation motor 15*d*2 to stop rotating. This prevents the shift tray 10*c* from overrunning. As shown in FIG. 6, the sheet surface sensor 15*c* senses the surface of a sheet or that of a sheet stack driven out to the shift tray 10*c*.

Figure 9:
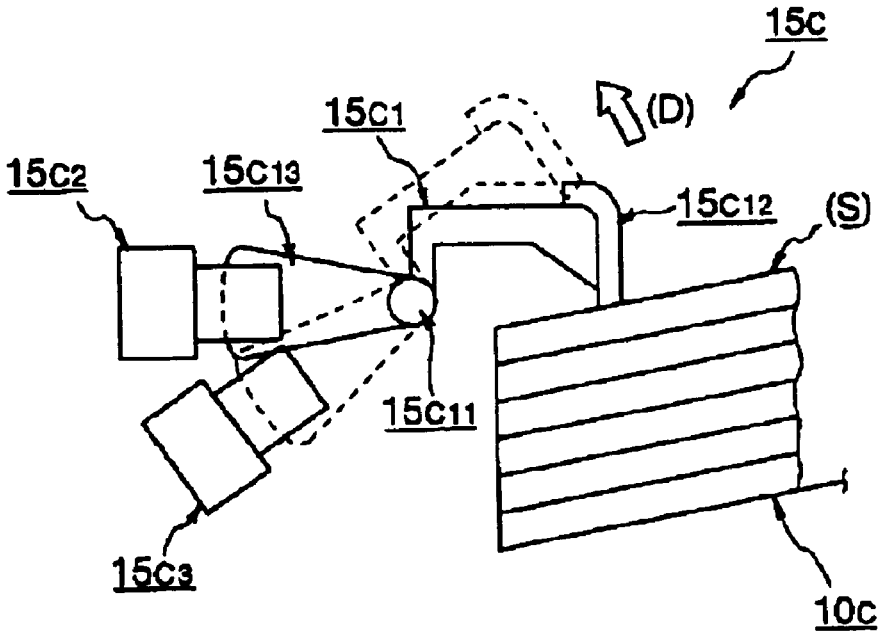

As shown in FIG. 9 specifically, the sheet surface sensor 15*c* is made up of a lever 15*c*1, a sensor 15*c*2 relating to stapling, and a sensor 15*c*3 relating to non-stapling. The lever 15*c*1 is angularly movable about its shaft portion and made up of a contact end 15*c*12 contacting the top of the trailing edge of a sheet on the shift tray 10*c* and a sectorial interrupter 15*c*13. The upper sensor 15*c*2 and lower sensor 15*c*3 are mainly used for staple discharge control and shift discharge control, respectively.

More specifically, in the illustrative embodiment, the sensors 15*c*2 and 15*c*3 each turn on when interrupted by the interrupter 15*c*13 of the lever 15*c*1. Therefore, when the shift tray 19*c* is lifted with the contact end 15*c*12 of the lever 15*c*1 moving upward, the sensor 15*c*2 turns off. As the shift tray 10*c* is further lifted, the sensor 15*c*3 turns off. When the outputs of the sensors 15*c*2 and 15*c*3 indicate that sheets are stacked on the shift tray 10*c* to a preselected height, the tray elevation motor 15*d*2 is driven to lower the shift tray 10*c* by a preselected amount. The top of the sheet stack on the shift tray 10*c* is therefore maintained at a substantially constant height.

The shift tray elevating mechanism 15*d* will be described in detail with reference to FIG. 7. As shown, the mechanism 15*d* includes a drive unit for moving the shift tray 10*c* upward or downward via a drive shaft 15*d*3. Timing belts 15*d*6 are passed over the drive shaft 15*d*3 and a driven shaft 15*d*4 under tension via timing pulleys 15*d*5. A side plate 15*d*7 supports the shift tray 10*c* and is affixed to the timing belts 15*d*6. In this configuration, the entire unit including the shift tray 10*c* is supported by the timing belts 15*d*6 in such a manner as to be movable up and down.

The drive unit includes a worm gear 15*d*8 in addition to the tray elevation motor 15*d*2, which is a reversible drive source. Torque output from the tray elevation motor 15*d*2 is transmitted to the last gear of a gear train mounted on the drive shaft 15*d*3 to thereby move the shift tray 10*c* upward or downward. The worm gear 15*d*8 included in the driveline allows the shift tray 10*c* to be held at a preselected position and therefore prevents it from dropping by accident.

An interrupter 15*d*10 is formed integrally with the side plate 15*d*7 of the shift tray 10*c*. A full sensor 15*d*11 responsive to the full condition of the shift tray 10*c* and a lower limit sensor 15*d*12 responsive to the lower limit position of the shift tray 10*c* are positioned below the interrupter 15*d*10. The full sensor 15*d*11 and lower limit sensor 15*d*12, which are implemented by photosensors, each turn off when interrupted by the interrupter 15*d*10. In FIG. 7, the drive roller 15*a*1 and 15*a*2, constituting the shift outlet roller pair 15, are not shown.

Figure 10:
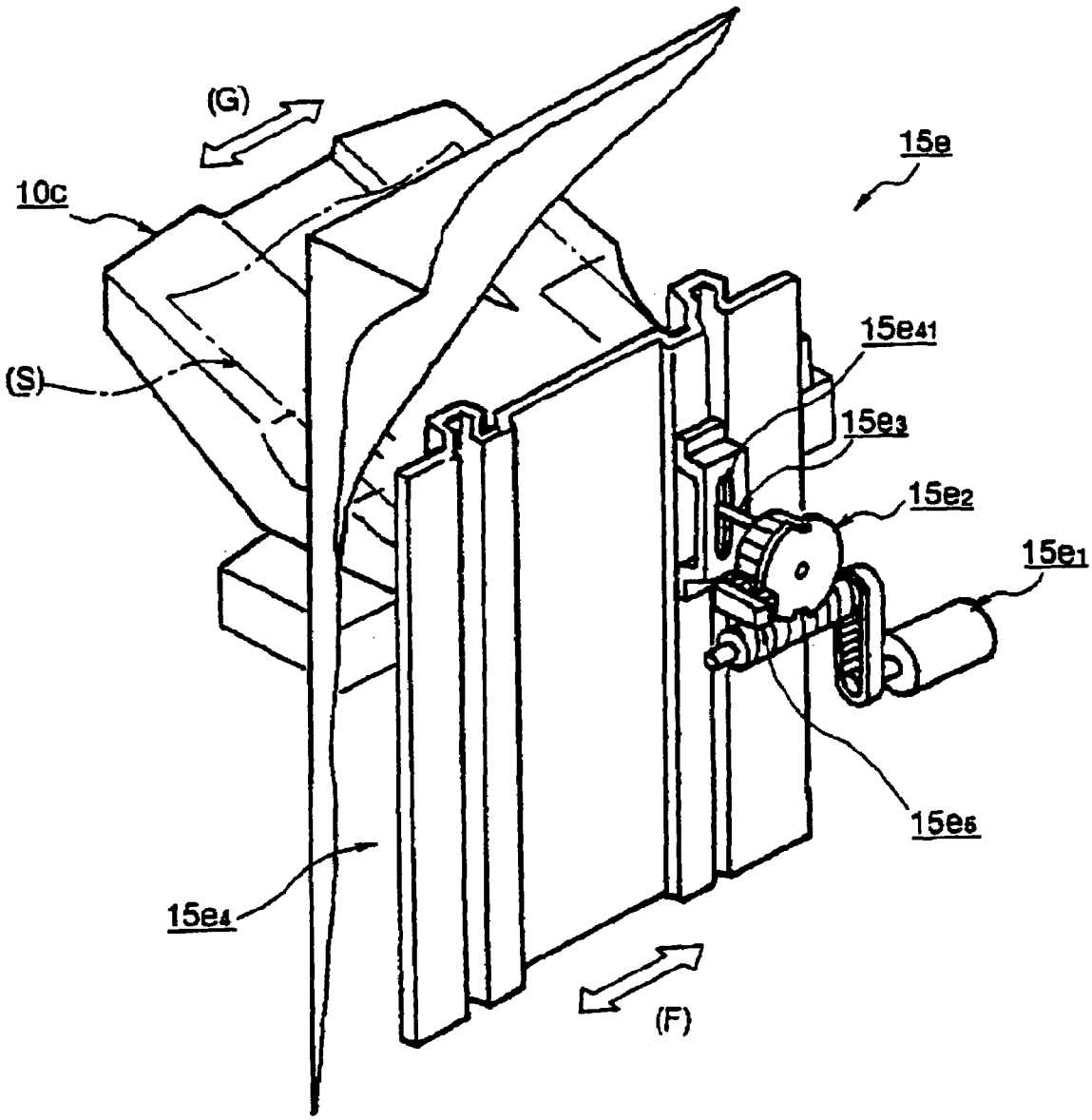
Figure 11:
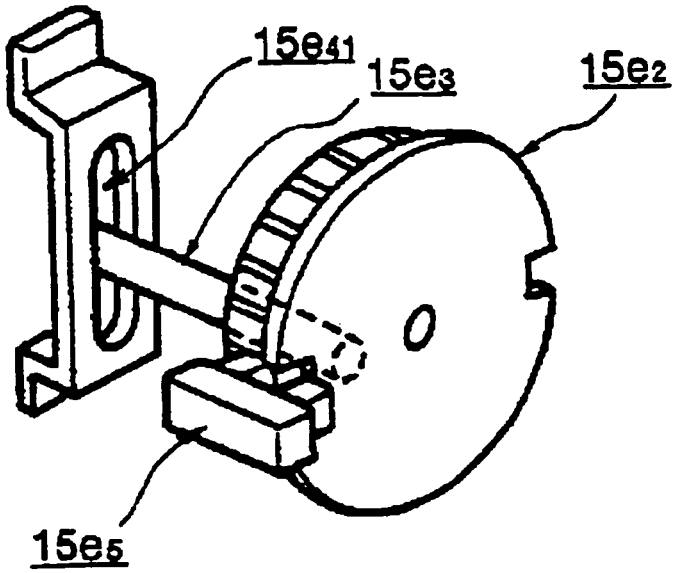
Figure 12:
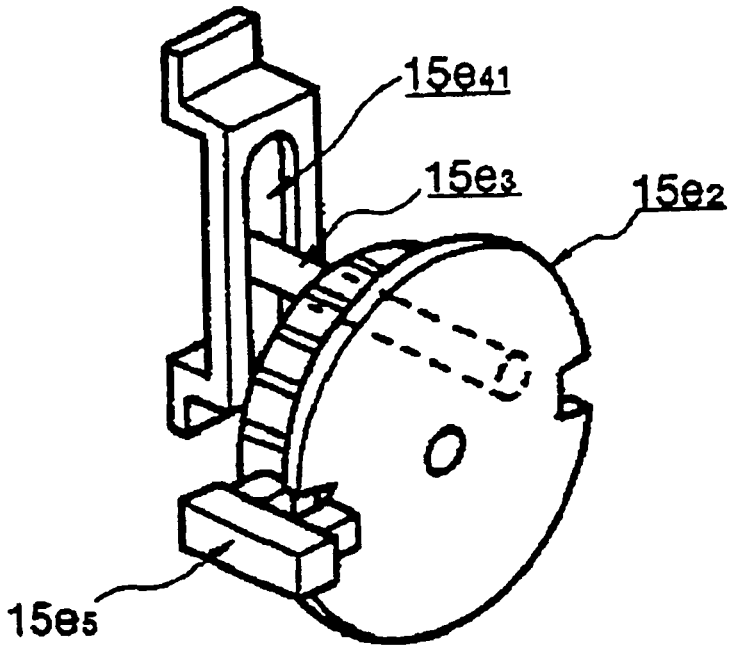

FIGS. 10 through 12 show the shifting mechanism 15*a*. As shown in FIG. 10, the shifting mechanism 15*a* includes a shift motor 15*e*1 and a cam 15*e*2. When the shift motor or drive source 15*e*1 causes the cam 15*e*2 to rotate, the cam 15*e*2 causes the shift tray 10*c* to move back and forth in a direction perpendicular to a direction of sheet discharge. A pin 15*e*3 is studded on the shift cam 15*e*2 at a position spaced from the axis of the shift cam 15*e*2 by a preselected distance. The tip of the pin 15*e*3 is movably received in an elongate slot 15*e*41 formed in an end fence 15*e*4, which guides the rear edge of the sheets S stacked on the shift tray 10*c*. The end fence 15*e*4 moves back and forth in a direction perpendicular to the direction of sheet discharge in accordance with the angular position of the pin 15*e*3, entraining the shift tray 10*c* in the same direction. The shift tray 10*c* stops at a front position and a rear position in the direction perpendicular to the sheet surface of FIG. 6. A shift sensor 15*e*5 is responsive to a notch formed in the shift cam 15*e*2. To stop the shift tray at the above two positions, the shift motor 15*e*1 is selectively energized or deenergized on the basis of the output of the shift sensor 336.

Figure 13:
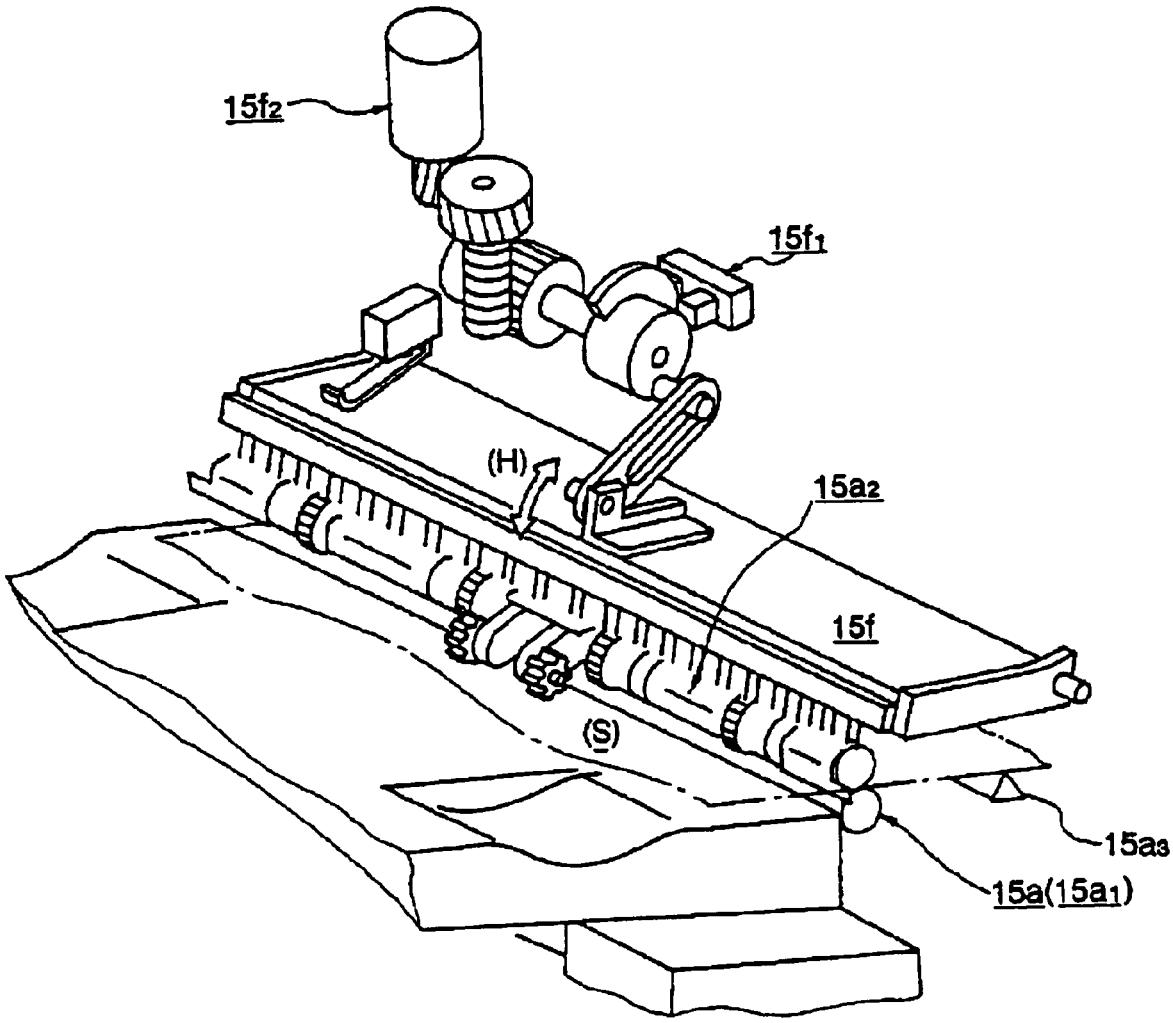

FIG. 13 shows a specific configuration of the arrangement for discharging a sheet to the shift tray 10*c*. The shift roller pair 15*a* has a drive roller 15*a*1 and a driven roller 15*a*2. A guide plate 15*f* is supported at its upstream side in the direction of sheet discharge and angularly movable in the up-and-down direction. The driven roller 15*a*2 is supported by the guide plate 15*f* and contacts the drive roller 15*a*1 due to its own weight or by being biased, nipping a sheet between it and the drive roller 15*a*1. When a stapled sheet stack is to be driven out to the shift tray 10*c*, the guide plate 15*f* is lifted and then lowered at a preselected timing, which is determined on the basis of the output of a guide plate sensor 15*f*1. A guide plate motor 15*f*2 drives the guide plate 15*f*.

Figure 14:
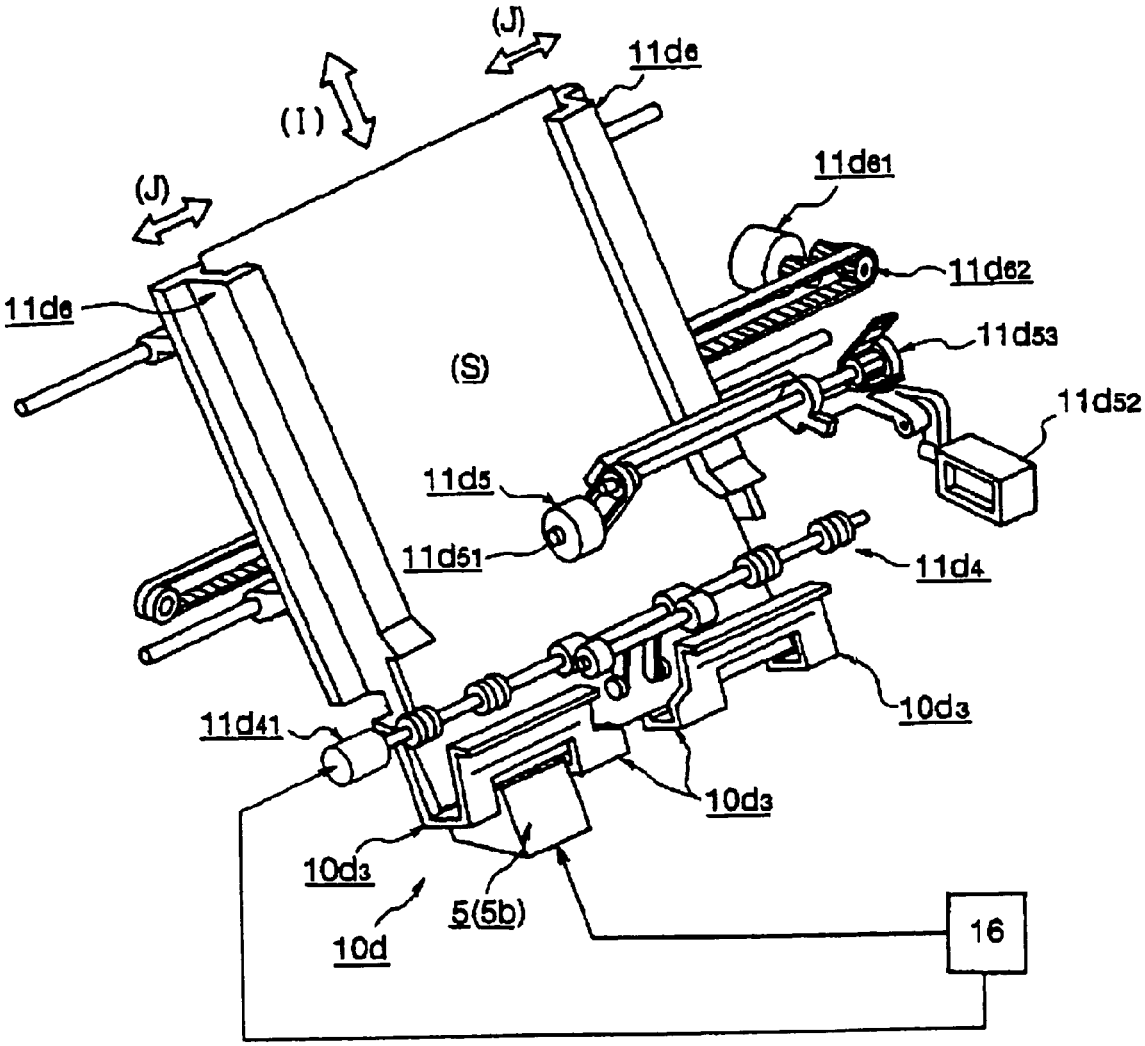
Figure 15:
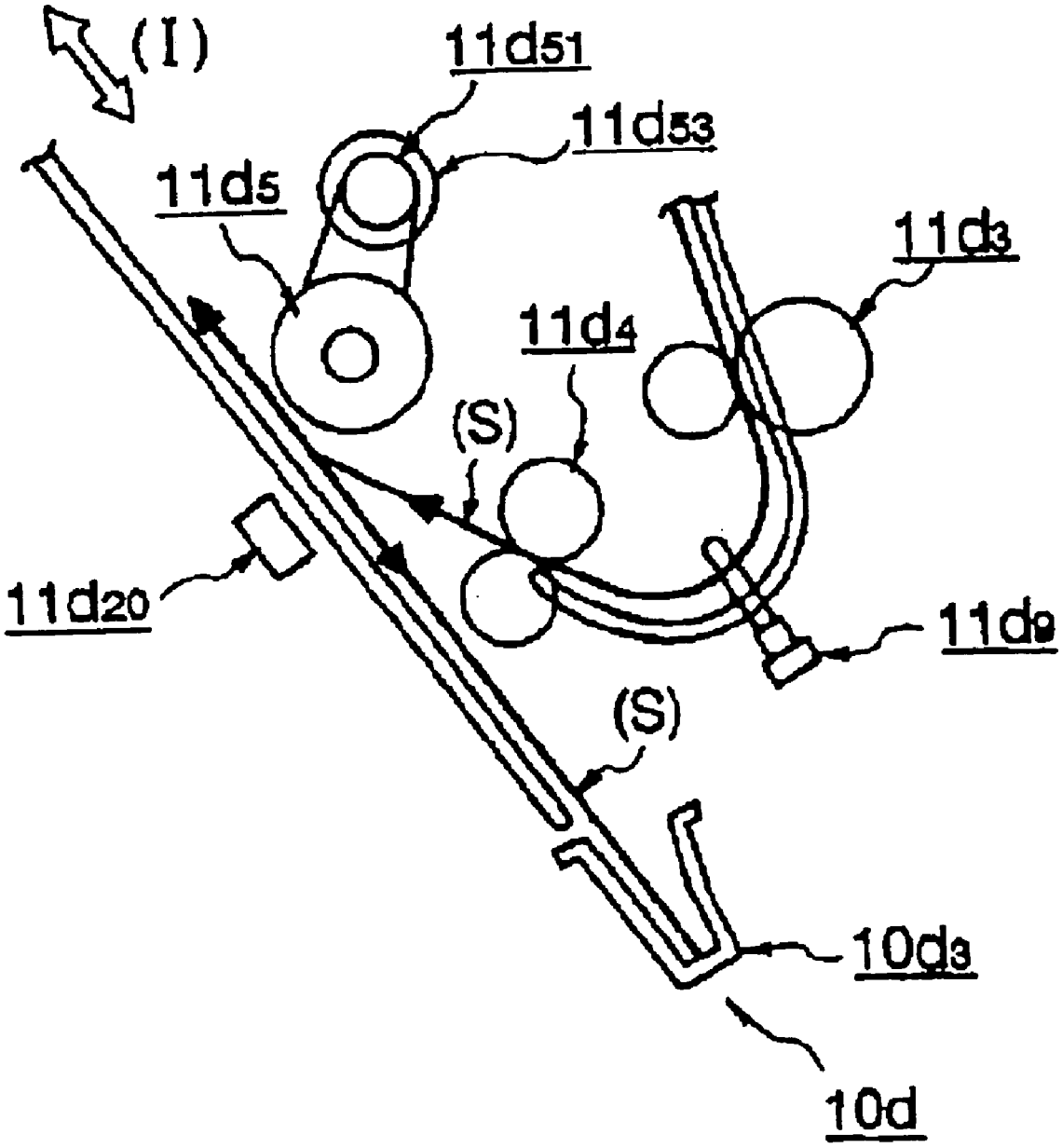
Figure 16:
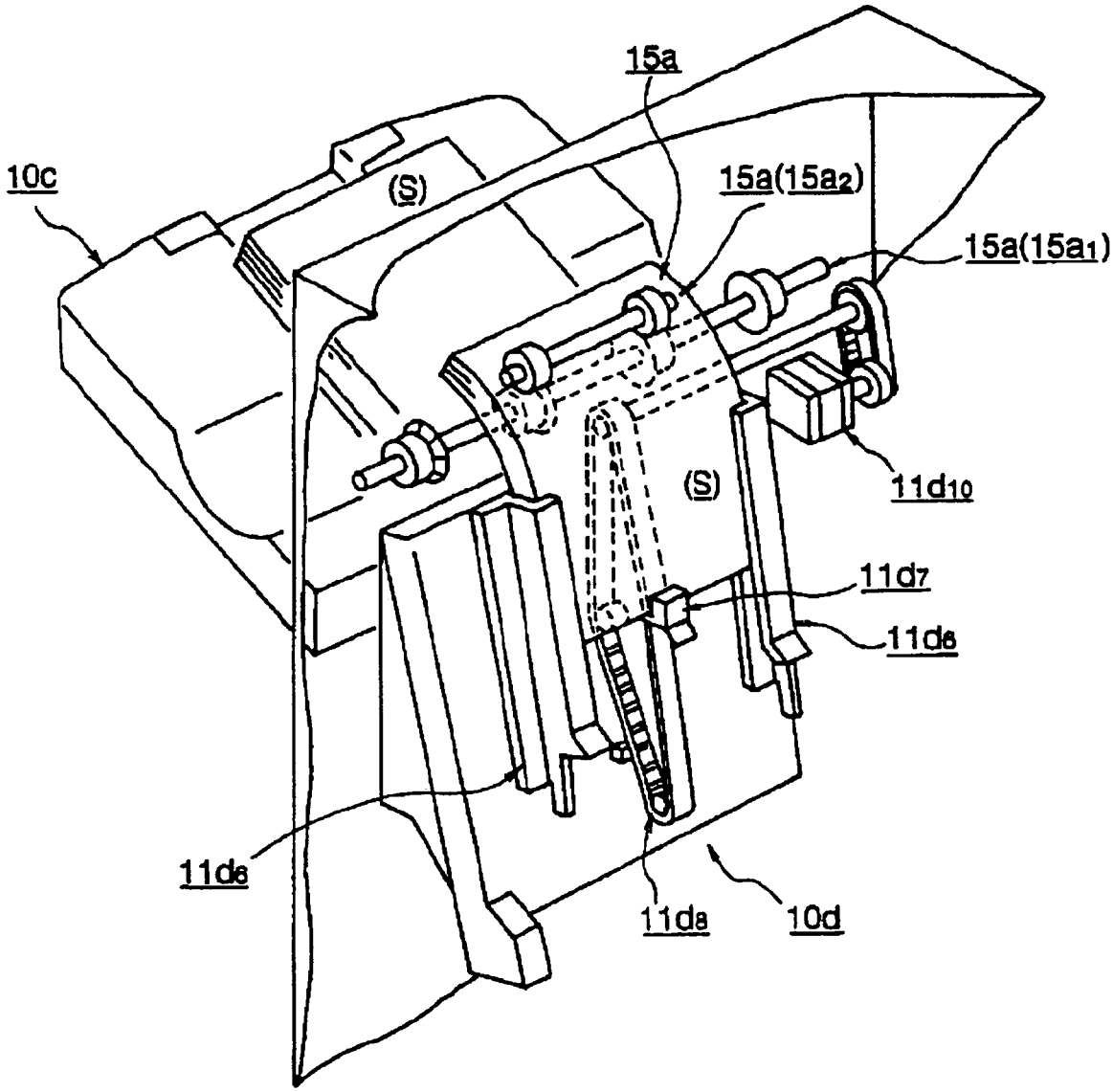
Figure 17:
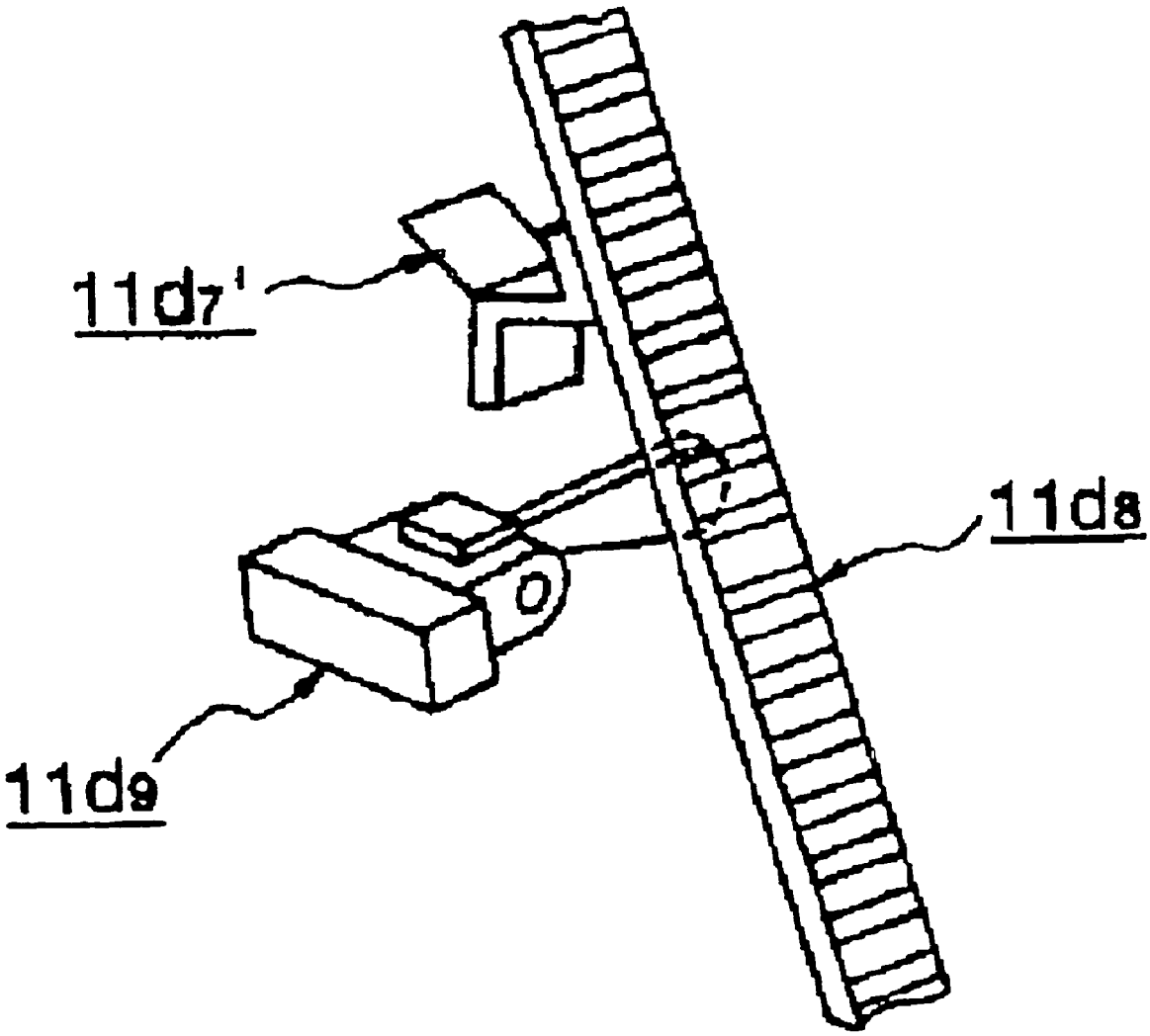

FIGS. 14 through 20 show the staple tray 10*d* for allowing the center stapler 5*a* and edge stapler 5*b* to staple a sheet stack at the center and the edge, respectively. As shown in FIGS. 14 and 15, sheets sequentially conveyed by the staple outlet roller pair 11*d*4 to the staple tray 10*d* are sequentially stacked on the staple tray 10*d*. At this instant, a knock roller 11*d*5 knocks every sheet for positioning it in the vertical direction (direction of sheet conveyance) while jogger fences 11*d*6 position the sheet in the horizontal direction perpendicular to the sheet conveyance (sometimes referred to as a direction of sheet width). Between consecutive jobs, i.e., during an interval between the last sheet of a sheet stack and the first sheet of the next sheet stack, a controller 16, see FIG. 35, outputs a staple signal for causing an edge stapler 5*b* to perform a stapling operation. A discharge belt 11*d*8 with a hook 11*d*7 immediately conveys the stapled sheet stack to the shift outlet roller pair 15*a*, so that the shift outlet roller pair 15*a* conveys the sheet stack to the shift tray 10*c* held at a receiving position, as shown in FIGS. 16 and 17.

As shown in FIG. 17, a belt HP (Home Position) sensor 11*d*9 senses the hook 11*d*7 of the discharge belt 11*d*8 brought to its home position. More specifically, two hooks 11*d*7 are positioned on the discharge belt 11*d*8 face-to-face at spaced locations in the circumferential direction and alternately convey sheet stacks stapled on the staple tray 10*d* one after another. The discharge belt 11*d*8 may be moved in the reverse direction such that one hook 11*d*7 held in a stand-by position and the back of the other hook 11*d*7' position the leading edge of the sheet stack stored in the staple tray 10*d* in the direction of sheet conveyance, as needed. The hook 11*d*7 therefore plays the role of positioning means at the same time.

Figure 18:
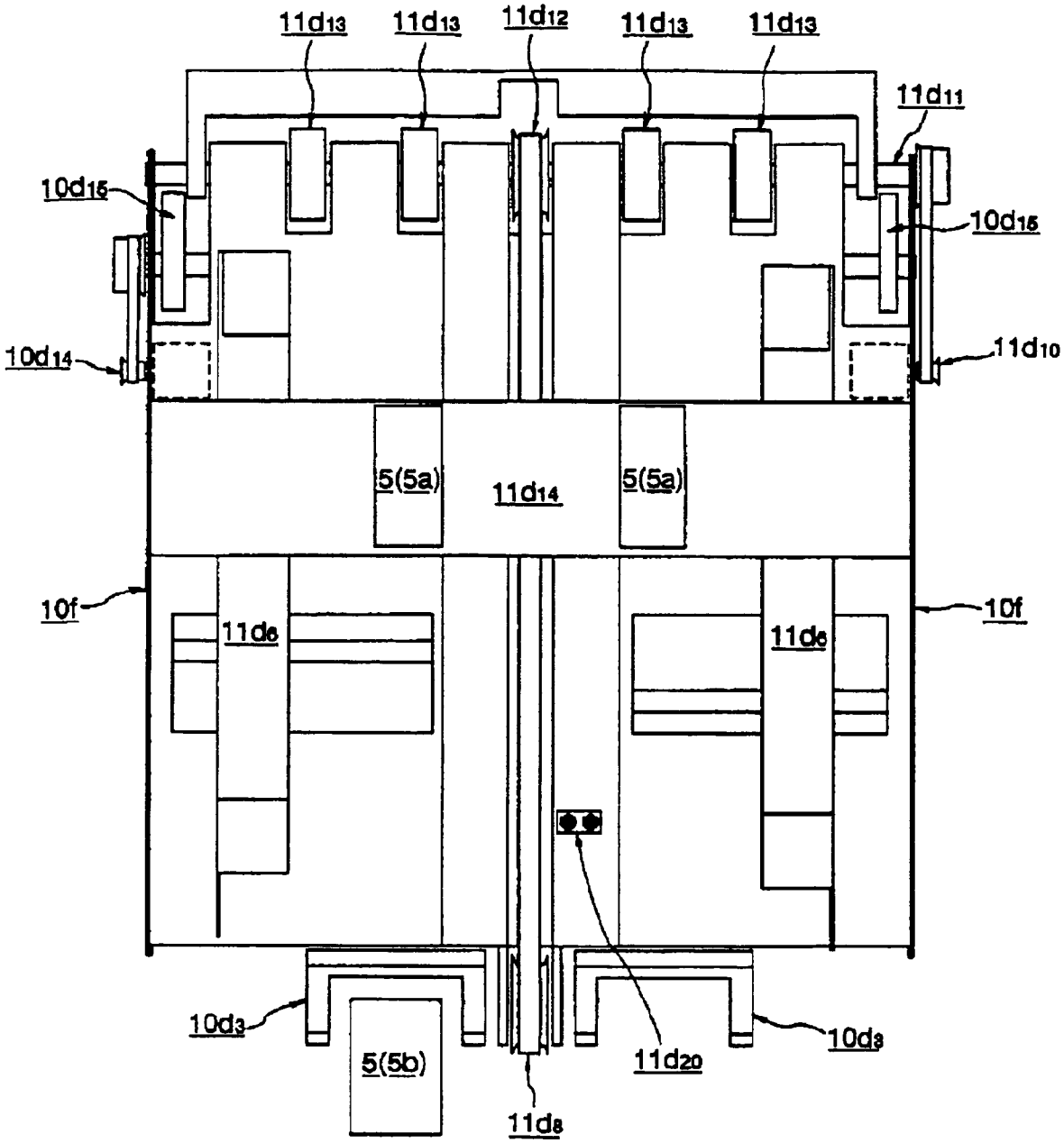

As shown in FIG. 18, a discharge motor 11*d*10 causes the discharge belt 11*d*8 to move via a discharge shaft 11*d*11. The discharge belt 11*d*8 and a drive pulley 11*d*12 therefor are positioned at the center of the discharge shaft 11*d*11 in the direction of sheet width. Discharge rollers 11*d*13 are mounted on the discharge shaft 11*d*11 in a symmetrical arrangement. The discharge rollers 11*d*13 rotate at a higher peripheral speed than the discharge belt 11*d*8.

A processing mechanism will be described hereinafter. As shown in FIGS. 14 and 15, a solenoid (SOL) 11*d*52 causes the knock roller 11*d*5 to move about a fulcrum 11*d*51 in a pendulum fashion, so that the knock roller 11*d*5 intermittently acts on sheets sequentially driven to the staple tray 10*d* and causes their trailing edges to abut against rear fences 10*d*3. The knock roller 11*d*5 rotates counterclockwise about its axis. A jogger motor 11*d*61 drives the jogger fences 10*d*3 via a timing belt and causes them to move back and forth in the direction of sheet width.

As shown in FIGS. 6 and 18, a pair of center staplers 5*a* are affixed to a stay 11*d*4 and are located at a position where the distance between the rear fences 10*d*3 and their stapling positions is equal to or greater than one-half of the length of the maximum sheet size, as measured in the direction of conveyance, that can be stapled. The center staplers S2 are symmetrical to each other with respect to the center in the direction of sheet width. The center staplers S2 themselves are conventional and will not be described specifically.

Figure 19:
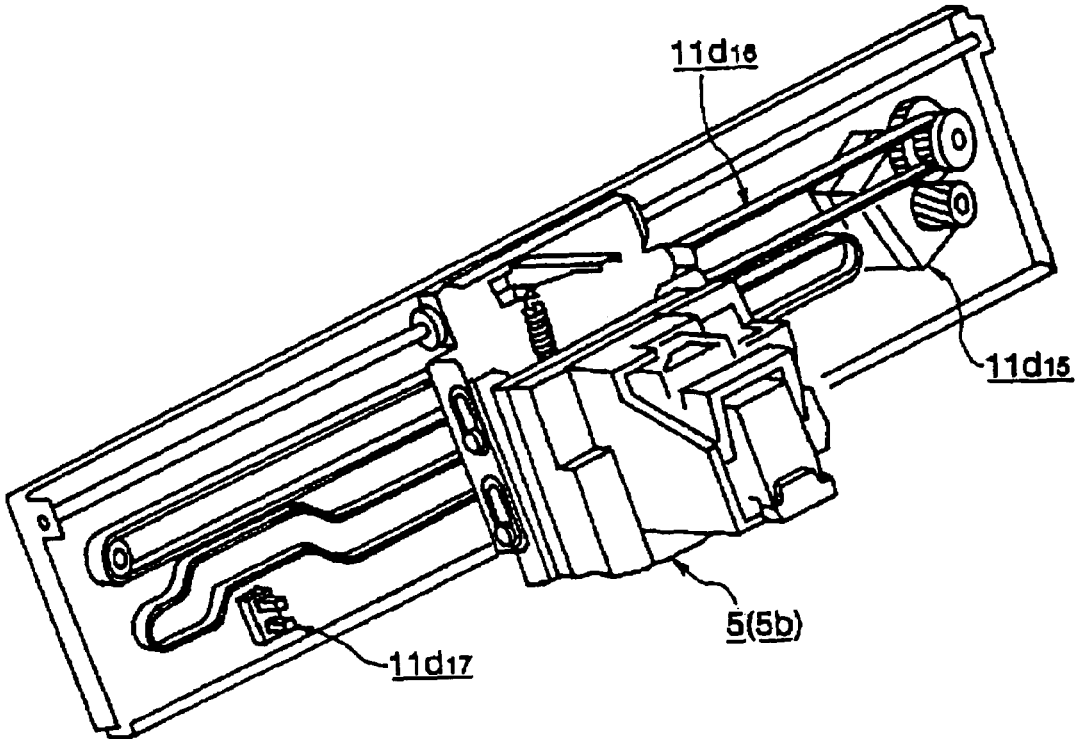

As shown in FIG. 19, a mechanism for moving the edge stapler 5*b* includes a reversible, stapler motor 11*d*15 for driving the edge stapler 5*b* via a timing belt. The edge stapler 5*b* is movable in the direction of sheet width in order to staple a sheet stack at a desired edge position. A stapler HP sensor 11*d*17 is positioned at one end of the movable range of the edge stapler 5*b* in order to sense the stapler 5*b* brought to its home position. The stapling position in the direction of sheet width is controlled in terms of the displacement of the edge stapler 5*b* from the home position.

Figure 20:
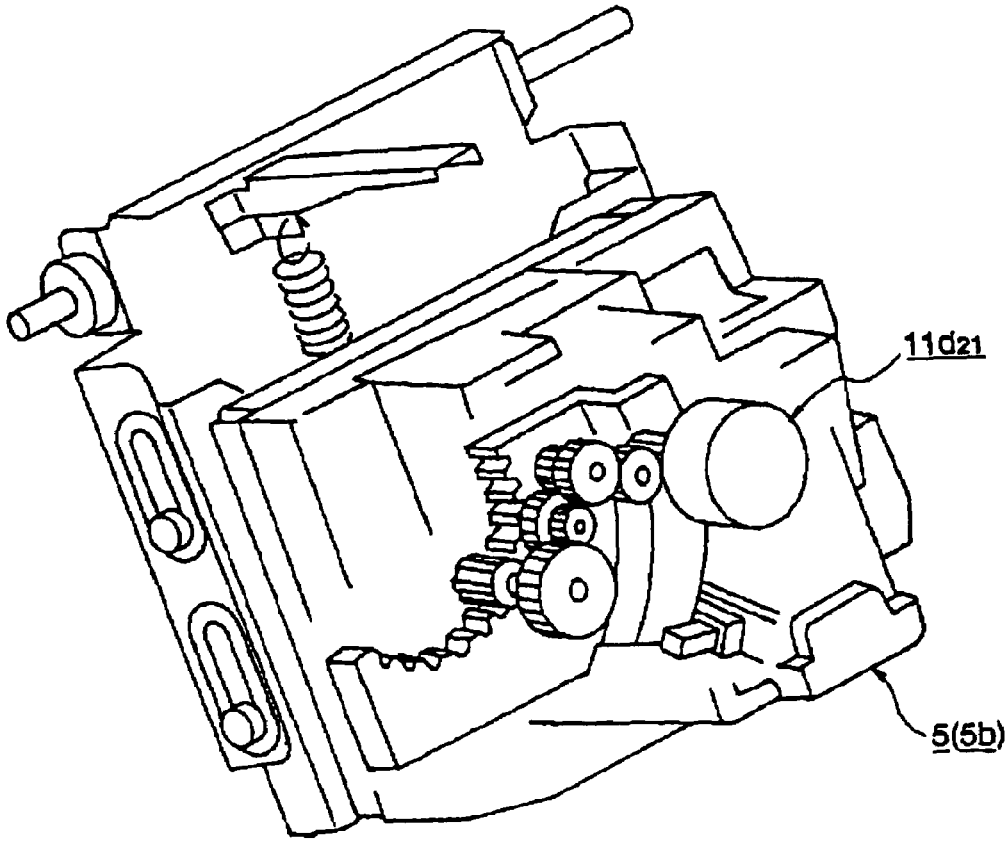

As shown in FIG. 20, the edge stapler 5*b* is capable of selectively driving a staple into a sheet stack in parallel to or obliquely relative to the edge of the sheet stack. Further, at the home position, only the stapling mechanism portion of the edge stapler 5*b* is rotatable by a preselected angle for the replacement of staples. For this purpose, an oblique motor 11*d*21 causes the above mechanism of the edge stapler 5*b* to rotate Reference will be made to FIGS. 21 through 23 for describing a specific mechanism for driving the guide plate 10*d*1. As shown, the mechanism includes the guide plate or steering means 54 and movable guide 55 mentioned earlier. The guide plate 10*d*1 is angularly movable about a fulcrum 10*d*11 in the up-and-down direction and supports a press roller 10*d*12, which is freely rotatable, on its downstream end. A spring 10*d*13 constantly biases the guide plate 10*d*1 toward the discharge roller 11*d*13. The guide plate 11*d*1 is held in contact with the cam surface 10151 of a cam 10*d*15, which is driven by a steer motor 10*d*14.

The movable guide 10*d*2 is angularly movably mounted on the shaft 11*d*131 of the discharge roller 11*d*13. A link arm 10*d*21 is connected to one end of the movable guide 10*d*2 remote from the guide plate 10*d*1 at a joint. A pin 10*d*22, studded on a front sidewall 10*f* shown in FIG. 18, is movably received in an elongate slot 10*d*23 formed in the link arm 10*d*21, limiting the movable range of the movable guide 10*d*2. A spring 10*d*13 holds the link arm 10*d*21 in the position shown in FIG. 21.

When the steer motor 19*d*1 causes the cam 10*d*15 to rotate to a position where its cam surface 10*d*151 presses the link arm 10*d*21, the movable guide 10*d*2 connected to the link arm 10*d*21 angularly moves upward. A guide HP sensor 10*d*25 senses the home position of the cam 10*d*15 on sensing the interrupter portion 10*d*26 of the cam 10*d*15. Therefore, the stop position of the cam 10*d*15 is controlled on the basis of the number of drive pulses input to the steer motor 10*d*14 counted from the home position of the cam 10*d*15, as will be described later in detail.

Figure 21:
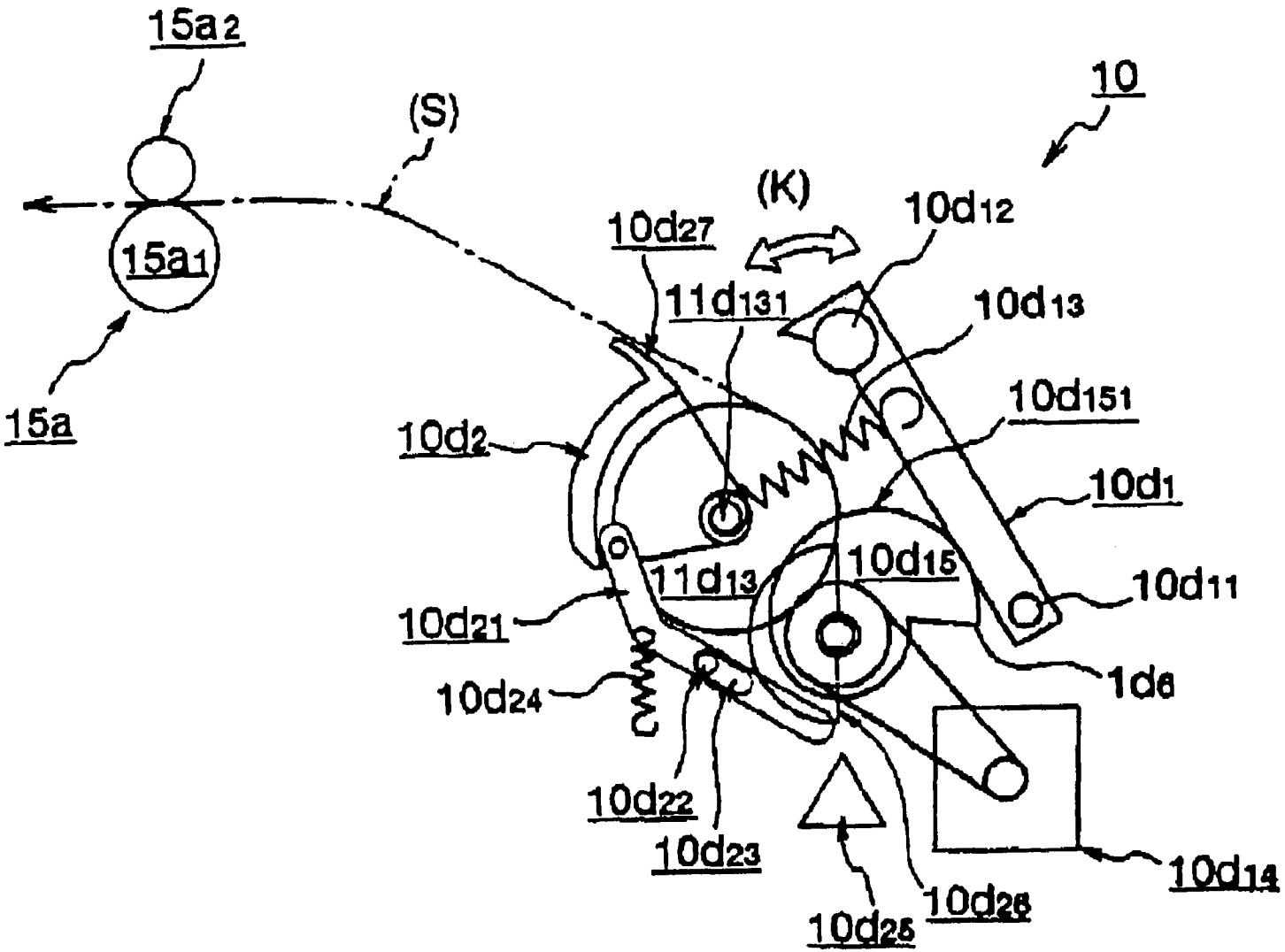

FIG. 21 shows a positional relation to hold between the guide plate 10*d*1 and the movable guide 10*d*2 when the cam 10*d*15 is held at its home position. As shown, the guide surface 10*d*27 of the movable guide 10*d*2 guides a sheet stack S on the path extending between the shift outlet roller 15*a* and the drive roller 15*a*1 and driven roller 15*a*2.

Figure 22:
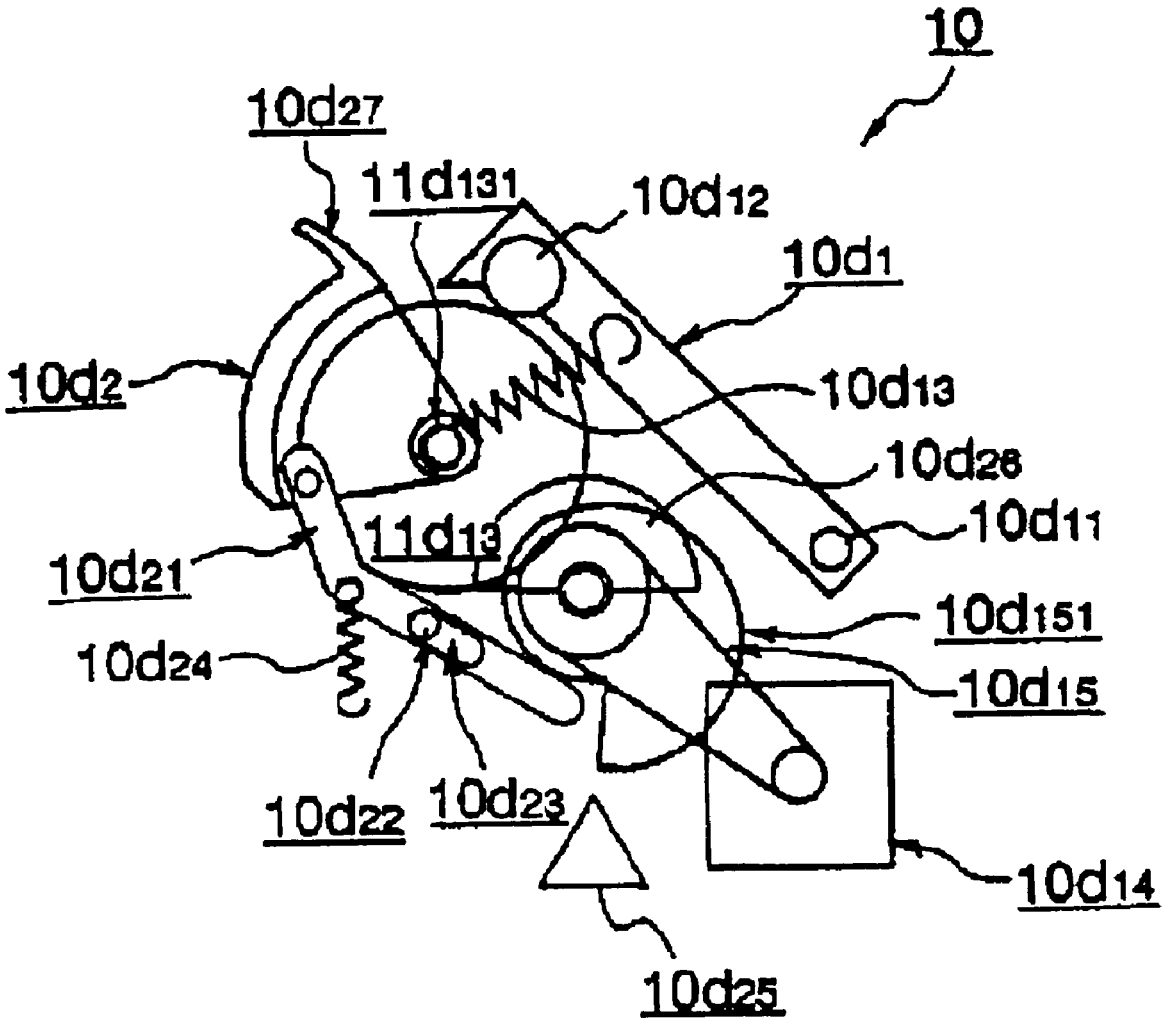

FIG. 22 shows a condition wherein the guide plate 10*d*1 is caused to move downward by the cam 1-d15 with the press roller 10*d*12 pressing the discharge roller 11*d*13.

Figure 23:
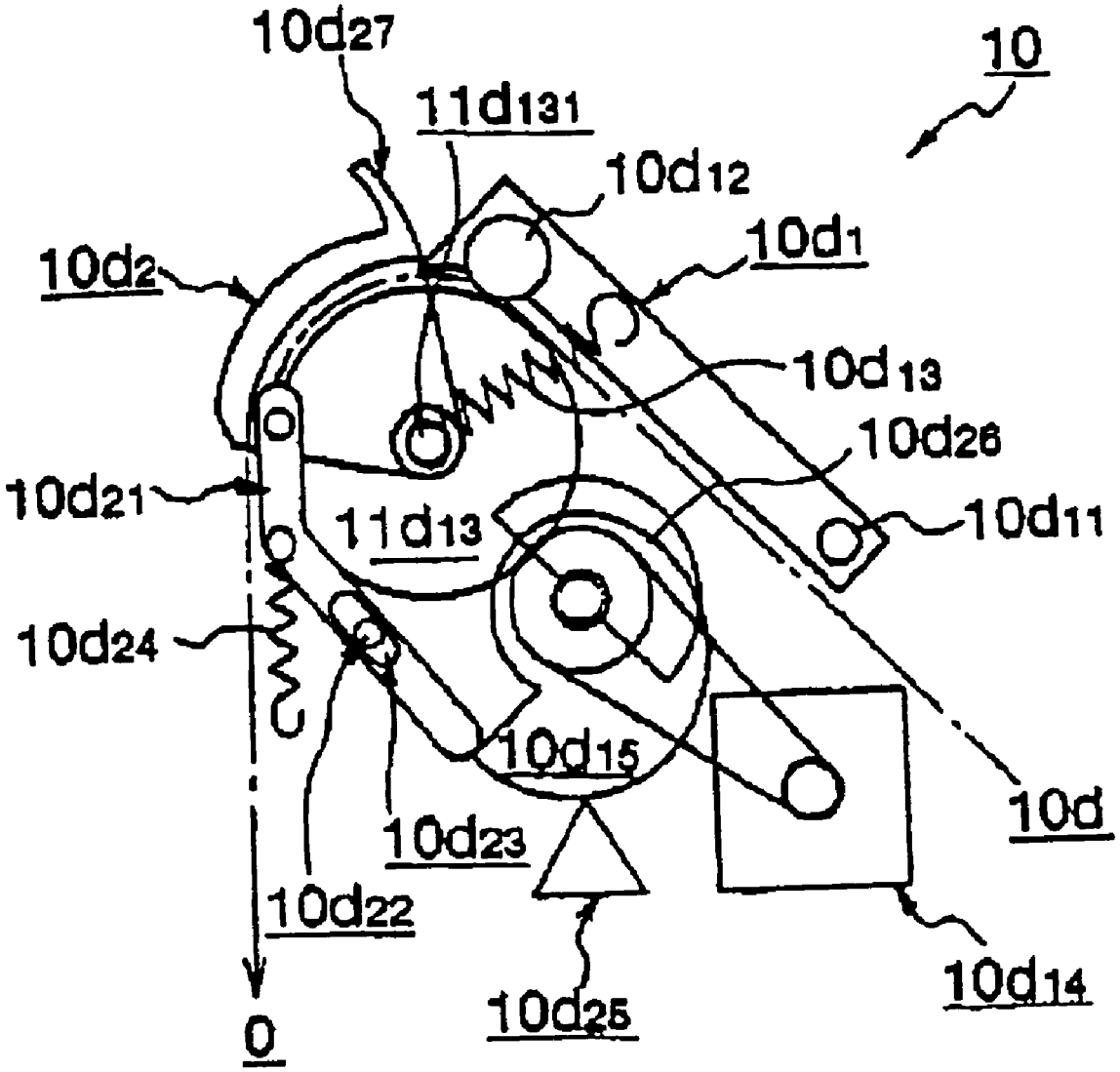

FIG. 23 shows a condition wherein the cam 10*d*15 has further rotated from the above position to move the movable guide 10*d*2 upward. In this condition, the guide plate 10*d*1 and movable guide 10*d*2 form the route extending from the staple tray 10*d* toward the folding device 0. FIG. 18 shows the same relation as seen in the direction of depth.

While in the illustrative embodiment the guide plate 10*d*1 and movable guide 10*d*2 share a single drive motor, each of them may be driven by a respective drive motor, so that the timing of movement and stop position can be controlled in accordance with the sheet size and the number of sheets stapled together.

Figure 24:
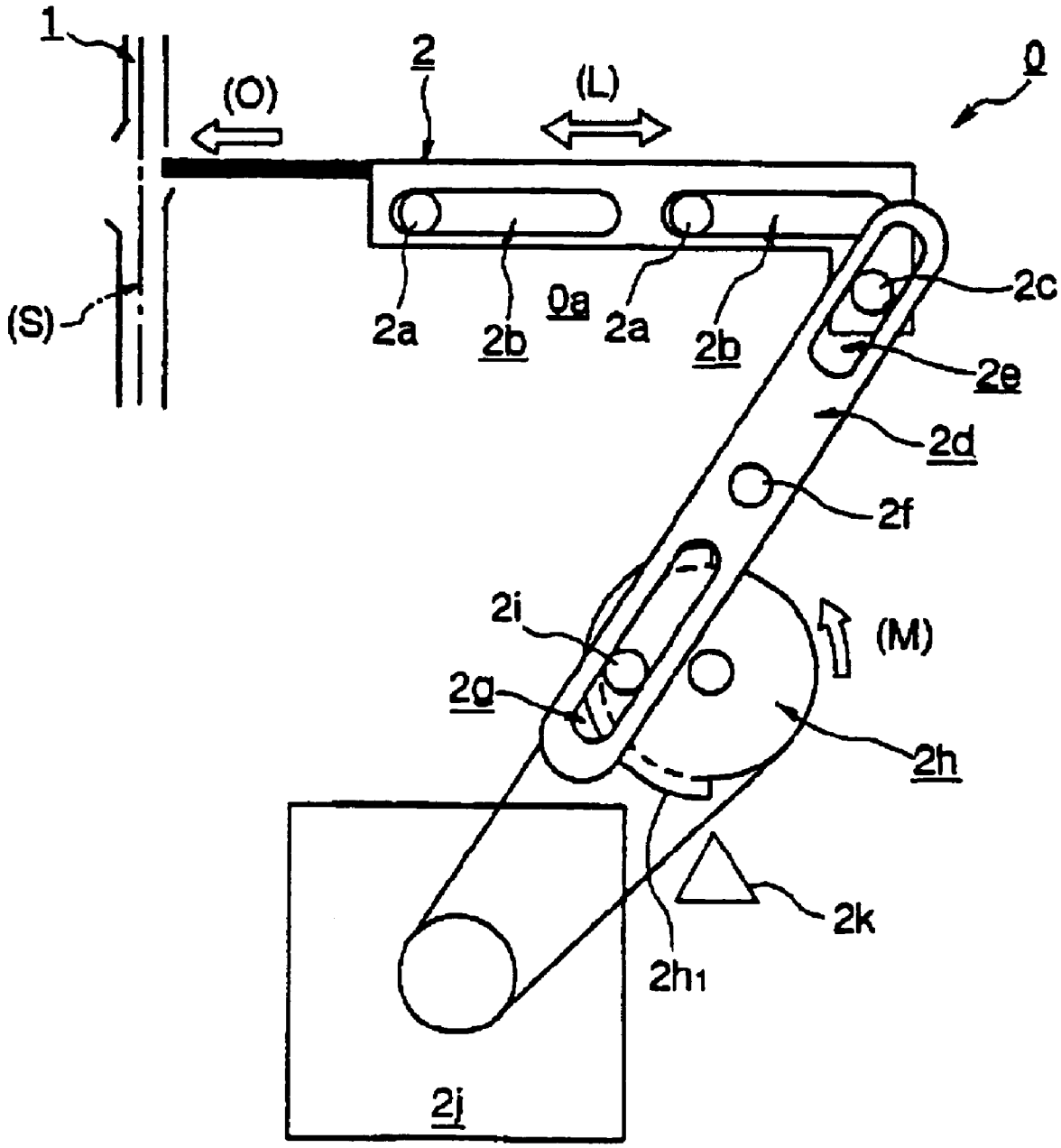
Figure 25:
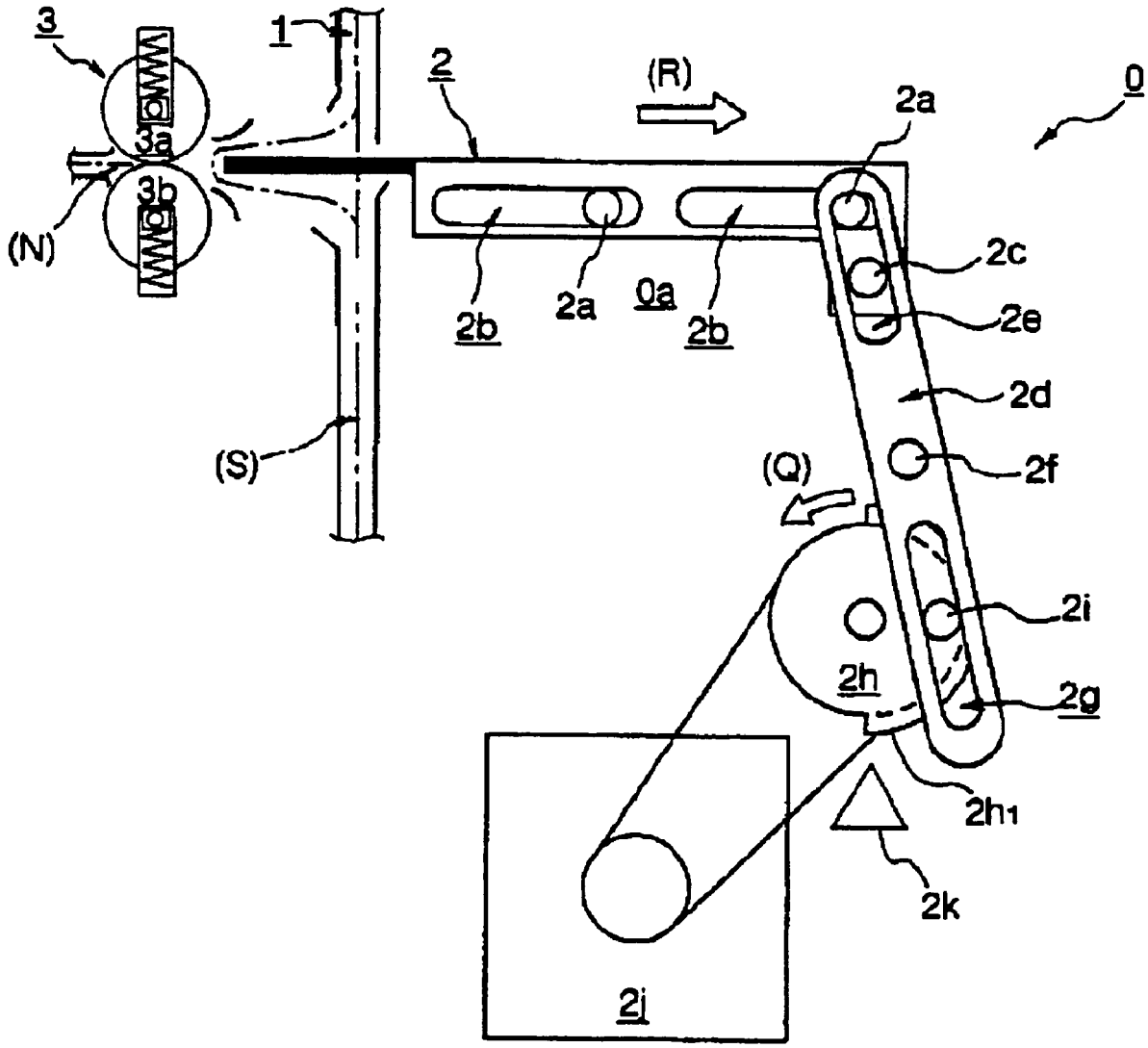
Figure 26:
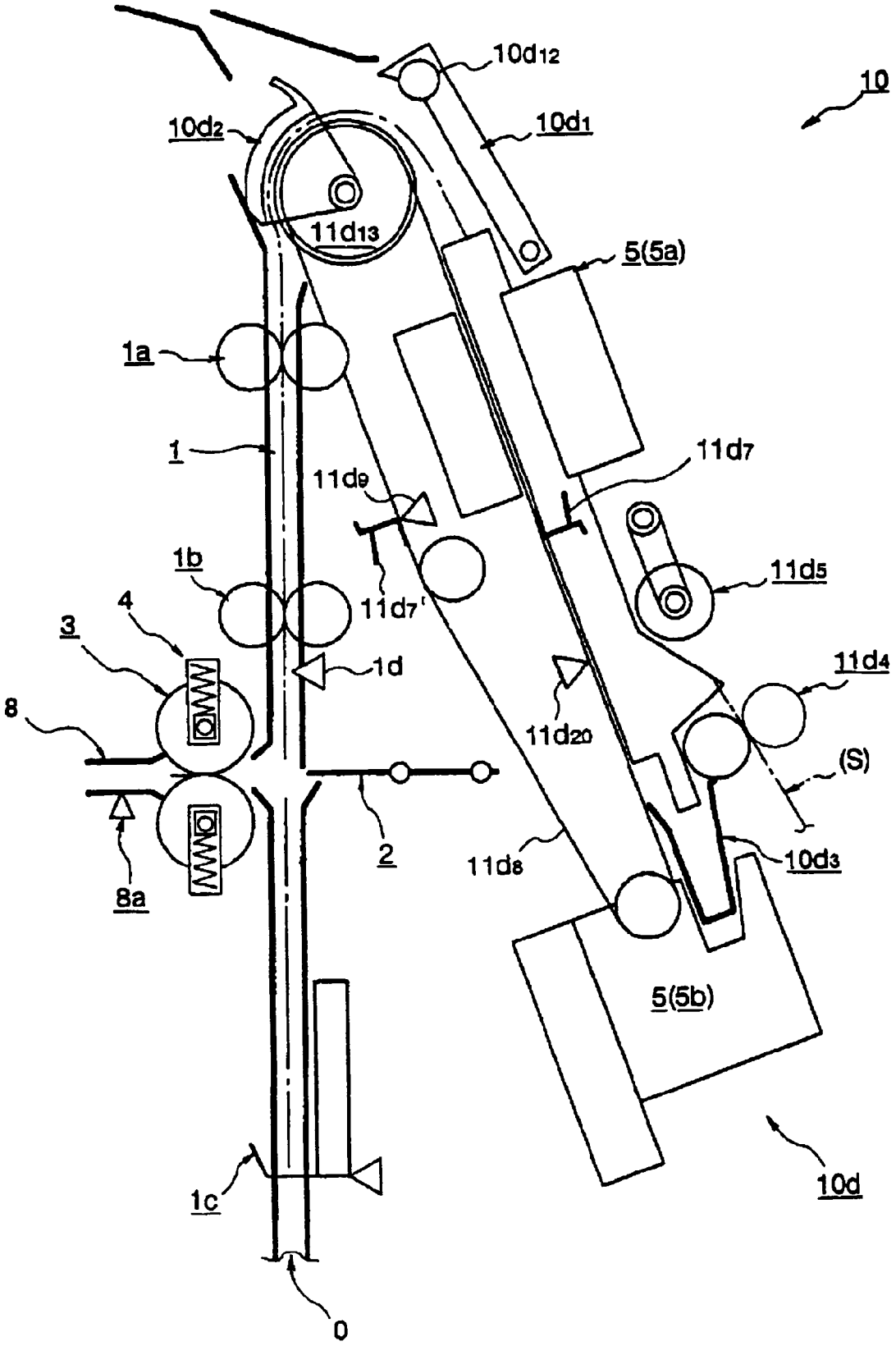
Figure 27:
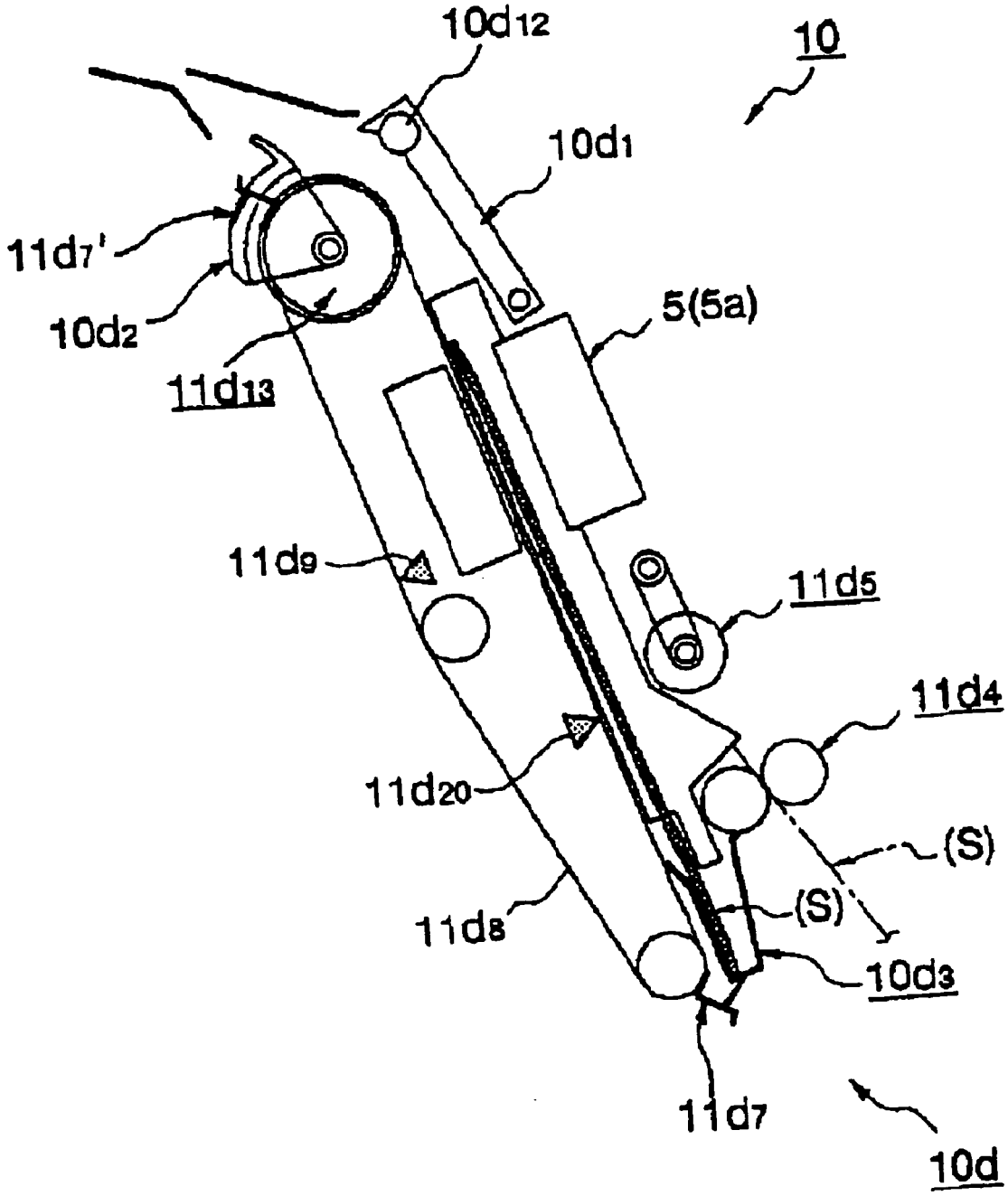

As shown in FIGS. 24 and 25, the fold plate 2 included in the folding device 0 is formed with elongate slots 2*b* each being movably received in one of pins 2*a* studded on each of the front and rear side walls of the device body 0*a*. A pin 2*c* studded on the fold plate 2 is movably received in an elongate slot 2*e* formed in a link arm 2*d*. The link arm 2*d* is angularly movable about a fulcrum 2*f*, causing the fold plate 2 to move in the right-and-left direction indicated by an arrow L. More specifically, a pin 2*i* studded on a fold plate cam 2*h* is movably received in an elongate slot 2*g* formed in the link arm 2*d*. In this condition, the link arm 2*d* angularly moves in accordance with the rotation of the fold plate cam 2*h*.

A fold plate motor 2*j* causes the fold plate cam 2*h* to rotate in a direction indicated by an arrow M. The stop position of the fold plate cam 2*h* is determined on the basis of the output of a fold plate HP sensor 2*k* responsive to the opposite ends of a semicircular interrupter portion 2*h*1 included in the cam 2*h*.

FIG. 24 shows the fold plate 2 in the home position where the fold plate 2 is fully retracted from the sheet stack storing range of the fold tray. When the fold plate cam 2*h* is rotated in the direction indicated by the arrow M, the fold plate 2 is moved in the direction indicated by an arrow O and enters the sheet stack storing range of the path 1. FIG. 25 shows a position where the fold plate 2 pushes the center of a sheet stack on the fold tray into the nip N between the fold rollers 3*a* and 3*b*. When the fold plate cam 2*h* is rotated in a direction indicated by an arrow Q, the fold plate 2 moves in a direction indicated by an arrow R out of the sheet stack storing range of the path 1.

Referring again to FIG. 6, the sheet finisher 10 is selectively operable in any one of a non-staple mode (a), a non-staple mode (b), a sort/stack mode, a staple mode, and a center staple and bind mode. In the non-staple mode (a), sheets S are routed from the path 11*a* to the upper tray 10*a* via the path 11*b* while, in the non-staple mode (b), sheets S are routed from the path 11*a* to the shift tray 10*c* via the path 11*c*. The sort/stack mode is similar to the non-staple mode (b) except that the shift tray 10*c* is repeatedly shifted in the direction perpendicular to the direction of sheet conveyance copy by copy. In the staple mode, sheets S are delivered from the path 11*a* to the staple tray 10*d* via the path 11*d*, stapled on the staple tray 10*d*, and then delivered to the shift tray 10*c* via the path 11*c*. Further, in the center staple and bind mode, sheets S stapled at the center on the staple tray

10*d*, is folded on the path and then driven out to the lower tray 12*b* via the outlet roller pair 12*a*.

Figure 28:
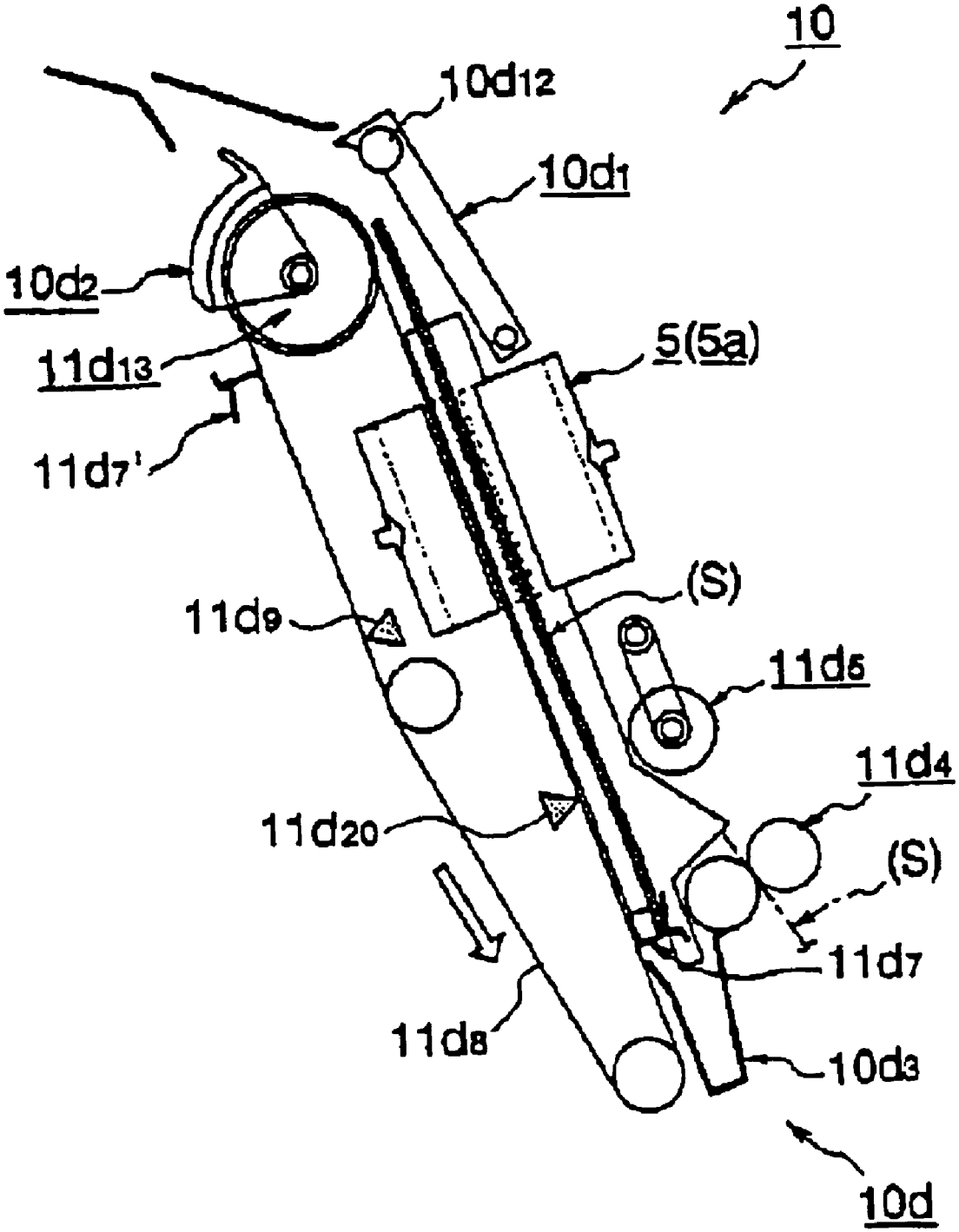
Figure 29:
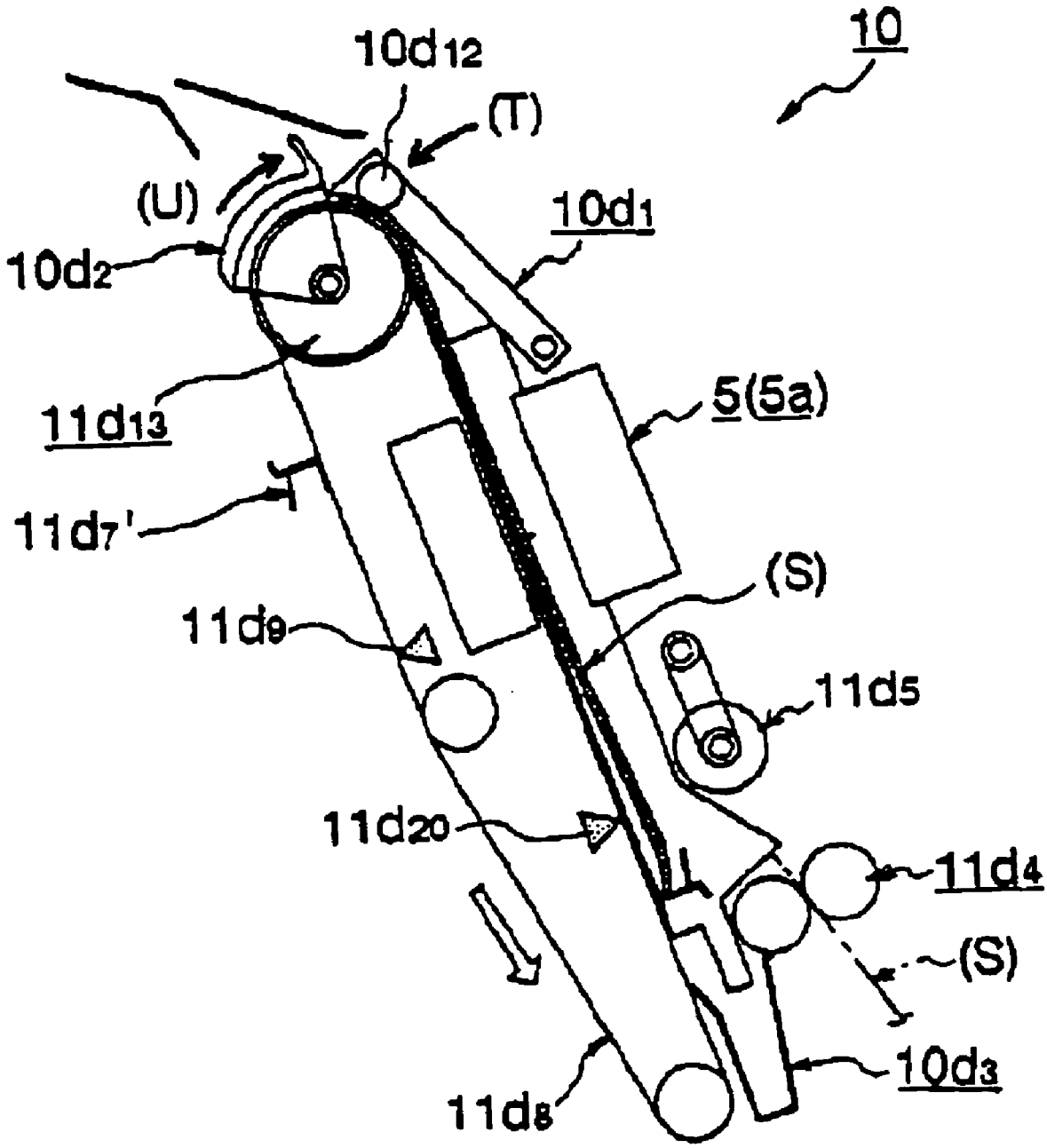

The center staple and bind mode will be described in more detail with reference to FIGS. 26 through 34 hereinafter. As shown, a sheet S is steered by the path selectors 13 and 14 to the path lid and then conveyed by the roller pairs 11*d*18, 11*d*2, 11*d*3 and 11*d*4 to the staple tray 10*d*. The staple tray 10*d* operates in exactly the same manner as in the staple mode stated earlier before positioning and stapling, see FIGS. 26 and 27. Subsequently, as shown in FIG. 28, the hook 11*d*7 conveys the sheet stack to the downstream side in the direction of conveyance by a distance matching with the sheet size.

After the center staplers 5*a* have stapled the center of the sheet stack, the sheet stack is conveyed by the hook 62*a* to the downstream side by a preselected distance matching with the sheet size and then brought to a stop. The distance of movement of the sheet stack is controlled on the basis of the drive pulses input to the discharge motor 11*d*10, see FIGS. 16 and 18.

Figure 30:
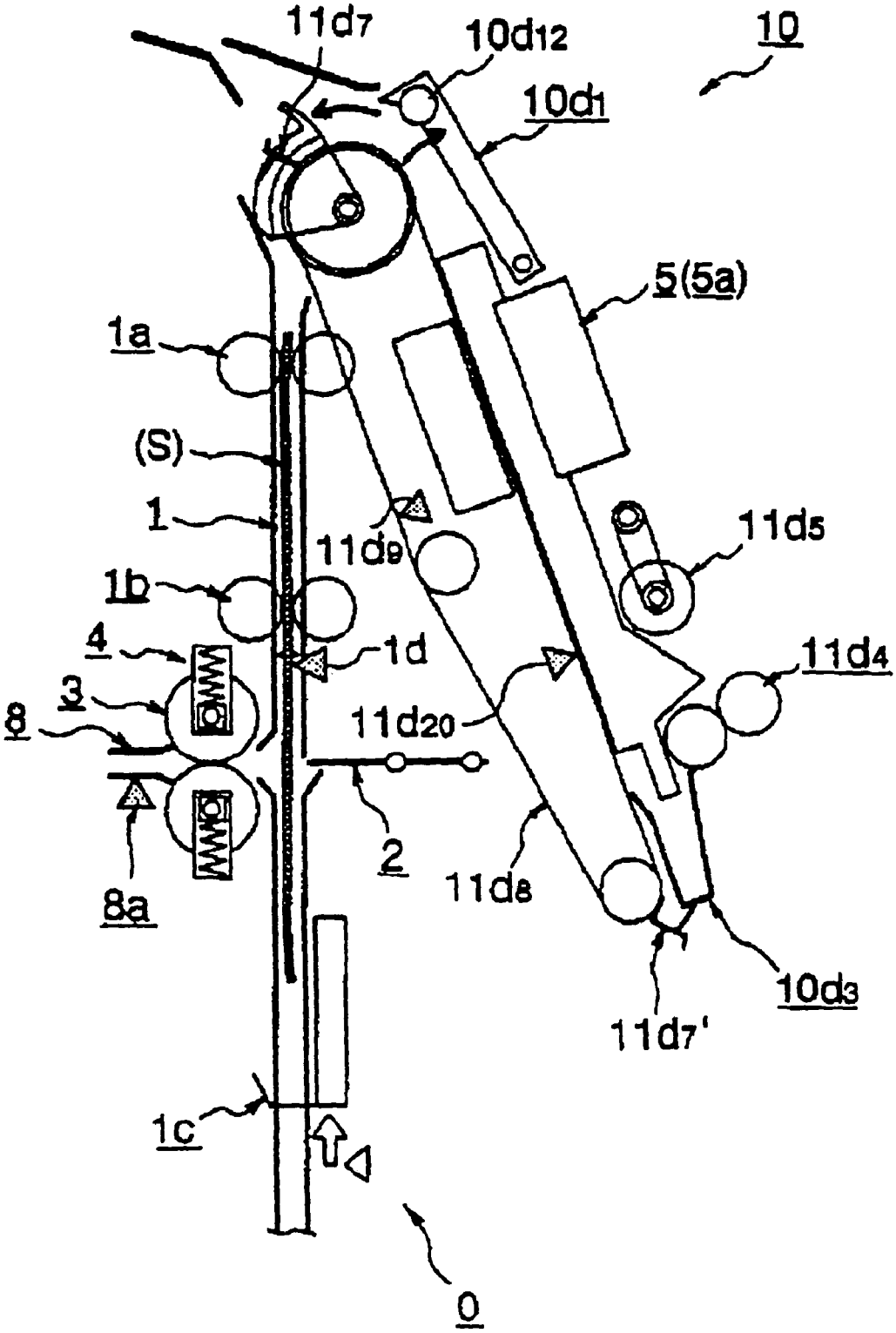

Subsequently, the sheet stack is nipped by the discharge roller 11*d*13 and press roller 10*d*12 and then conveyed by the hook 11*d*7 and discharge roller 11*d*13 to the downstream side such that it passes through the path formed between the guides 10*d*1 and 10*d*2, which are respectively moved in directions T and U, and extending to the path 1. The discharge roller 11*d*13 is mounted on the drive shaft 11*d*11 associated with the belt 11*d*8 and therefore driven in synchronism with the belt 11*d*8, as stated earlier. Subsequently, the sheet stack is conveyed by the upper and lower roller pairs 1*a* and 1*b* of the folding device 0 to the movable rear fence 1*c*, which is moved from its home position to a position matching with the sheet size beforehand and held in a stop for guiding the lower edge of the sheet stack S. At this instant, as soon as the other hook 11*d*7' on the belt 11*d*8 arrives at a position close to the rear fence 10*d*3, the hook 11*d*7 is brought to a stop while the guides 10*d*1 and 10*d*2 are returned to the home positions to wait for the next sheet stack, as shown in FIG. 30.

Figure 31:
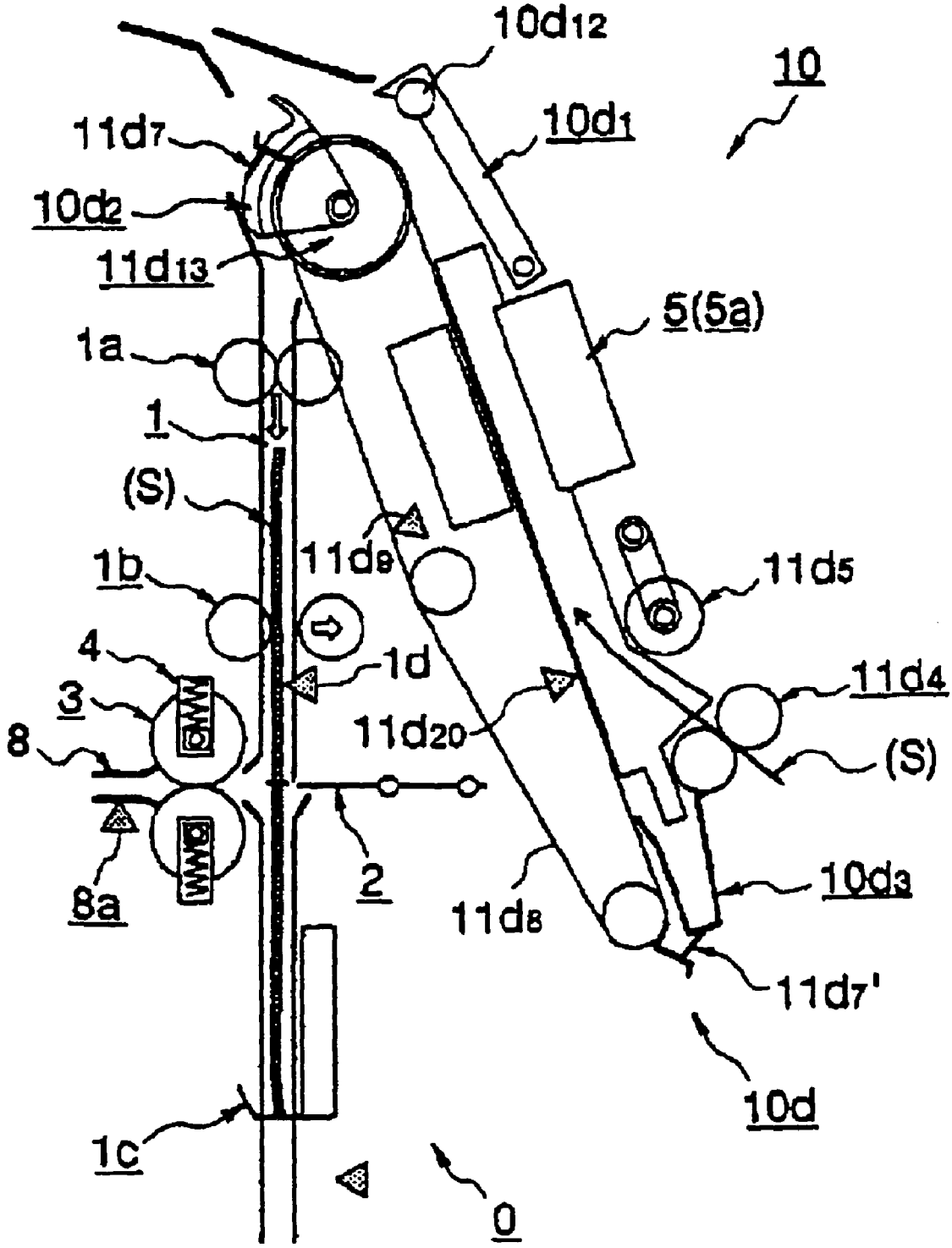
Figure 32:
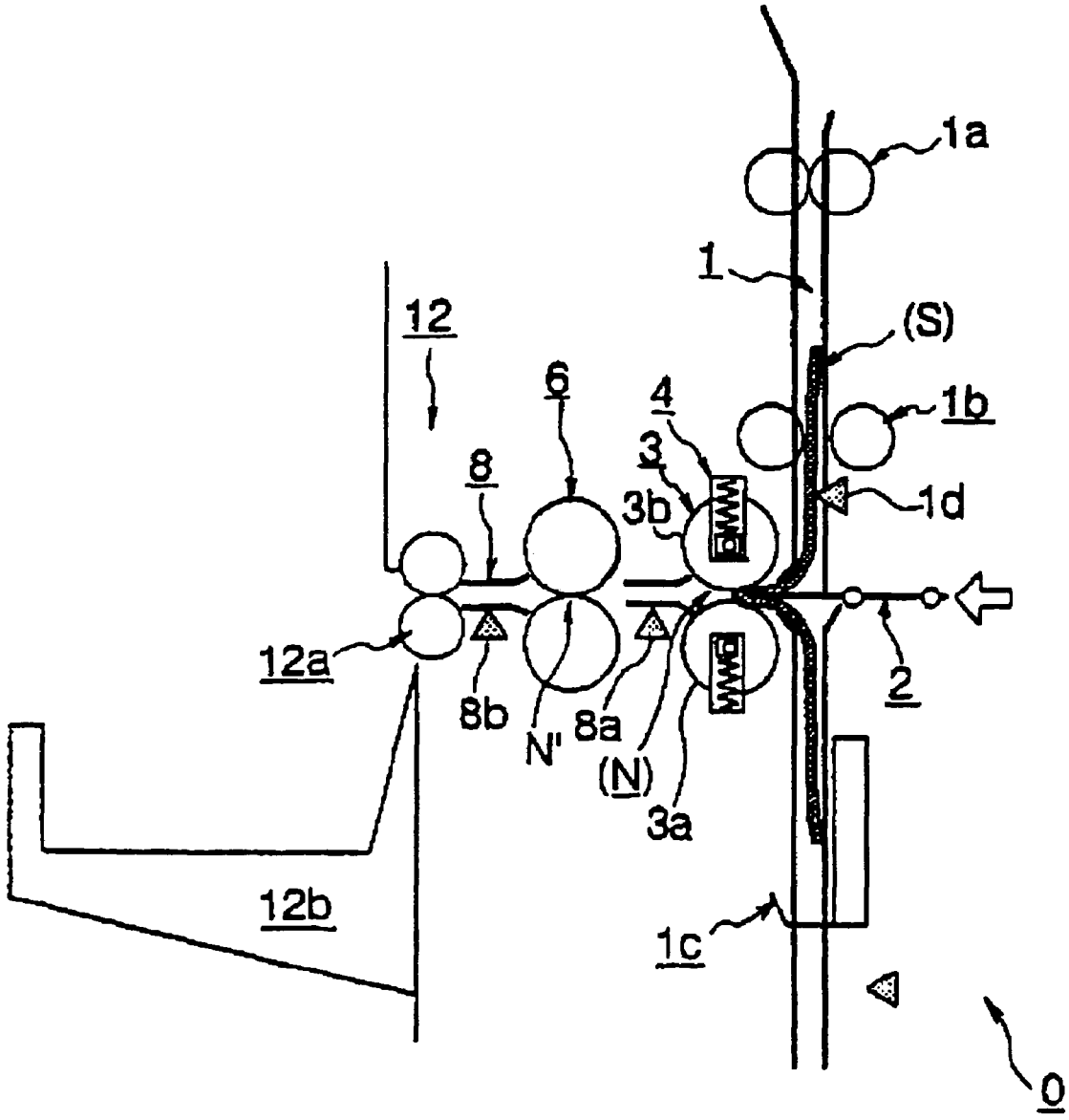

As shown in FIG. 31, the sheet stack S abutted against the movable rear fence 1*c* is freed from the pressure of the lower roller pair 1*b*. Subsequently, the fold plate 2 pushes part of the sheet stack close to a staple toward the nip of the fold roller pair 3 substantially perpendicularly to the sheet stack. The fold roller pair 3, which is caused to rotate beforehand, conveys the sheet stack reached its nip while pressing it. As a result, the sheet stack is folded at its center, as shown in FIG. 32.

Figure 33:
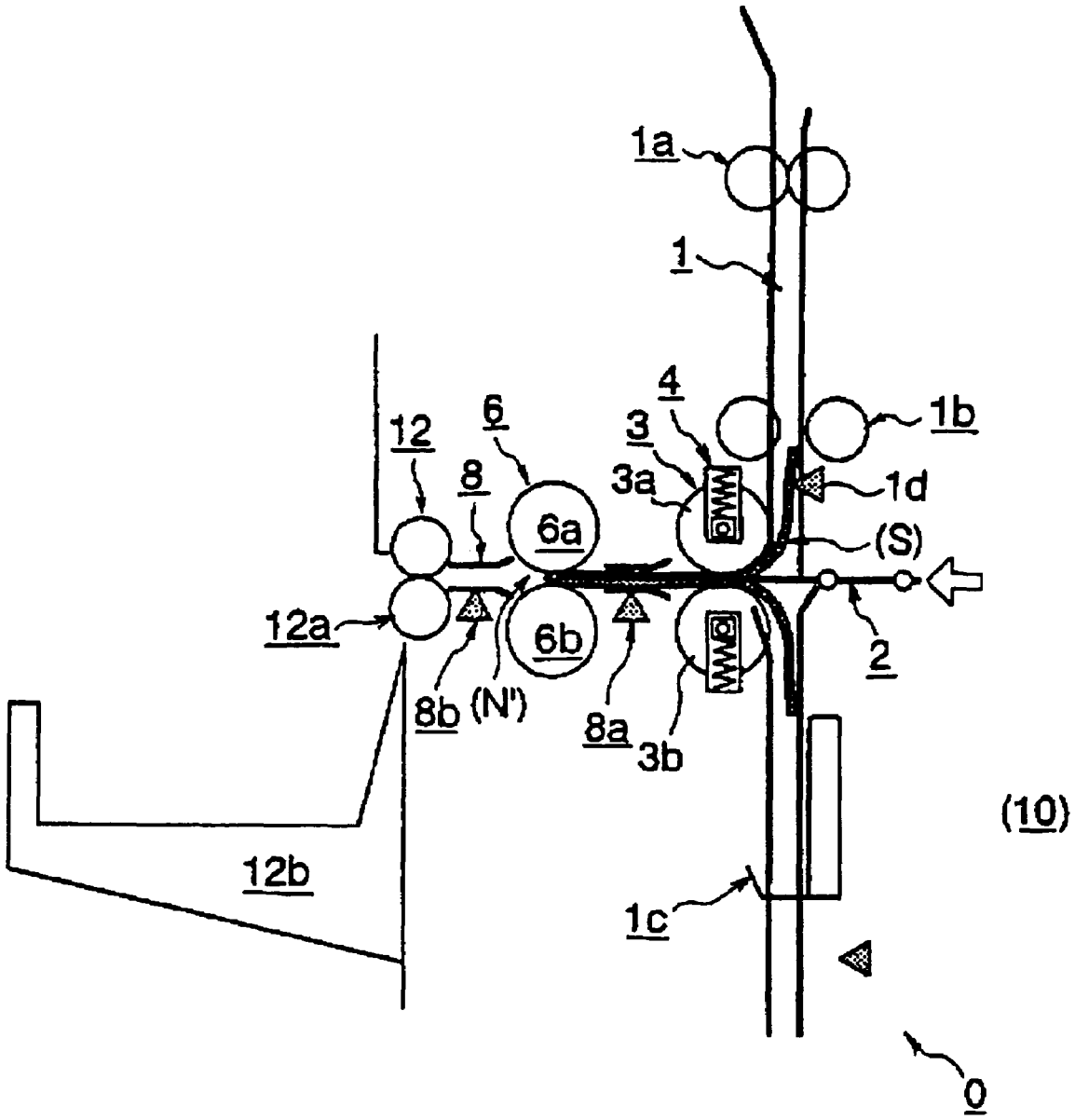

As shown in FIG. 33, the leading edge of the center-folded sheet stack S enters the nip N' of the reinforce roller pair 6. At this time, the fold rollers 3*a* and 3*b* are caused to stop rotating and then, on the elapse of a preselected period of time, resume the conveyance of the sheet stack. It is noteworthy that the preselected period of time mentioned above is variable in accordance with the number of sheets and sheet size. For example, when the number of sheets constituting a stack is relatively large, a substantial period of time elapses until the next sheet stack enters the folding section. In such a case, the above period of time may be added to the preselected period of time, so that the fold of the sheet stack can be made sharper or more firm without degrading the productivity of the image forming apparatus 20. Further, the reinforce rollers 6*a* and 6*b* may be repeatedly rotated in opposite directions within the preselected period of time by an amount small enough to prevent the leading edge of the sheets stack from slipping out of the nip of the fold roller pair 6, which is about several millimeters wide. This will stroke and thereby reinforce the fold of the sheet stack.

Figure 34:
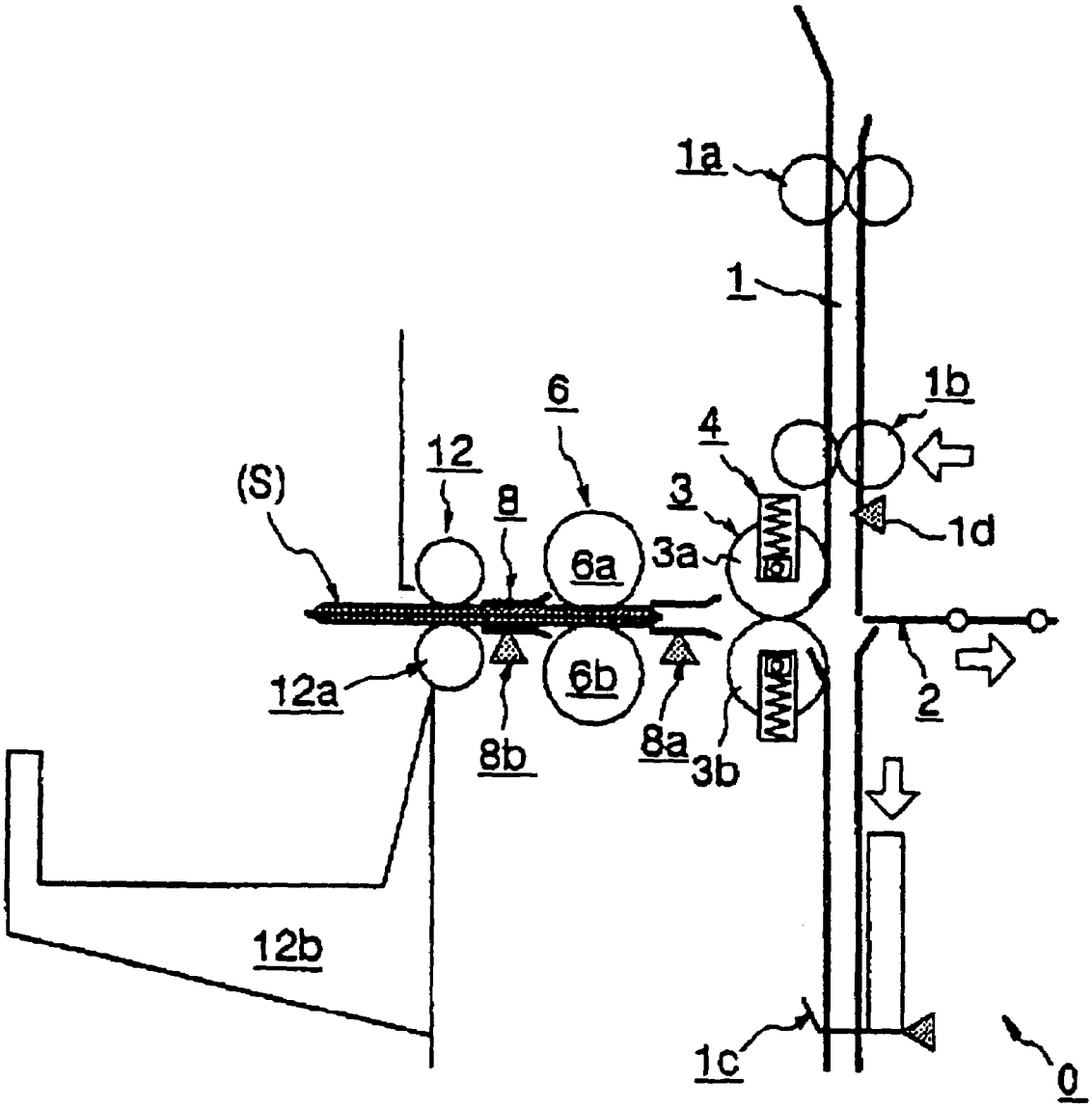

As shown in FIG. 34, the sheet stack S with the fold reinforced by the reinforce roller pair 6 is driven out to the lower tray 12*b* by the lower outlet roller pair 12*a* via the path 8. At this instant, as soon as the pass sensor 8*a* senses the trailing edge of the sheet stack S, the fold plate 2 and movable rear fence 1*c* are returned to their home positions while the lower roller pair 1*b* is released from each other so as to wait for the next sheet stack. Alternatively, the rear fence 1*c* may be held at the same position without being returned to the home position if the next job deals with the same sheet size and the same number of sheets.

Figure 35:
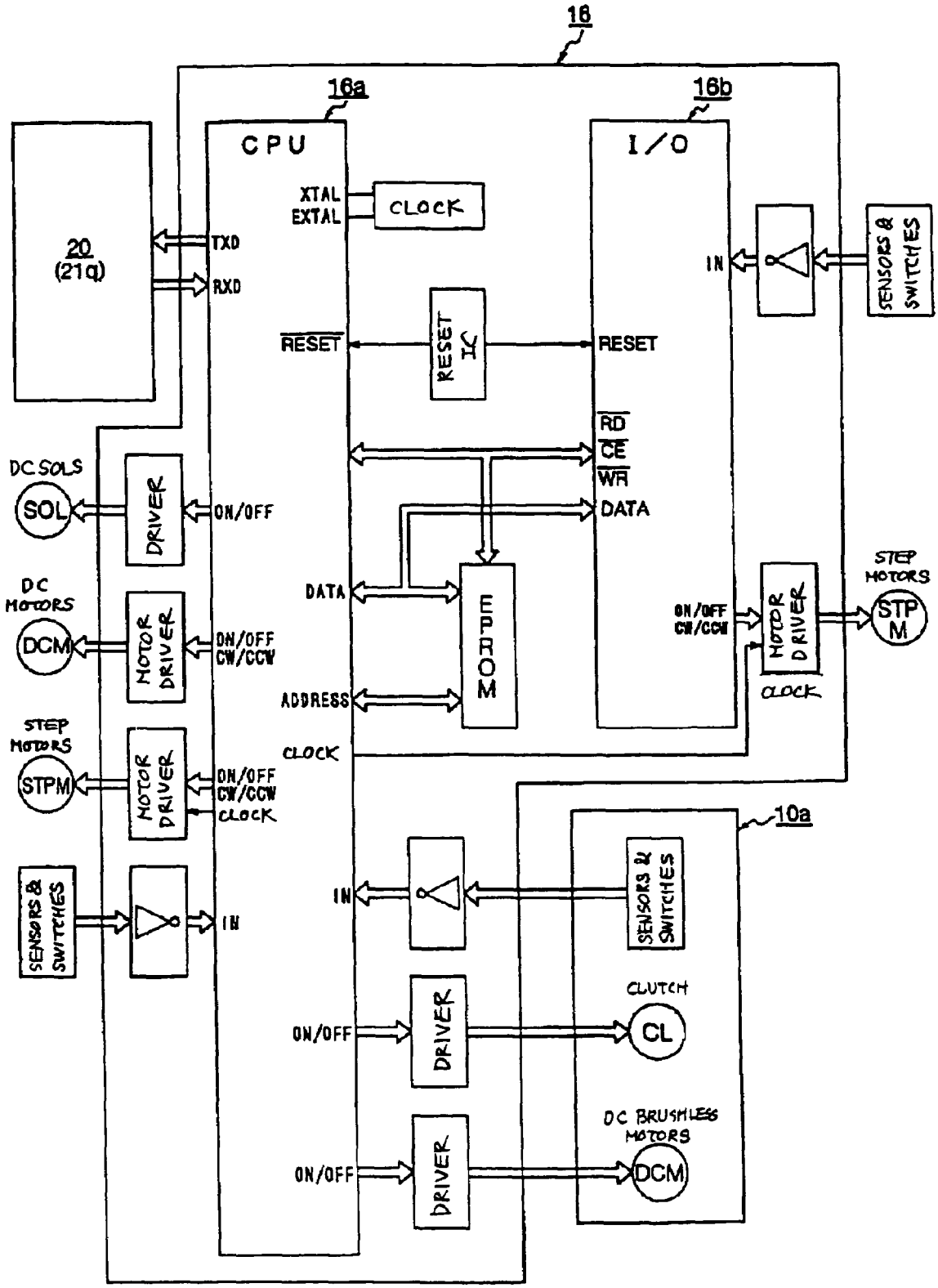

Reference will be made to FIG. 35 for describing a control system included in the illustrative embodiment. As shown, the control system includes the previously mentioned control means 16 implemented as a microcomputer including a CPU (Central Processing Unit) 16*a* and an I/O (Input/Output) interface 16. The outputs of various switches arranged on a control panel 21*q* mounted on the image forming apparatus 20 and the outputs of various sensors, including the sheet sensor 15*c*, are input to the CPU 16*a* via the I/O interface 16*b*.

The CPU 6*a* controls, based on the above various inputs, the tray motor 15*d*2 assigned to the shift tray 10*c*, the guide plate motor 15*f*2 assigned to the guide plate 15*f*, the shift motor 15*e*1 assigned to the shift tray 10*c*, knock roller motor 11*d*53 assigned to the knock roller 11*d*5, various solenoids including the knock solenoid (SOL) 11*d*52, motors for driving the conveyor rollers, outlet motors for driving the outlet rollers, the discharge motor 11*d*10 assigned to the belt 11*d*8, the stapler motor 11*d*15 assigned to the edge stapler 5*b*, the oblique motor 11*d*21 for causing the edge staplers 5*b* to move obliquely, the jogger motor 11*d*61 assigned to the jogger fences 11*d*6, the steer motor 10*d*14 assigned to the guide plate 10*d*1 and movable guide 10*d*2, a rear fence motor, not shown, assigned to the movable rear fence 73, the fold plate motor 2*j* assigned to the fold plate 2, and a mold roller motor, not shown, assigned to the fold roller 3*b* of the fold roller pair 3. The pulse signals of the staple conveyance motor 11*d*41 assigned to the staple discharge rollers 11*d*4 are input to the CPU 16*a* and counted thereby. The CPU 16*a* controls the knock SOL 11*d*52 and jogger motor 11*d*61 in accordance with the number of pulse signals counted, see FIG. 14.

Specific operations to be executed by the CPU 16*a* in various modes available with the illustrative embodiment will be described hereinafter.

Figure 36:
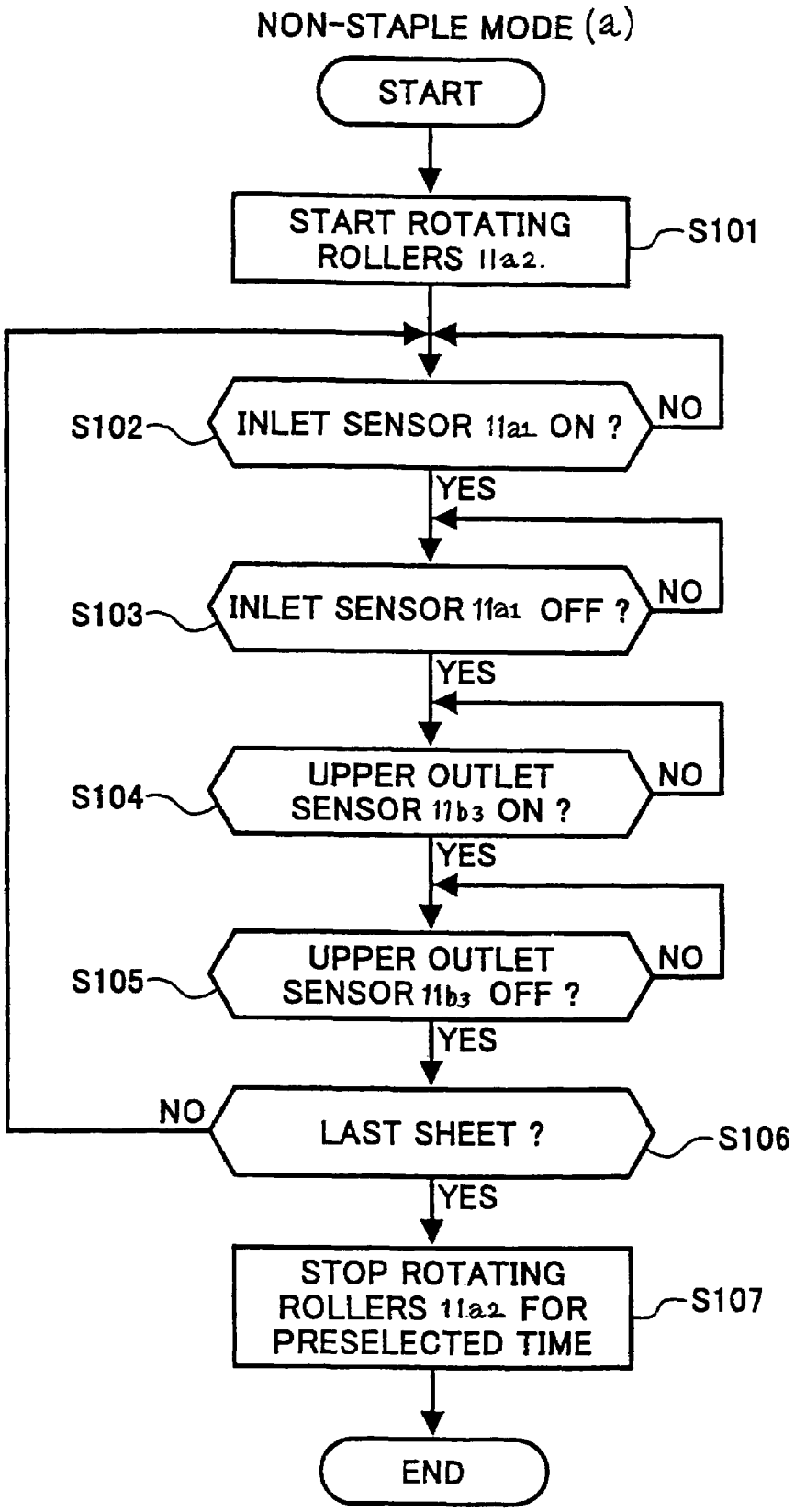
FIG. 36 is a flowchart demonstrating a non-staple mode (a) available with the first embodiment.

First, reference will be made to FIG. 36 for describing the non-staple mode (a) more specifically. As shown, before a sheet S driven out of the image forming apparatus 20 enters the finisher 10, the CPU 16*a* causes the inlet roller pair 11*a*2 and conveyor roller pair 11*a*3 on the path 11*a*, the roller pair 11*b*1 on the path 11*b* and outlet roller pair 11*b*2 to start rotating (step S101). The CPU 16*a* then checks the ON/OFF state of the inlet sensor 11*a*1 (steps S102 and S103) and the ON/OFF state of the upper outlet sensor 11*b*3 (steps S014 and S105) for thereby confirming the passage of sheets S. When a preselected period of time elapses since the passage of the last sheet S (YES, step S106), the CPU 16*a* causes the above rollers to stop rotating (step S107). In this manner, all the sheets S handed over from the image forming apparatus 20 to the finisher 10 are sequentially stacked on the upper tray 201 without being stapled. If desired, the punch unit 10*a*, which intervenes between the inlet roller pair 11*a*2 and conveyor roller pair 11*a*3, may punch the consecutive sheets S.

Figure 37:
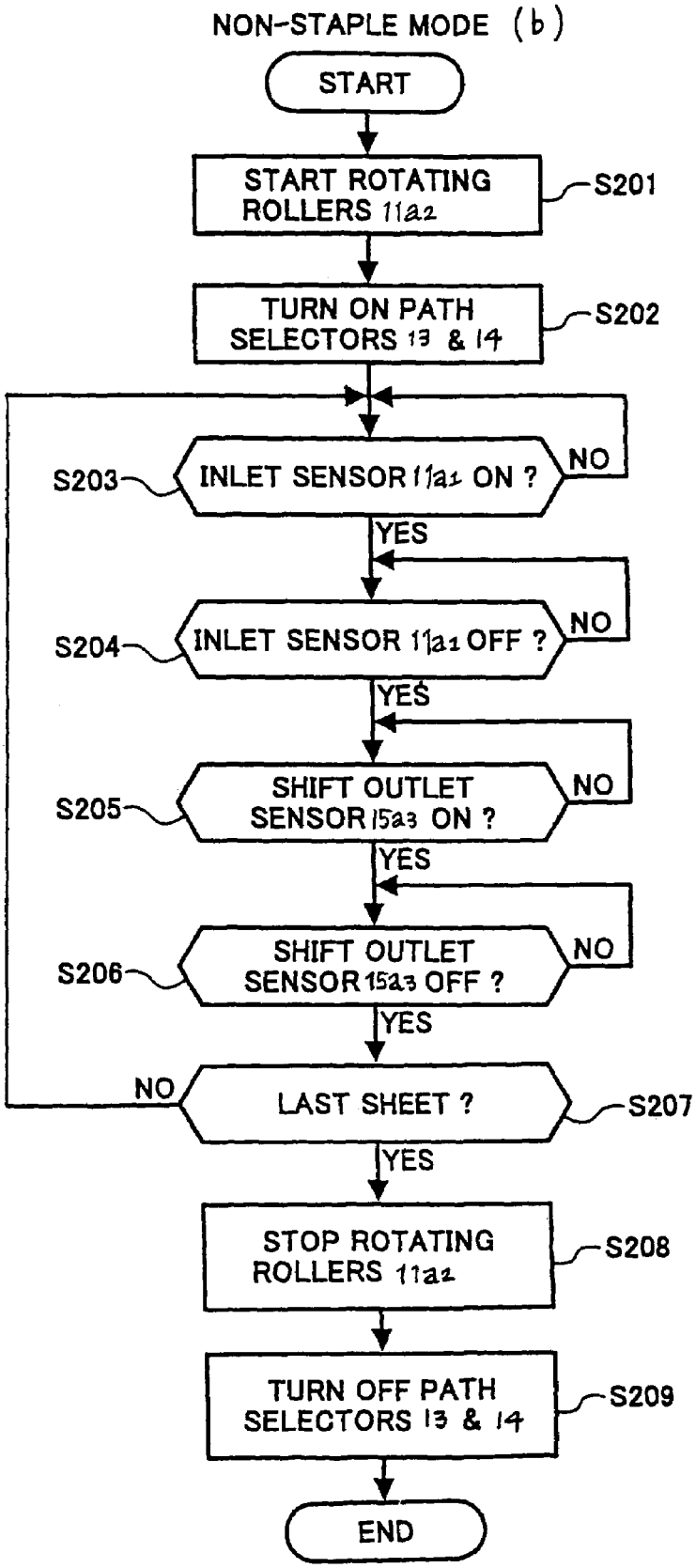
FIG. 37 is a flowchart demonstrating a non-staple mode (b) available with the first embodiment.

FIG. 37 demonstrates the non-staple mode (b). As shown, before a sheet S driven out of the image forming apparatus 20 enters the finisher 10, CPU 16*a* causes the inlet roller pair 11*a* and conveyor roller pair 11*a* on the path 11*a* and the roller pair 11*c*1 and shift outlet roller pair 15*a* on the path 11*c* start rotating (step S201). The CPU 16*a* then energizes the solenoids assigned to the path selectors 13 and 14 (step S202) to thereby move the path selectors 13 and 14 counterclockwise and clockwise, respectively. Subsequently, the CPU 16*a* checks the ON/OFF state of the inlet sensor 11*a*1 (steps S203 and S204) and the ON/OFF state of the shift outlet sensor 15*a*3 (steps S205 and S206) to thereby confirm the passage of the sheets S.

On the elapse of a preselected period of time since the passage of the last sheet S (YES, step S207), the CPU 16*a* causes the various rollers mentioned above to stop rotating (S208) and deenergizes the solenoids (steps S209). In this manner, all the sheets S entered the finisher 10 are sequentially stacked on the shift tray 10*c* without being stapled. Again, the punch unit 10*a*, which intervenes between the inlet roller pair 11*a*2 and conveyor roller pair 11*a*3, may punch the consecutive sheets S.

Figure 38:
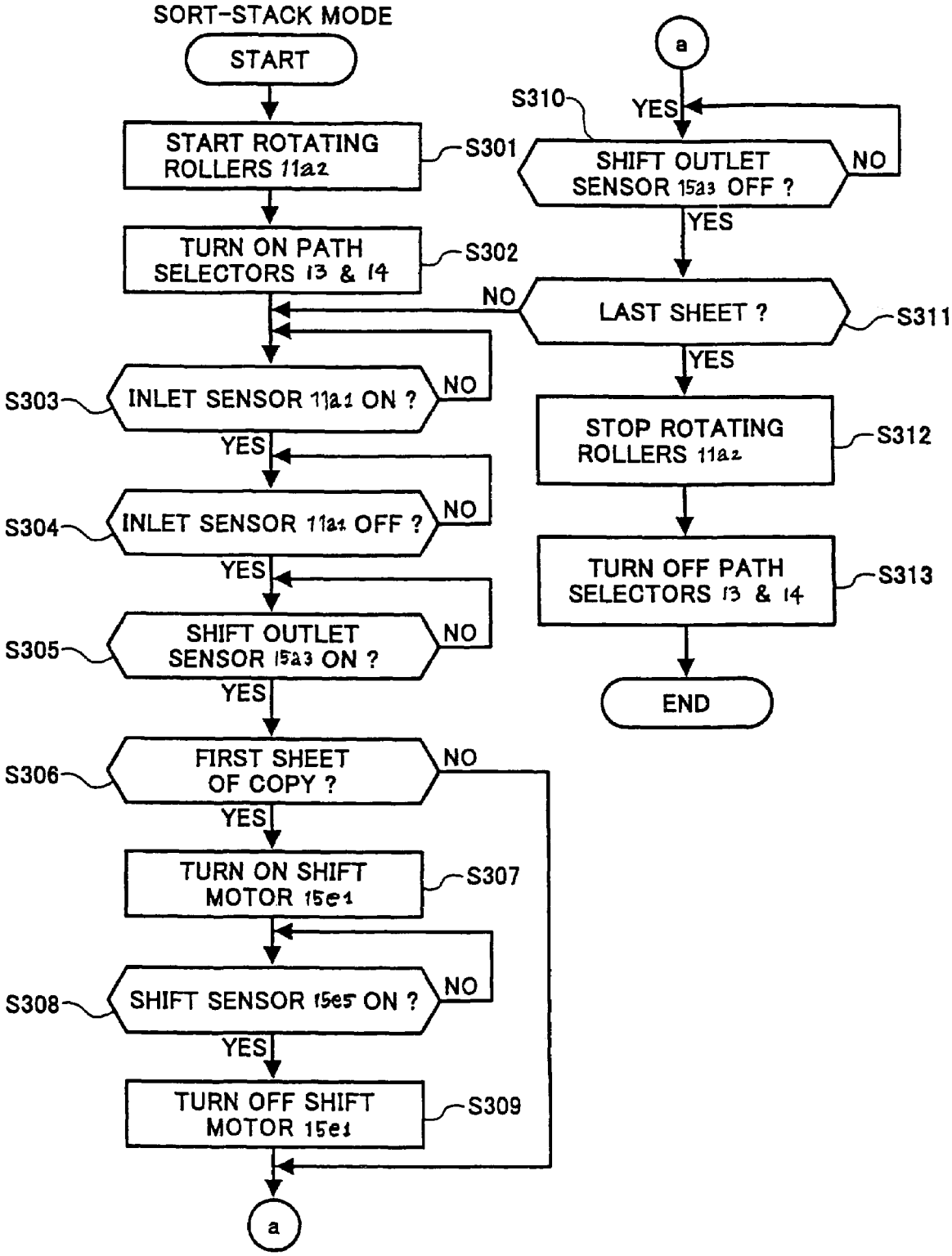
FIG. 38 is a flowchart demonstrating a sort/stack mode available with the first embodiment.

FIG. 38 demonstrates the sort/stack mode more specifically. As shown, before a sheet S driven out of the image forming apparatus 20 enters the finisher 10, the CPU 16*a* causes the inlet roller pair 11*a*2 and conveyor roller pair 11*a*3 on the path 11*a* and the conveyor roller pair 11*c*15 and shift outlet roller pair 15*a* on the path 11*c* to start rotating (step S301). The CPU 16*a* then energizes the solenoids assigned to the path selectors 13 and 14 (step S302) to thereby move the path selectors 13 and 14 counterclockwise and clockwise, respectively. Subsequently, the CPU 16*a* checks the ON/OFF state of the inlet sensor 11*a*1 (steps S303 and S304) and the ON/OFF state of the shift outlet sensor 15*a*3 (step S305)

If the sheet S passed the shift outlet sensor 15*a*3 is not the first sheet of a copy (NO, step S306), meaning that the shift tray 10*c* has already moved, then the CPU 16*a* causes the sheet S to be directly driven out (step S310). If the answer of the step S306 is YES, meaning that the sheet S is the first sheet of a copy, then the CPU 16*a* turns on the shift motor 15*e*1 (step S307) to thereby move the shift tray 10*c* perpendicularly to the direction of sheet conveyance until the shift sensor 16*e*5 senses the tray 10*c* (steps S308). When the shift sensor 15*e*5 senses the shift tray 10*c*, the CPU 15*a* turns off the shift motor 15*e*1 (step S309) and causes the sheet S to be driven out to the shift tray 10*c*.

Subsequently, the CPU 16*a* determines whether or not the shift outlet sensor 15*a* is in an OFF state (step S310). The CPU 10*a* then determines whether or not the sheet S is the last sheet (step S311). If the answer of the step S311 is NO, meaning that the sheet is not the last sheet of a copy, then the procedure returns to the step S303. If the answer of the step S311 is YES, then the CPU 16A causes the inlet roller pair 11*a*2 and conveyor roller pair 11*a*3 on the path 11*a* and the roller pair 11*c*1 and shift outlet roller pair 15*a* on the path 11*c* to stop rotating (step S312). Thereafter, the CPU 16*a* deenergizes the solenoids assigned to the path selectors 13 and 14 (step S313) and then ends the procedure.

In this manner, all the sheets sequentially entered the finisher 20 are sorted and stacked on the shift tray 10*c* without being stapled. In this mode, too, the punch unit 100 may punch the consecutive sheets, if desired.

Figure 39:
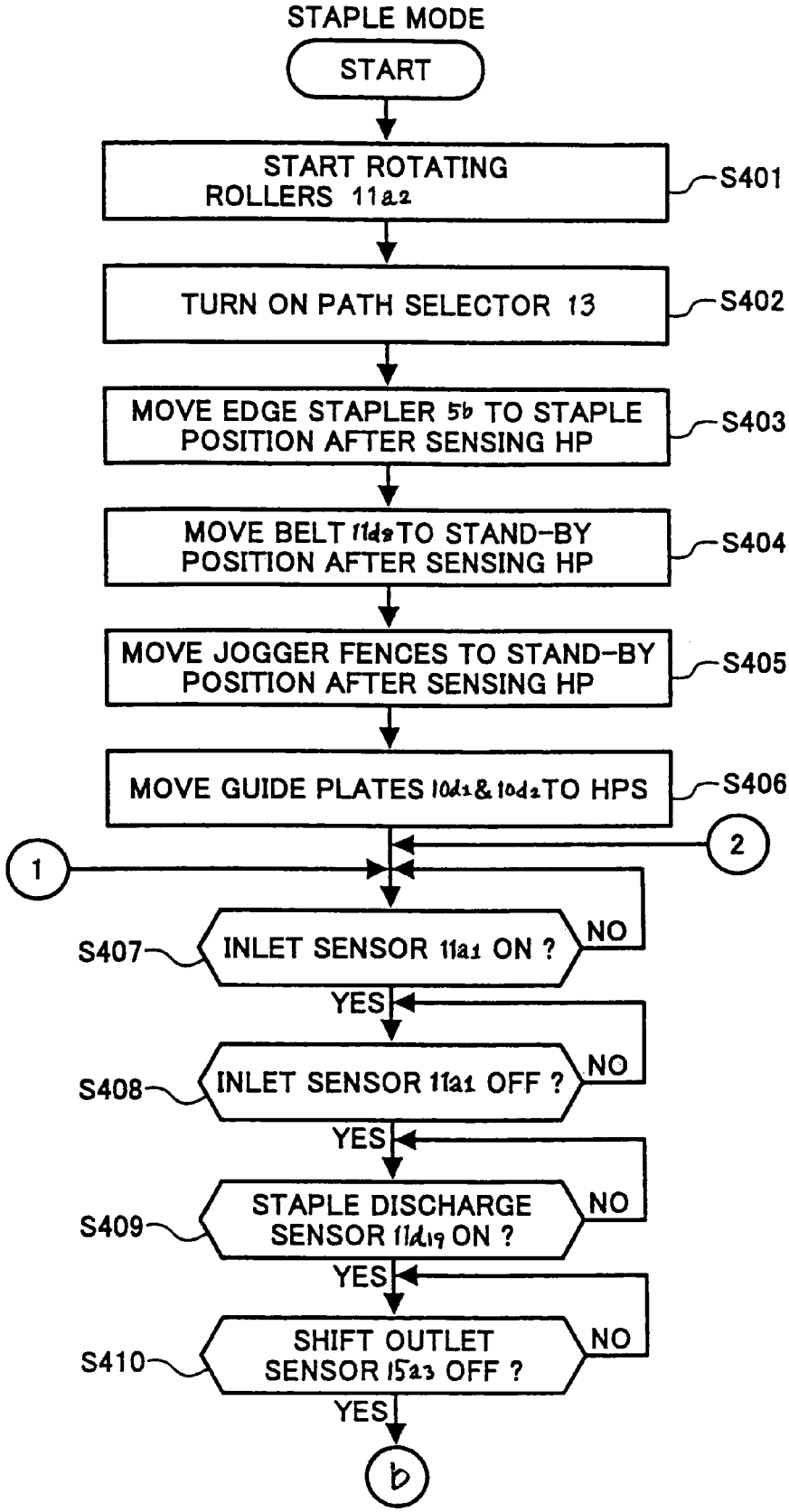
FIGS. 39 through 41 are flowcharts demonstrating a staple mode available with the illustrative embodiment.
Figure 40:
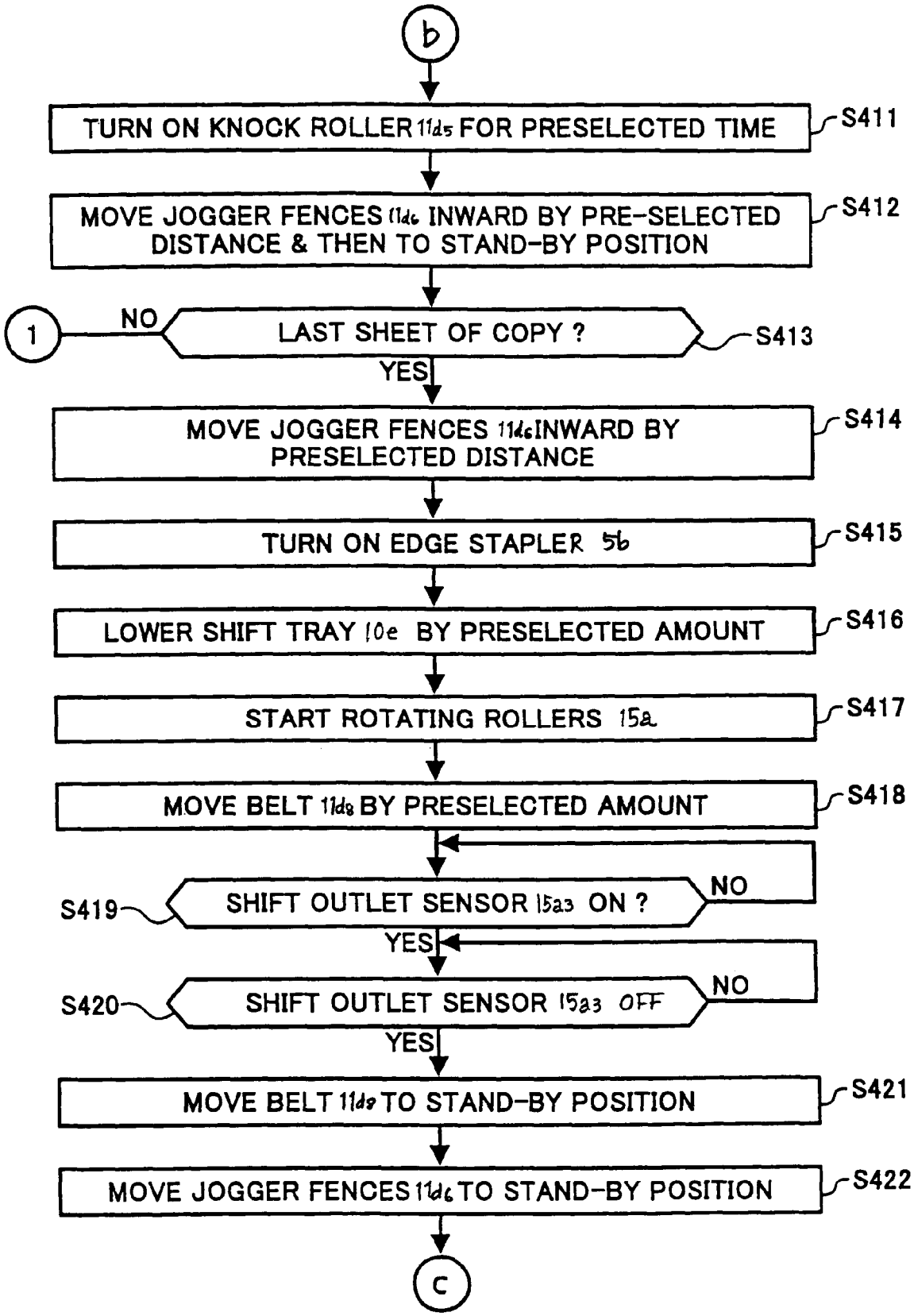
Figure 41:
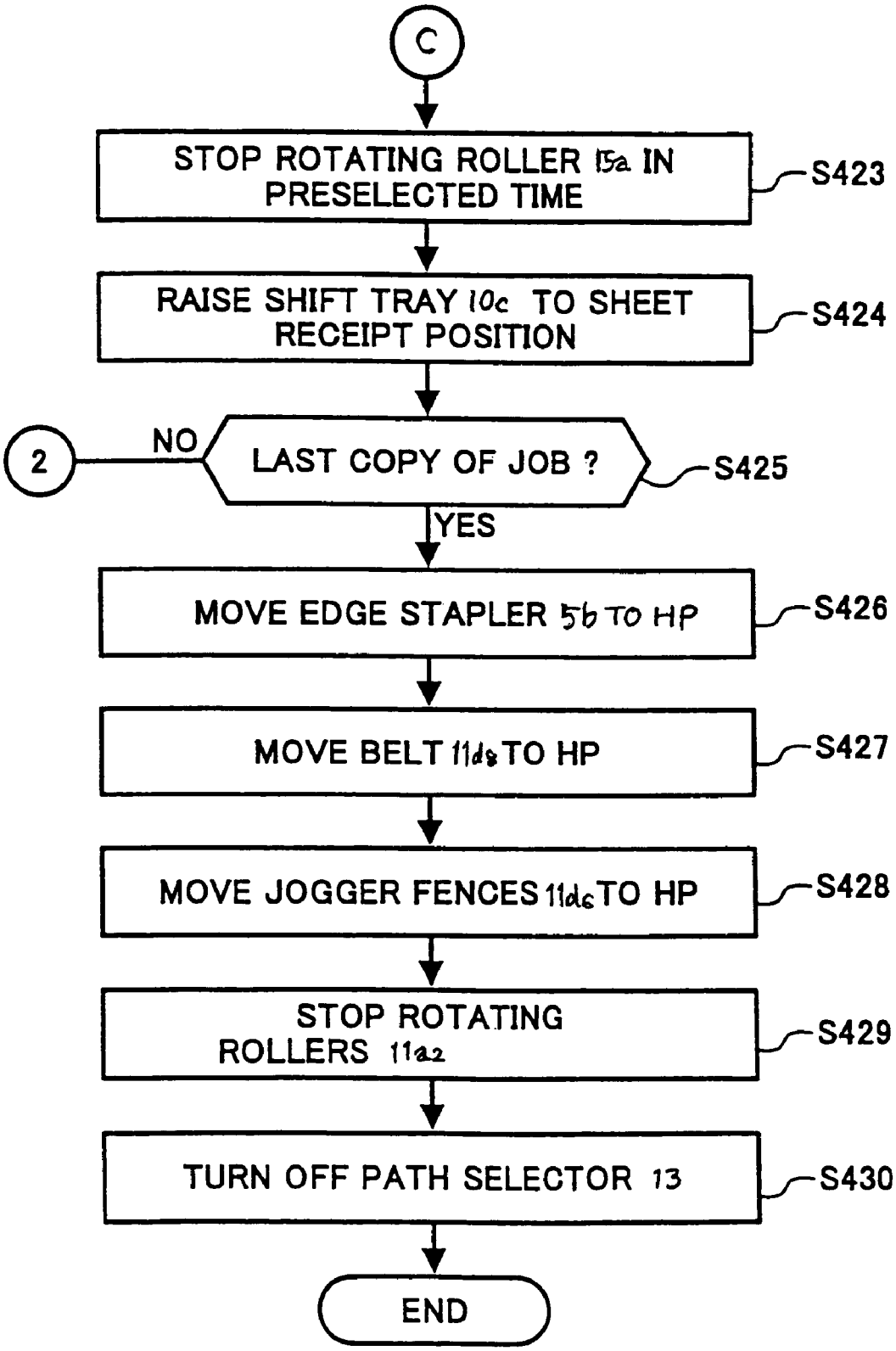

Reference will be made to FIGS. 39 through 41 for describing the staple mode. As shown, before a sheet S driven out of the image forming apparatus 20 enters the finisher 10, the CPU 16*a* causes the inlet roller pair 11*a*2 and conveyor roller pair 11*a*3 on the path 1, the conveyor roller pairs 11*d*18, 11*d*2, 11*d*3 and staple outlet roller 11*d*4 on the path 11*d* and knock roller 11*d*5 to start rotating (step S401). The CPU 16*a* then energizes the solenoid assigned to the path selector 13 (step S402) to thereby cause the path selector 13 to rotate counterclockwise.

After the stapler HP sensor 11*d*17 has sensed the edge stapler 5*b* at the home position, the CPU 16*a* drives the stapler motor 11*d*15 to move the edge stapler 5*b* to a preselected stapling position (step S403). Also, after the belt HP sensor 11*d*9 has sensed the belt 11*d*8 at the home position, the CPU 10*a* drives the discharge motor 11*d*10 to bring the belt 11*d*8 to a stand-by position (step S404). Further, after the jogger fence motor HP sensor has sensed the jogger fences 11*d*6 at the home position, the CPU 16*a*moves the jogger fences 1*d*6 to a stand-by position (step S405) In addition, the CPU 16*a* causes the guide plate 10*d*1 and movable guide 10*d*2 to move to their home positions (step S406).

If the inlet sensor 11*a*1 has turned on (YES, step S407) and then turned off (YES, step S408), if the staple discharge sensor 11*d*19 has turned on (YES, step S409) and if the shift outlet sensor 15*a*3 has tuned on (YES, step S410), then the CPU 16*a* determines that a sheet S is present on the staple tray 10*d*. In this case, the CPU 16*a* energizes the knock solenoid 1*d*52 for a preselected period of time to cause the knock roller 11*d*5 to contact the sheet S and force it against the rear fences 10*d*3, thereby positioning the rear edge of the sheet S (step S411). Subsequently, the CPU 16*a* drives the jogger motor 11*d*61 to move each jogger fence 11*d*6 inward by a preselected distance for thereby positioning the sheet S in the direction of width perpendicular to the direction of sheet conveyance and then returns the jogger fence 11*d*6 to the stand-by position (step S412). The CPU 16*a* repeats the step S407 and successive steps with every sheet. When the last sheet S of a copy arrives at the staple tray 10*d* (YES, step S413), the CPU 16*a* moves the jogger fences 11*d*6 inward to a position where they prevent the edges of the sheets from being dislocated (step S414). In this condition, the CPU 16*a* turns on the stapler 5*b* and causes it to staple the edge of the sheet stack (step S415).

On the other hand, the CPU 16*a* lowers the shift tray 10*c* by a preselected amount (step S416) in order to produce a space for receiving the stapled sheet stack. The CPU 16*a* then drives the shift discharge roller pair 15*a* via the shift discharge motor (step S417) and drives the belt 11*d*8 by a preselected amount via the discharge motor 11*d*10 (step S418), so that the stapled sheet stack is raised toward the path 11*c*. As a result, the stapled sheet stack is driven out to the shift tray 10*c* via the shift outlet roller pair 15*a* (S418). After the shift outlet sensor 303 has turned on (step S419) and then turned off (step S420), meaning that the sheet stack has moved away from the sensor 15*a*3, the CPU 16*a* moves the belt 11*d*8 and jogger fences 11*d*6 to their stand-by positions (steps S421 and S422), causes the shift outlet roller pair 15*a* to stop rotating on the elapse of a preselected period of time (step S423), and raises the shift tray 10*c* to a sheet receiving position (step S424). The rise of the shift tray 10*c* is controlled in accordance with the output of the sheet surface sensor 15*c* responsive to the top of the sheet stack positioned on the shift tray 10*c*.

After the last copy or set of sheets has been driven out to the shift tray 10*c*, the CPU 16*a* returns the edge stapler 5*b*, belt 11*d*8 and jogger fences 11*d*6 to their home positions (steps S426, S427 and S428) and causes the inlet roller pair 11*a*2, conveyor roller pairs 11*a*3, 11*d*18, 11*d*2, 11*d*3 and 11*d*4 and knock roller 11*d*5 to stop rotating (step S429). Further, the CPU 16*a* deenergizes the solenoid assigned to the path selector 13 (step S430). Consequently, all the structural parts are returned to their initial positions. In this case, too, the punch unit 10*a* may punch the consecutive sheets before stapling.

Figure 42:
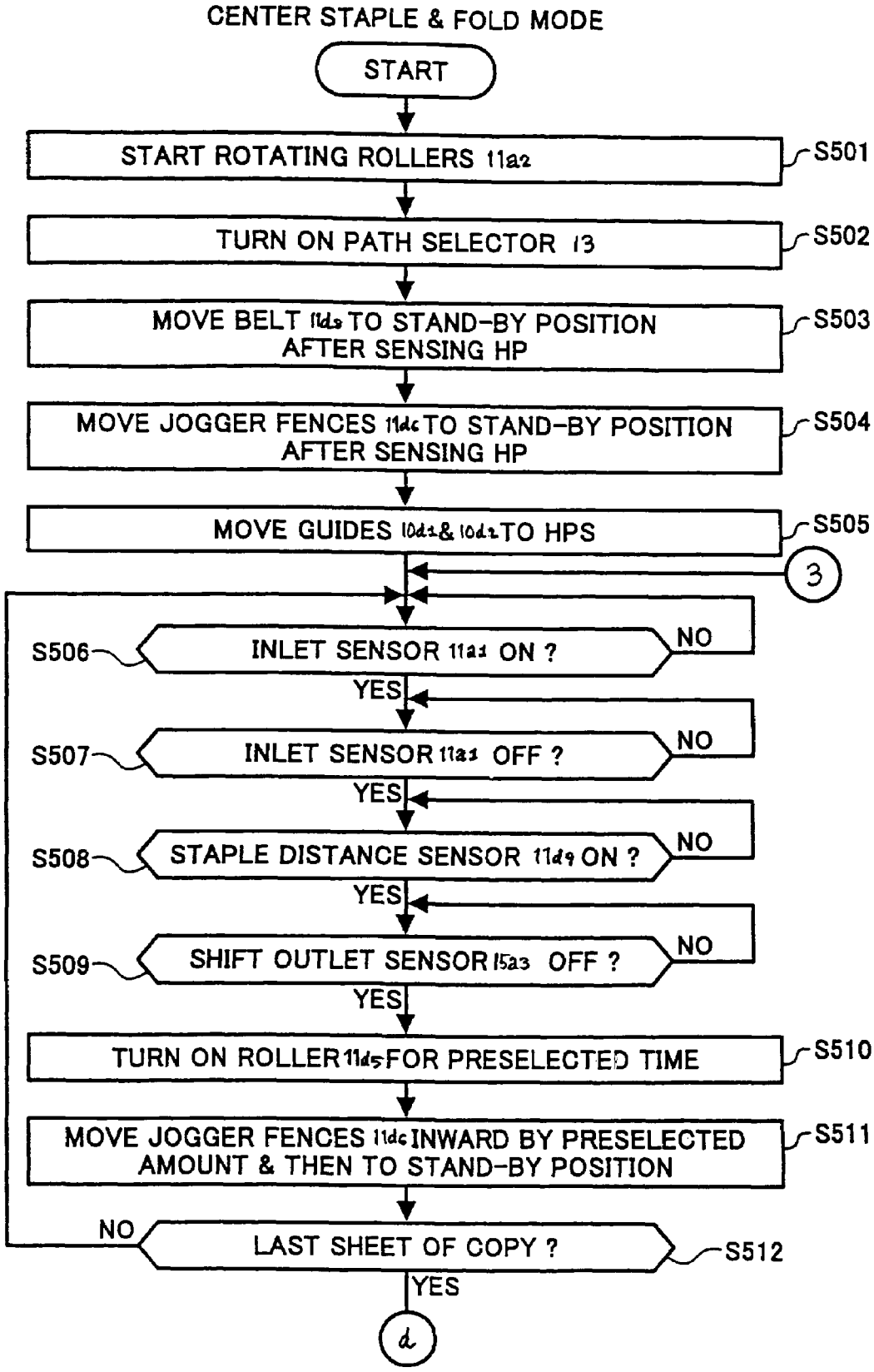
FIGS. 42 through 44 are flowcharts demonstrating a center staple mode available with the illustrative embodiment.
Figure 43:
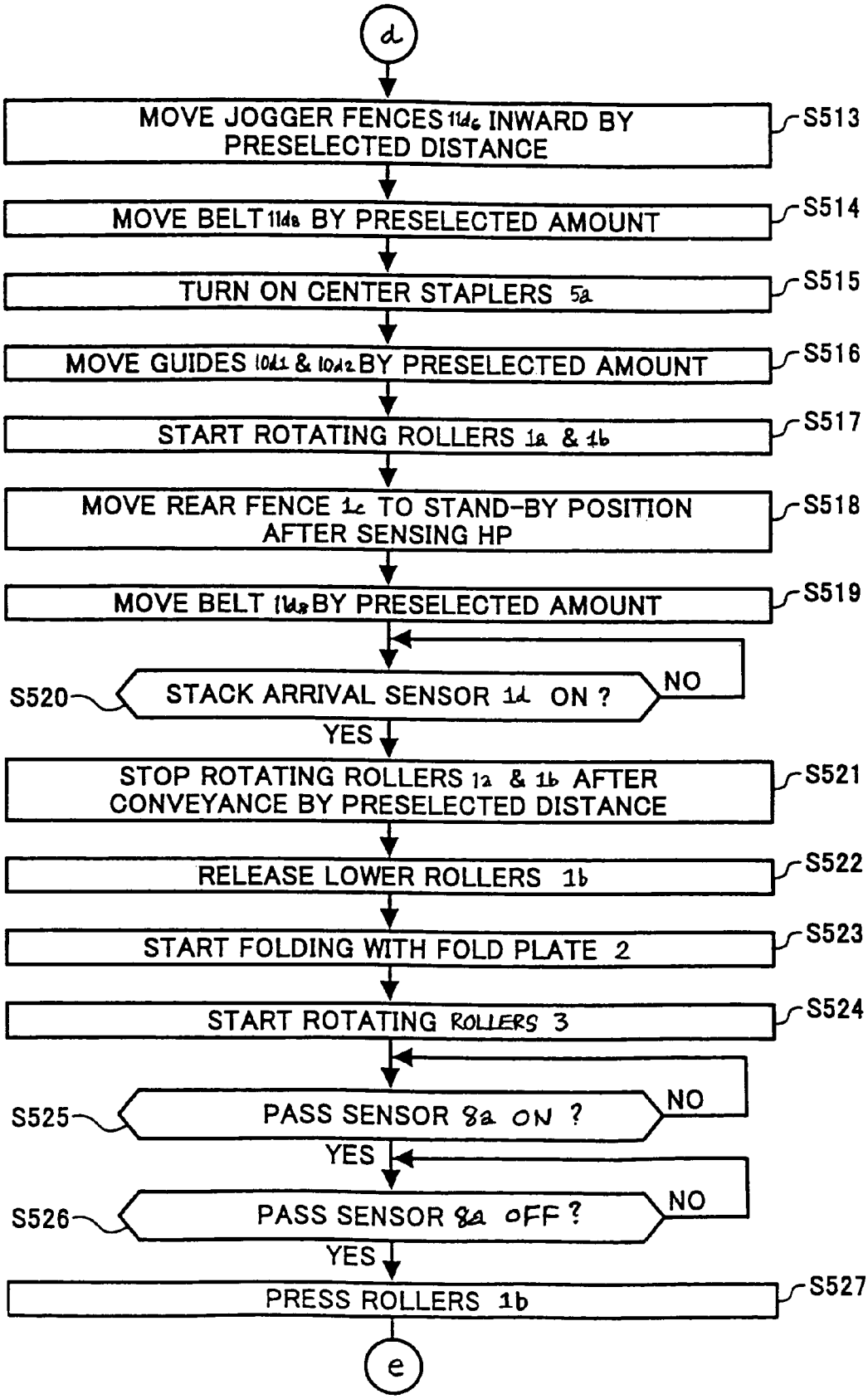
Figure 44:
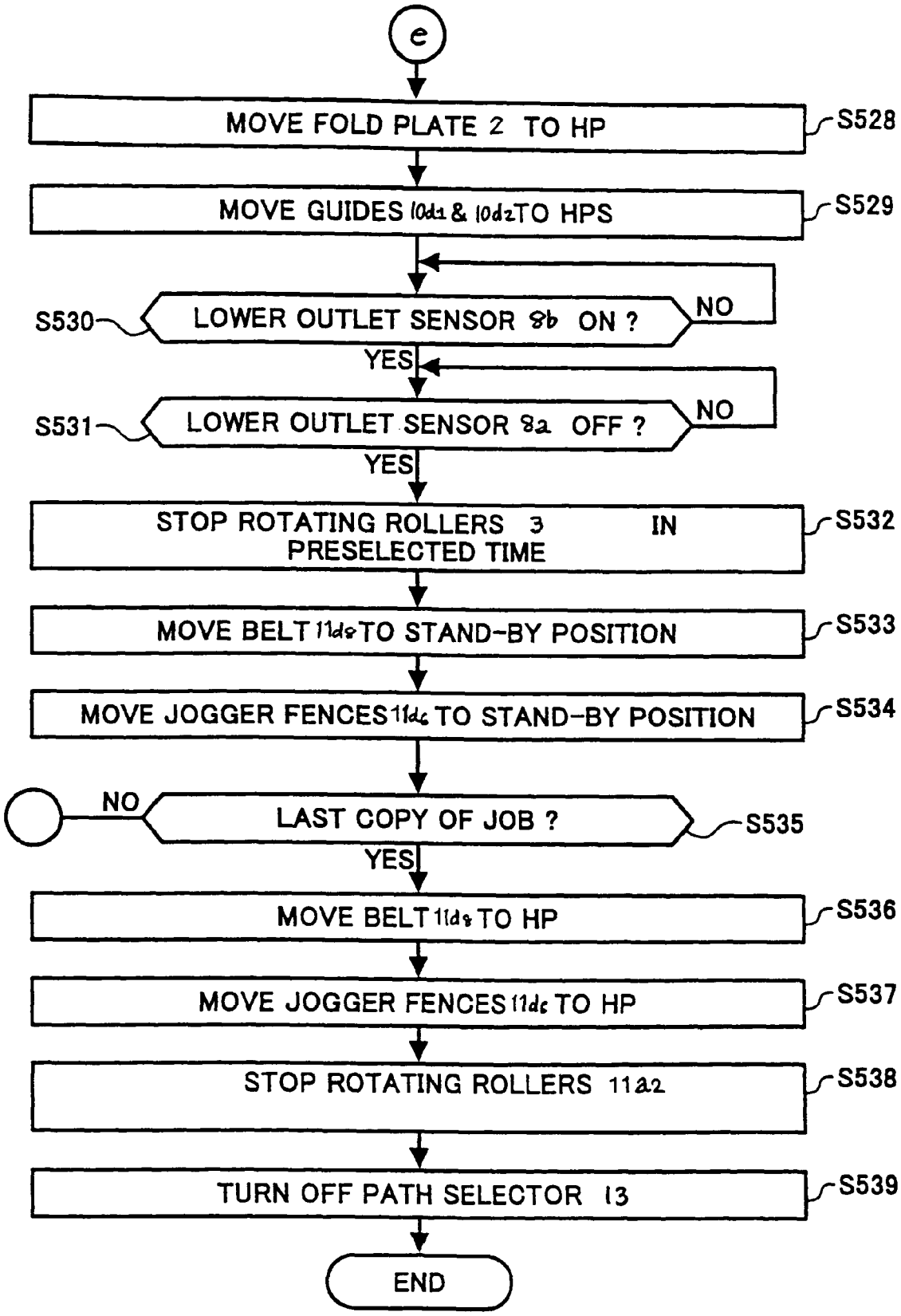

Reference will be made to FIGS. 42 through 44 for describing the center staple and bind mode available with the illustrative embodiment more specifically. As shown, before a sheet driven out of the image forming apparatus 20 enters the finisher 10, CPU 16*a* causes the inlet roller pair 11*a*2 and conveyor roller pair 11*a*3 on the path 11*a*, the conveyor roller pairs 11*d*18, 11*d*2 and 11*d*3 and staple outlet roller 11*d*4 on the path 11*d* and knock roller 11*d*5 to start rotating (step S501). The CPU 16*a* then energizes the solenoid assigned to the path selector 13 (step S502) to thereby cause the path selector 13 to rotate counterclockwise.

Subsequently, after the belt sensor 11*d*9 has sensed the belt 11*d*8 at the home position, the CPU 16*a* drives the discharge motor 11*d*10 to move the belt 11*d*8 to the stand-by position (step S503). Also, after the jogger fence HP sensor has sensed each jogger fence 11*d*6 at the home position, the CPU 16*a* moves the jogger fence to the stand-by position (step S504). Further, the CPU 16*a* moves the guide plate 10*d*1 and movable guide 10*d*2 to their home positions (steps S505).

If the inlet sensor 11*a*1 has turned on (YES, step S506) and then turned off (YES, step S507), if the staple discharge sensor 11*d*19 has turned on (YES, step S508) and if the shift outlet sensor 15*a*3 has tuned on (YES, step S509), then the CPU 16*a* determines that a sheet S is present on the staple tray 10*d*. In this case, the CPU 16*a* energizes the knock solenoid 11*d*52 for the preselected period of time to cause the knock roller 11*d*5 to contact the sheet and force it against the rear fences 10*d*3, thereby positioning the trailing edge of the sheet (step S510). Subsequently, the CPU 16*a* drives the jogger motor 11*d*61 to move each jogger fence 11*d*6 inward by the preselected distance for thereby positioning the sheet in the direction of width perpendicular to the direction of sheet conveyance and then returns the jogger fence 11*d*6 to the stand-by position (step S511). The CPU 16*a* repeats the steps S506 through S512 with every sheet. When the last sheet of a copy arrives at the staple tray 10*d* (YES, step S512), the CPU 16*a* moves the jogger fences 11*d*6 inward to the position where they prevent the edges of the sheets from being dislocated (step S513).

After the step S513, the CPU 16*a* turns on the discharge motor 11*d*10 to thereby move the belt 11*d*8 by a preselected amount (step S514), so that the belt 11*d*8 lifts the sheet stack to a stapling position assigned to the center staplers 5*a*. Subsequently, the CPU 16*a* turns on the center staplers 5*a* at the intermediate portion of the sheet stack for thereby stapling the sheet stack at the center (step S515). The CPU 16*a* then moves the guides 10*d*1 and 10*d*2 by a preselected amount each in order to form a path directed toward the path 1 of the folding device 0 (step S516) and causes the upper and lower roller pairs 1*a* and 1*b* on the path 1 to start rotating (step S517). As soon as the movable rear fence 1*c* on the path 1 is sensed at the home position, the CPU 16*a* moves the fence 1*c* to a stand-by position (step S518). The path 1 is now ready to receive the stapled sheet stack.

After the step S518, the CPU 16*a* further moves the belt 11*d*8 by a preselected amount (step S519) and causes the discharge roller 11*d*13 and press roller 10*d*12 to nip the sheet stack and convey it to the path 1. After the leading edge of the stapled sheet stack has arrived at the stack arrival sensor 1*d* (step S520), the CPU 16*a* causes the upper and lower roller pairs 1*a* and 1*b* on the path 1 to stop rotating (step S521), causes the fold plate 2 to starts moving for folding the sheet stack (step S523), and causes the fold roller pairs 3 and 6 and lower outlet roller pair 12*a* to start rotating (step S524). The CPU 16*a* then determines whether or not the pass sensor 8*a* responsive to the folded sheet stack has turned on (YES, step S525) and then turned off (YES, step S526). The CPU 16*a* then brings the lower rollers 1*b* into contact (step S527) and moves the fold plate 2 and guides 10*d*1 and 10*d*2 to their home positions (steps S528 and S529).

In the above condition, the CPU 16*a* determines whether or not the trailing edge of the folded sheet stack has moved away from the lower outlet sensor 8*b* (steps S530 and S531). If the answer of the step S531 is YES, then the CPU 16*a* causes the fold roller pairs 3 and 6 and lower outlet roller pair 12*a* to further rotate for a preselected period of time and then stop (step S532) and then causes the belt 11*d*8 and jogger fences 11*d*6 to return to the stand-by positions (steps S533 and S534). Subsequently, the CPU 16*a* determines whether or not the above sheet stack is the last copy of a single job to perform (step S535) If the answer of the step S535 is NO, then the procedure returns to the step S506. If the answer of the step S535 is YES, then the CPU 16*a* returns the belt 11*d*8 and jogger fences 11*d*6 to the home positions (steps S536 and S537). At the same time, the CPU 16*a* causes the inlet roller pair 11*a*2, roller pairs 11*a*3, 11*d*18, 11*d*2, 11*d*3, 11*d*4 and knock roller 11*d*5 to stop rotating (step S538) and turns off the solenoid assigned to the path selector 13 (step S539). As a result, all the structural parts are returned to their initial positions.

A specific configuration of the image forming apparatus 20 will be described with reference to FIGS. 45 through 47. As shown, the image forming apparatus includes toner image forming means 21, a sheet feeder 22 for feeding a sheet S to the toner image forming means 21, a scanner 23 for reading a document image, and an ADF (Automatic Document Feeder) 24. The sheet finisher 10 with the folding device 0 is operatively mounted to one side of the image forming apparatus.

Figure 45:
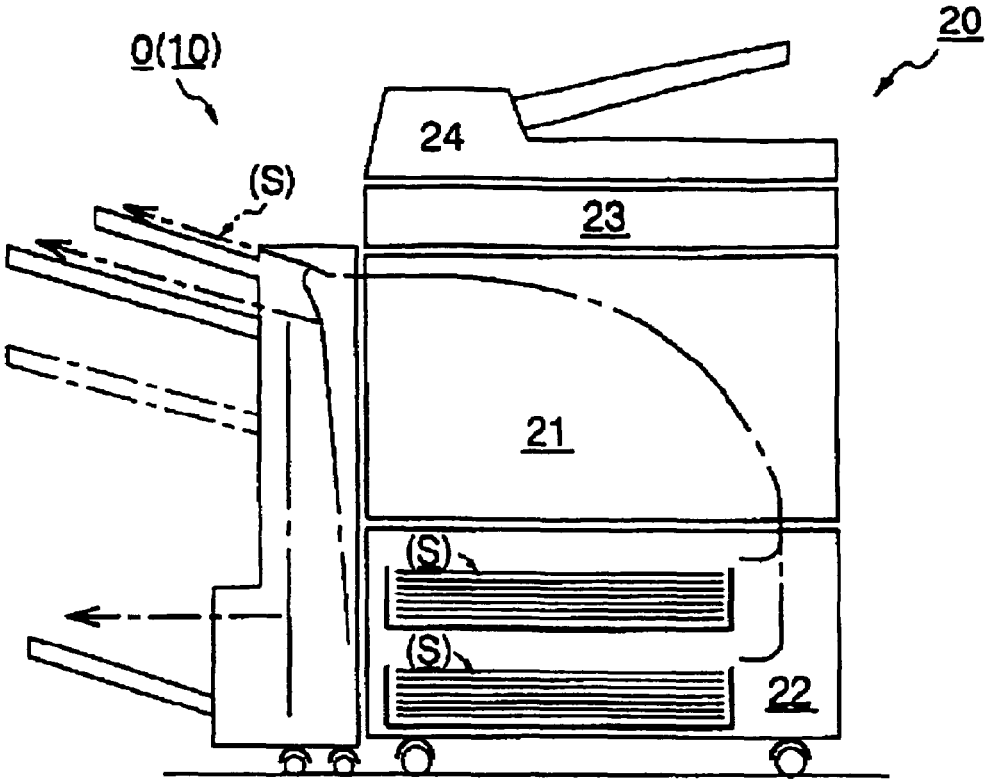
FIGS. 45 through 47 are views showing an image forming apparatus including the first embodiment.

In FIG. 45, the image forming apparatus is implemented as a copier by way of example. The sheet is usually conveyed from the sheet feeder 22 to the finisher 10 via the toner image forming means 21.

Figure 46:
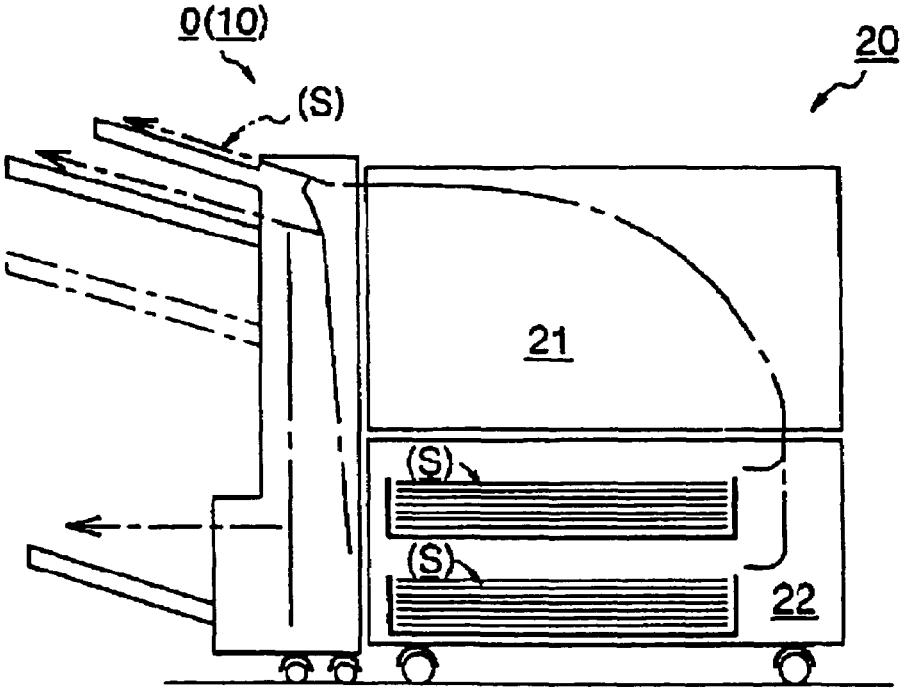

FIG. 46 shows an image forming system implemented as a printer in which the scanner 23 and ADF 24 are absent. The printer is identical with the copier of FIG. 45 as for the rest of the configuration.

Figure 47:
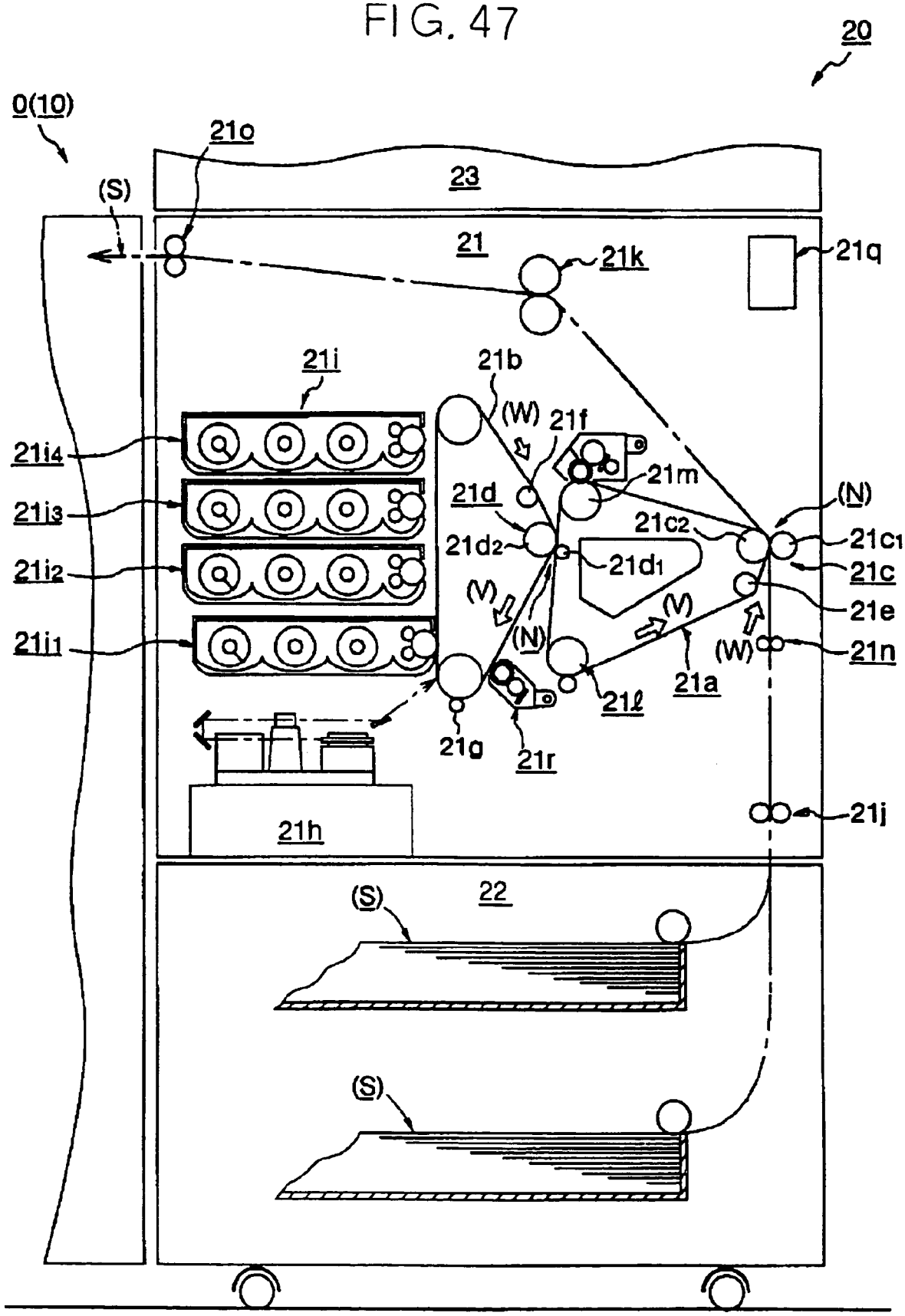

As shown in FIG. 47 specifically, the toner image forming means 21 includes a photoconductive belt implemented as an intermediate image transfer belt 21*a* or a belt-like image carrier 21*b*. The intermediate image transfer belt 21*a* is an urethane-based elastic member. Image transferring means 21*c* or 21*d* transfers a toner image formed on the intermediate image transfer belt 21*a* or the image carrier 21*b* to the sheet S or the belt 21*a*, respectively. The intermediate image transfer belt 21*a*, movable in a direction V via the nip of the image transferring means 21*c*, is passed over a tension roller 21*e*, a drive roller 21*l*, and a roller 21*m*. Likewise, the image carrier 21*b*, movable in a direction V via the nip N of the image transferring means 21*d*, is passed over a tension roller 21*f* as well as other rollers. The tension rollers 21*e* and 21*f* are respectively positioned upstream of the image transferring means 21*c* and 21*d* in a direction W in which the belts

21*a* and 21*b* enter the associated nips N. Also included in the image forming means 21 are a charger 21*g*, an optical writing unit 21*h*, developing units 21*i*1 through 21*i*4, collectively 21*i*, a roller pair 21*j* for sheet conveyance, a fixing unit 21*k*, a registration roller pair 21*n*, an outlet roller pair 20*o*, the operation panel 21*q*, and a cleaning unit 21*r*.

The image transferring means 21*c* is made up of rollers 21*c*1 and 21*c*2 while the image transferring means 21*d* is made up of rollers 21*d*1 and 21*d*2.

Arranged around the belt-like image carrier (belt hereinafter) 21*b* are the charger 21*g*, the optical writing unit 21*h*, developing devices 21*i*1 through 21*i*4, intermediate image transfer belt 21*a* and cleaning unit 21*r*. The developing units 21*i*1 through 21*i*4 are respectively assigned to black (B), cyan (C), magenta (M) and yellow (Y), respectively. The belt 21*b* has an organic photoconductive layer formed thereon.

In operation, when a start switch, not shown, provided on the operation panel 21*q* is pressed, a high voltage is applied to the charger 21*g* to thereby uniformly charge the surface of the belt 21*b*. A signal processor, not shown, converts color image information, e.g., color image signals input from a computer to corresponding color image data and sends the color image data to the optical writing unit 21*h*.

In the optical writing unit 21*h*, lasers are controlled in accordance with the color image data. Laser beams, issuing from the lasers, are routed through a polygonal mirror, an fθ lens and mirrors although not shown specifically. As a result, latent images are sequentially formed on the belt 21*b* in accordance with the B, C, M and Y image data.

The developing units 21*i*1 through 21*i*4 sequentially develop the latent images formed on the belt 21*b* with B, C, M and Y toners to thereby produce B, C, M and Y toner images respectively. At the position where the belt 21*b* contact the intermediate image transfer belt 21*a*, a charge opposite in polarity to the toners is applied in order to transfer the toner images from the belt 21*b* to the belt 21*a* one above the other, completing a full-color toner image.

Subsequently, the full-color toner image is transferred from the intermediate image transfer belt to the sheet S fed from the sheet feeder 22 via the roller pair 21*j* and registration roller pair 21*n* by the image transferring means or secondary image transfer member 21*c*. The image transferring means 21 is implemented by simple rollers 21*c*1 and 21*c*2, as stated earlier.

The sheet S, carrying the full-color toner image thereon, is conveyed to the fixing unit 21*k* to have the toner image fixed thereby. The sheet S is then handed over from the image forming apparatus 20 to the sheet finisher 10 via the outlet roller pair 21*o*.

The rollers 21*l*, 21*m* and 21*c*2 and other rollers except for the tension roller 21*e* are fixed in position relative to the frame of an intermediate image transferring unit.

As stated above, the illustrative embodiment is capable of surely, easily folding a sheet stack with a simple fold roller pair at an adequate position, providing the sheet stack with a sharp, attractive fold. It follows that a plurality of folded sheet stacks can be neatly stacked without collapsing. Particularly, pressing forces, exerted by two fold rollers, are well balanced with each other.

Further, even when the nip of the fold roller pair is shifted from the line L including the locus of movement of the fold plate 2 after the assembly of the folding device, the shift can be immediately corrected.

Second Embodiment

Figure 48:
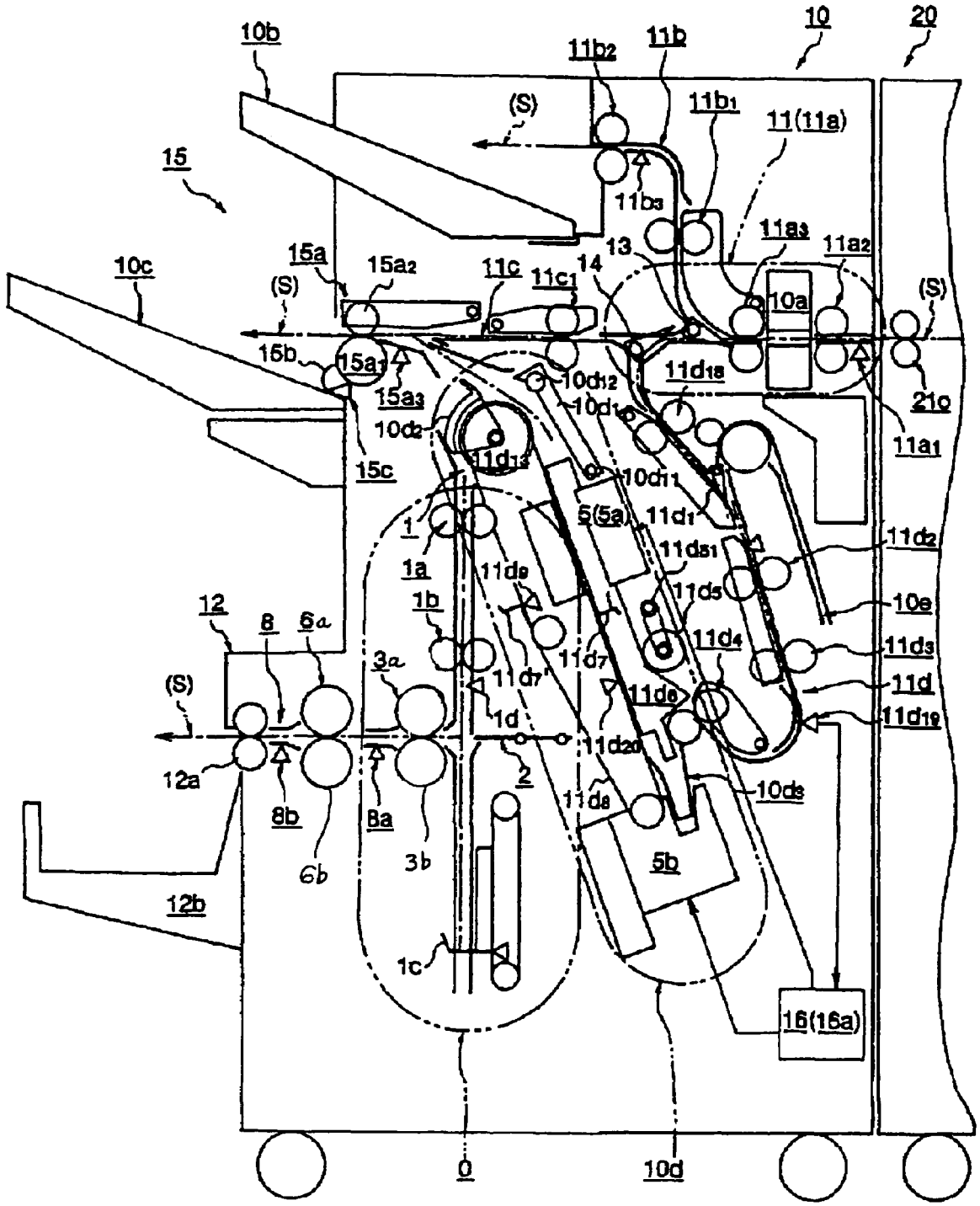
FIG. 48 is a view showing a sheet finisher representative of a second embodiment of the present invention.

A second embodiment of the present invention will be described hereinafter. The description of the first embodiment made with reference to FIGS. 7 through 35 and 42 through 43 also apply to the second embodiment. The following description will therefore concentrate on differences between the first and second embodiments. FIG. 48 shows a sheet finisher 10 of the illustrative embodiment identical with the sheet finisher 10 of the previous embodiment except for the following.

Figure 49:
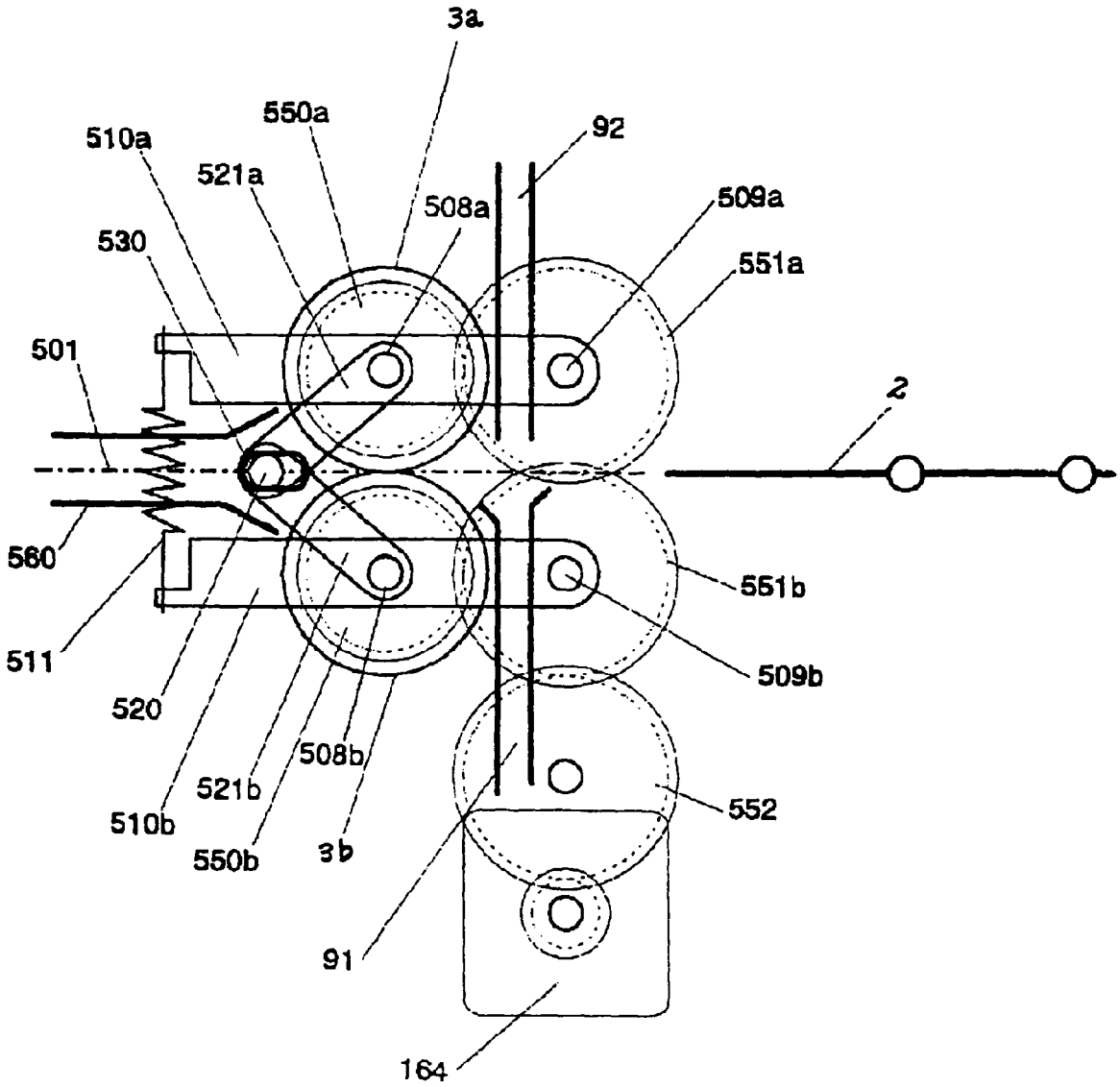
FIG. 49 is a view showing a drive mechanism for driving a fold roller pair included in the second embodiment.

FIG. 49 shows a mechanism for driving the fold rollers 3*a* and 3*b*. As shown, press bars 510*a* and 510*b* are respectively angularly movably supported by shafts 509*a* and 509*b* at one end and constantly biased toward each other by a tension spring 511 at the other end. Further, the press bars 510*a* and 510*b* are respectively supported by roller shafts 508*a* and 508*b* at the intermediate portions thereof. The roller shafts 508*a* and 508*b* are connected to a movable shaft 520, which is movable on the extension 501 of the locus of movement of the fold plate 2, by links or connecting means 521*a* and 521*b*, respectively. Although the extension of the above locus is indicated by a dash-and-dot line, it is, in practice, a plane.

In the above configuration, the press bars 510*a* and 510*b* are angulaly movable substantially symmetrically to each other with respect to the extension 501 of the locus. The movable shaft 520 moves back and forth along the extension 501 in accordance with the movement of the press bars 510*a* and 510*b*. The movable shaft 520 is received in a slot 530 and movable within the lengthwise range of the slot 530, determining the maximum gap between the fold rollers 3*a* and 3*b*. A path 560, like the extension 501, is positioned at the center of the gap.

A gear 552 is held in mesh with the output shaft of a fold roller motor 164 and a gear 551*b*, which is, in turn, held in mesh with a gear 551*a*. The gears 551*a* and 551*b* are held in mesh with gears 550*a* and 550*b*, respectively. The output torque of the fold roller motor 164 is transferred to the fold rollers 3*a* and 3*b* via such a gear train, causing the fold rollers 3*a* and 3*b* to rotate at the same speed as each other.

The fold rollers 3*a* and 3*b* move away from each other symmetrically to the extension 501 in accordance with the thickness of a sheet stack, exerting a pressing force on the sheet stack up to the maximum distance due to the bias of the tension spring 511. More specifically, the ends of the press bars 510*a* and 510*b* to which the tension spring 511 is anchored move farther from each other as the thickness of the sheet stack increases, so that the force that folds the sheet stack increases. It is noteworthy that when the thickness of the folded sheet stack exceeds the maximum distance between the fold rollers 3*a* and 3*b*, the sheet stack cannot pass through the gap between the fold rollers 3*a* and 3*b* and is therefore prevented from jamming the path after entering the above gap. Further, even when the sheet stack is thick, the fold formed by the fold plate 2 and the fold formed by the fold rollers 3*a* and 3*b* accurately coincide with each other.

Figure 50:
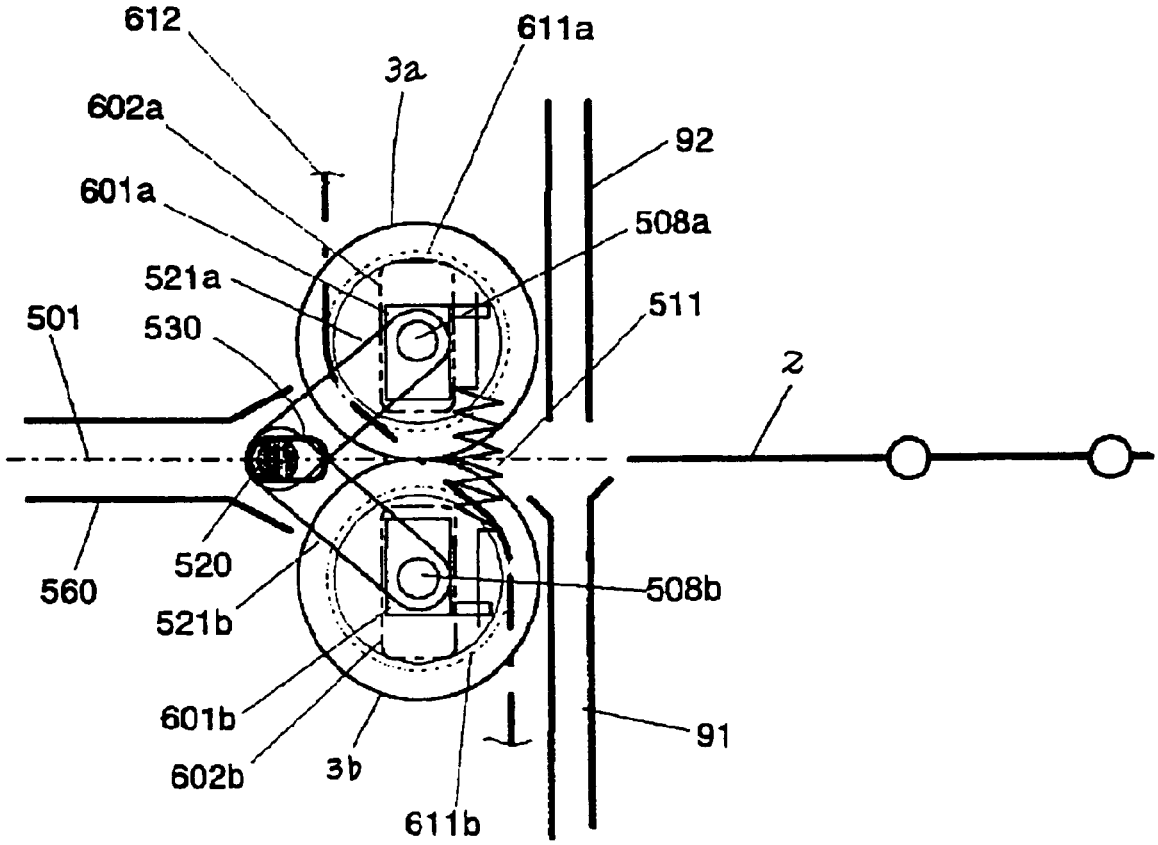
FIG. 50 is a view showing a modification of the drive mechanism.

FIG. 50 shows a modified mechanism for driving the fold rollers 3*a* and 3*b*. As shown, the press bars 510*a* and 510*b*, FIG. 49, are replaced with guides 602*a* and 602*b* positioned perpendicularly to the extension 501 and slide bearings 601*a* and 601*b* linearly movable along the guides 602*a* and 602*b*. In this modification, the tension spring 511 constantly biases the slide bearings 601*a* and 601*b* toward each other.

Timing pulleys 508*a* and 508*b* are mounted on the shafts 508*a* and 508*b*, respectively, while a timing belt 612 are passed over the timing pulleys 508*a* and 508*b*, as illustrated. In this configuration, the fold rollers 3*a* and 3*b* are driven to fold a sheet stack.

The drive mechanism shown in FIG. 49 or 50 is similarly applicable to the other fold rollers or reinforce rollers 6*a* and 6*b*, FIG. 48, so that the fold of a sheet stack can be reinforced with its fold coinciding with the stapled position. At this instant, the nip between the fold rollers 6*a* and 6*b* is also positioned on the extension 501 of the locus of the fold plate 2, so that the path 560 following the fold rollers 6*a* and 6*b* has the extension 501 located at the center of the gap.

As stated above, in the illustrative embodiment, a sheet stack is conveyed while being pressed without its center being shifted relative to the fold rollers 3*a* and 3*b* without regard to the number of sheets. Therefore, the fold of the sheet stack formed by the fold rollers 3*a* and 3*b* accurately coincides with the stapled position of the same. Further, the link mechanism, which generally withstands heavy loads and can be easily provided with dimensional accuracy, allows a sheet stack to be accurately, sharply folded without the pressing force being limited.

Further, because the movable range of the movable shaft 520 is limited by the slot 530, the displacement of the fold rollers 3*a* and 3*b* is limited such that the maximum gap between the rollers 3*a* and 3*b* is smaller than or equal to the gap preceding or following it. This insures smooth conveyance of a sheet stack while reducing noise ascribable to conveyance.

Moreover, the nip between the fold rollers or reinforce rollers 6*a* and 6*b* is accurately coincident with the fold of a sheet stack formed by the fold rollers 3*a* and 3*b*.

Third Embodiment

A third embodiment of the present invention will be described hereinafter. The description of the first embodiment made with reference to FIGS. 7 through 42 also apply to the third embodiment. The following description will therefore concentrate on differences between the first and third embodiments.

Figure 51:
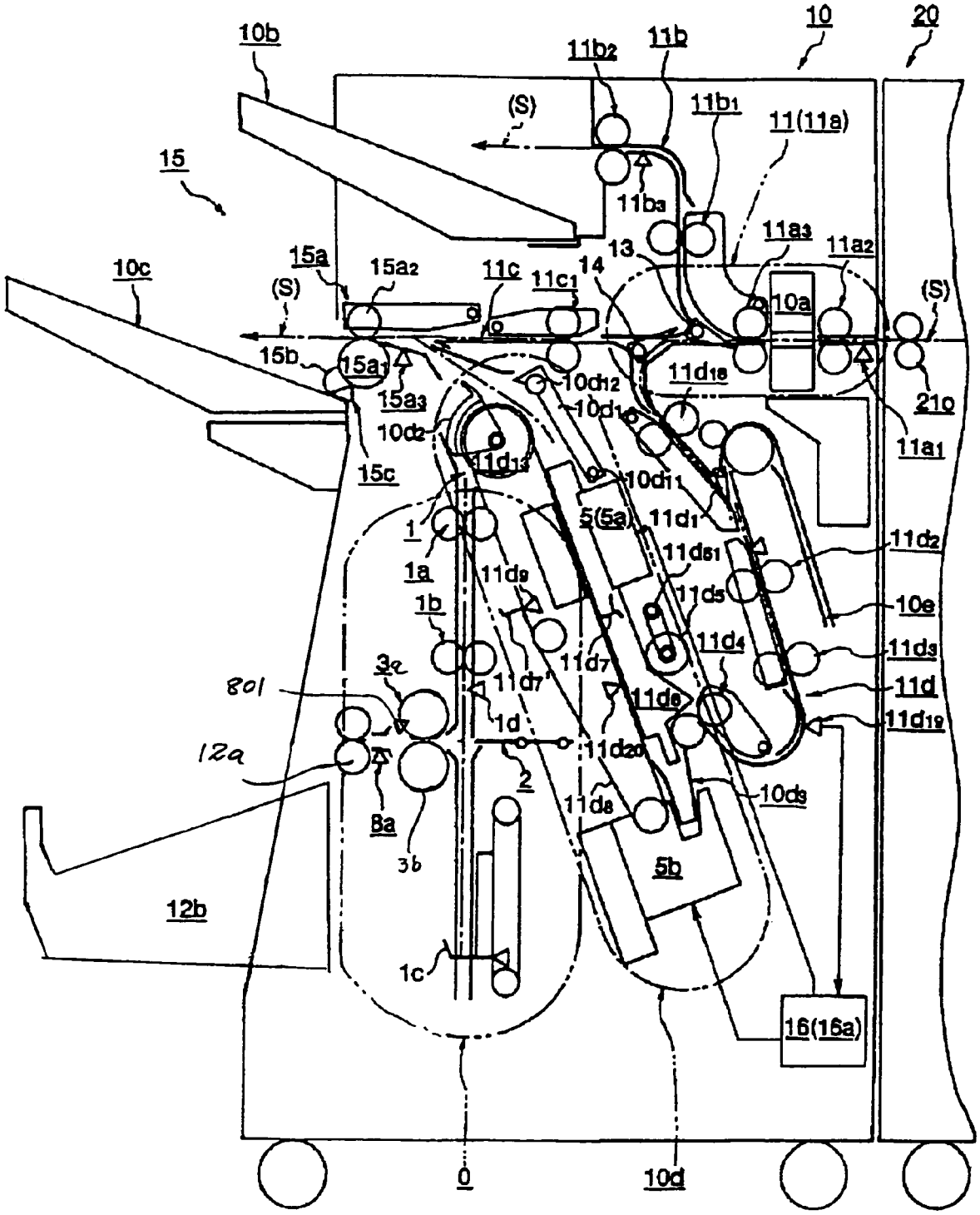
FIG. 51 is a view showing a sheet finisher representative of a third embodiment of the present invention.

FIG. 51 shows a sheet finisher to which the illustrative embodiment is applied. As shown, the sheet finisher is generally identical with the sheet finisher 10 of the first embodiment, FIG. 6, except for the sheet folding device 0.

Figure 52:
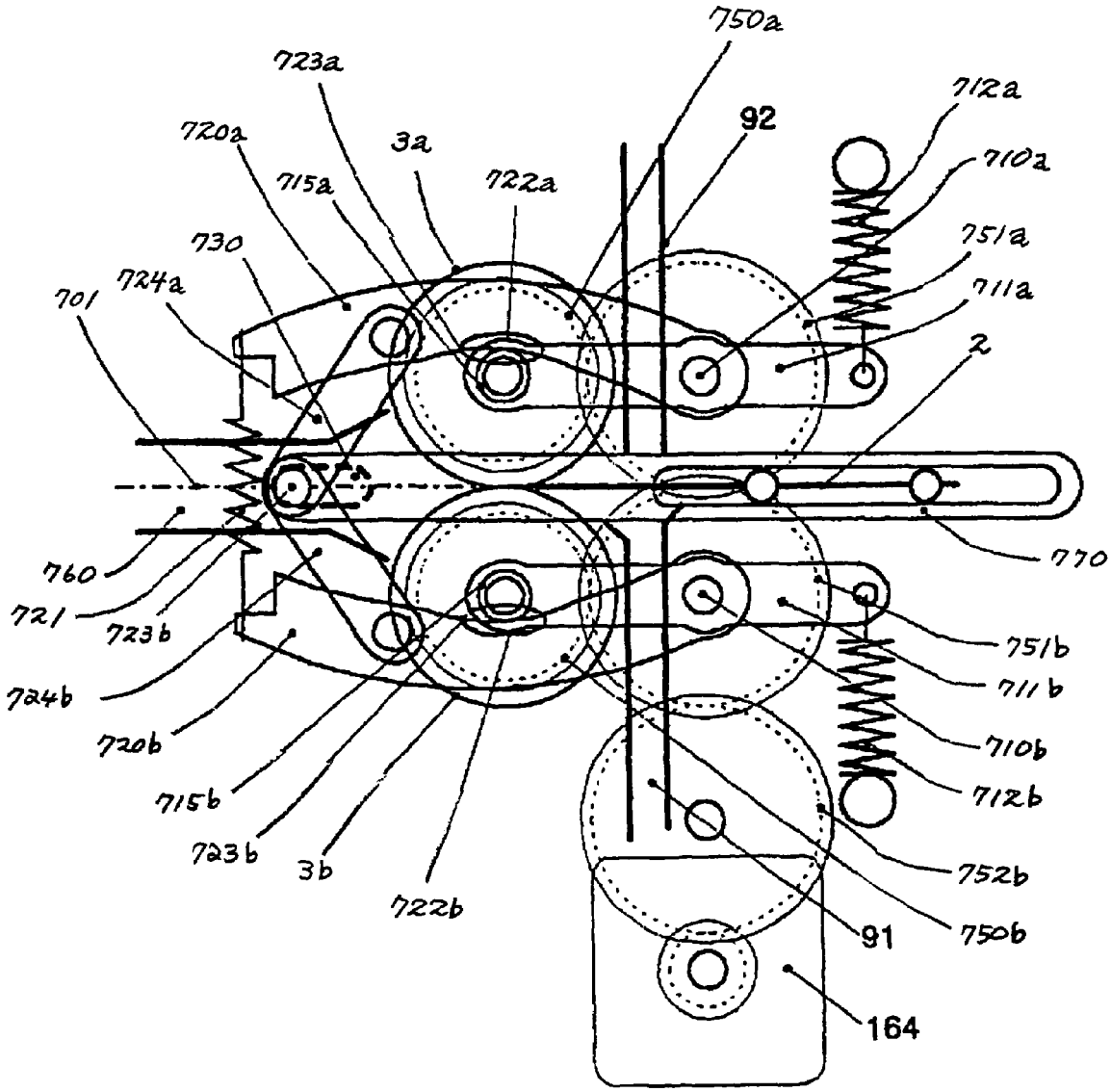
FIG. 52 is a view showing fold rollers and a pressure applying and canceling mechanism included in the third embodiment in a pressure applying condition.
Figure 53:
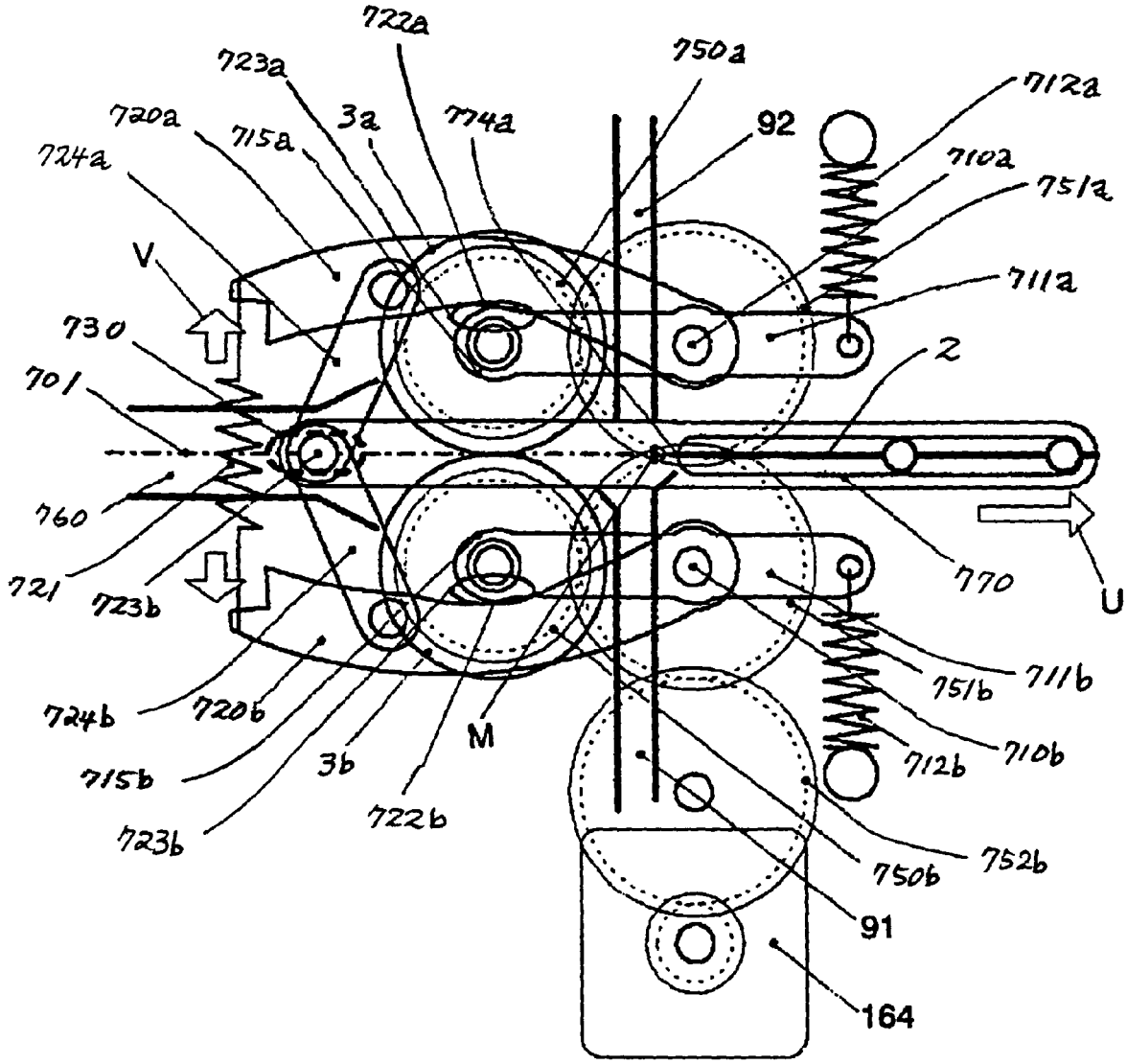
FIG. 53 is a view similar to FIG. 52, showing the fold rollers and pressure applying and canceling mechanism in a pressure canceling condition.

FIGS. 52 and 53 show the sheet folding device 0, particularly a mechanism for selectively applying pressure to the fold rollers 3*a* and 3*b* or canceling it, in detail. As shown, the pressure applying and canceling mechanism includes the fold rollers 3*a* and 3*b*, movable arms or first members 711*a* and 711*b*, swing arms or second members 720*a* and 720*b*, tie bars or third members 724*a* and 724*b*, first springs 712*a* and 712*b*, a second spring 721, the fold plate 2, a pressure cancel link (or third member) 770, and the motor 164 for driving the fold rollers 3*a* and 3*b*. The nip between the fold rollers 3*a* and 3*b* is positioned on a line 701 including the locus of movement 701 of the fold plate 2. Because various members are arranged substantially symmetrically with respect to the line 701, the members above the line 701 and the members below the line 701 are distinguished from each other by suffices a and b, respectively.

The movable arms 711*a* and 711*b* are respectively angularly movably supported by fulcrums 710*a* and 710*b*, which are, in turn, supported by the opposite side walls supporting the various portions of the fold tray. The fold rollers 3*a* and 3*b* are respectively rotatably supported by the movable arms 711*a* and 711*b* via bearings 715*a* and 715*b*. The first springs 712*a* and 712*b* are respectively anchored to the upstream ends of the movable arms 711*a* and 711*b* in the direction of sheet conveyance, constantly pressing the fold rollers 3*a* and 3*b* against each other. The first springs 712*a* and 712*b* exert a bias that implements a force necessary for the fold rollers 3*a* and 3*b* to convey a sheet stack. The movable arms 711*a* and 711*b*, fulcrums 710*a* and 710*b*, swing arms 720*a* and 720*b* and first and second springs 712*a*, 712*b*, and 721 each are provided in a pair at the inside and outside of the opposite side walls. The axes of the fold rollers 3*a* and 3*b* extend in the direction perpendicular to the sheet surface of FIG. 52 or 53.

The swing arms 720*a* and 720*b*, like the movable arms 711*a* and 711*b*, are respectively swingably supported by the fulcrums 710*a* and 710*b* at the upstream ends thereof in the direction of sheet conveyance. The second spring 721 is anchored to the swing arms 720*a* and 720*b* at opposite ends thereof, constantly biasing the above ends toward each other. As shown in FIG. 52, the swing arms 720*a* and 720*b* are respectively positioned above and below the fold rollers 3*a* and 3*b*. When the bearings 715*a* and 715*b* of the fold rollers 3*a* and 3*b* are moved away from each other by a preselected distance, the fold rollers 3*a* and 3*b* respectively contact the edges of the swing arms 720*a* and 720*b* facing each other and are therefore subject to the bias of the second spring 721.

So long as the bearings 715*a* and 715*b* do not contact the swing arms 720*a* and 720*b*, respectively, the fold rollers 3*a* and 3*b* are subject to the bias of the first springs 712*a* and 712*b*, respectively. The bias of the second spring 721 is selected to be stronger than the bias of the first springs 712*a* and 712*b*. In this configuration, when a sheet stack enters the nip between the fold rollers 3*a* and 3*b*, the comparatively weak bias of the first springs 712*a* and 712*b* acts on the sheet stack. When the bearings 715*a* and 715*b* respectively contact the swing arms 720*a* and 720*b*, the comparatively strong bias of the second spring 721 acts on the sheet stack. In this configuration, gaps or plays 723*a* and 723*b* between the positions where the fold rollers 3*a* and 3*b* contact each other and the positions where the bearings 715*a* and 715*b* contact the swing arms 720*a* and 720*b* play an important role when a sheet stack enters the nip between the fold rollers 3*a* and 3*b*.

To provide the fold rollers 3*a* and 3*b* with a conveying function in addition to the folding function, the illustrative embodiment additionally includes the motor 164 and drive transmission mechanism. The drive transmission mechanism is implemented as a speed reduction gear train including gears 752, 751*a* and 751*b*. The gear 752 is held in mesh with the output shaft of the motor 164 and the gear 751*b*, which is held in mesh with the gear 751*a*. The gears 751*a* and 751*b* are respectively held in mesh with gears 750*a* and 750*b*, which are coaxial with the fold rollers 3*a* and 3*b*, and rotated at the same speed.

The pressure cancel link 770 is positioned at the inside of each of the opposite side walls and movable back and forth along the line in interlocked relation to the fold plate 2. The pressure cancel link 770 limits the positions of the swing arms 720*a* and 720*b* for thereby canceling pressure acting on the fold rollers 3*a* and 3*b*. More specifically, the tie bars 724*a* and 724*b* respectively connect a movable shaft 723, which is positioned downstream of the fold rollers 3*a* and 3*b* in the direction of sheet conveyance, and swing arms 720*a* and 720*b*, thereby relating the position of the pressure cancel link 770 and the positions of the swing arms 720*a* and 720*b*. In this configuration, the position of the pressure cancel link 770 determines the timing for applying the pressure to a sheet stack and the timing for canceling it.

The movable shaft 723 is received in a guide slot 730 extending along the line 701, so that the dimension of the guide slot 730 determines the movable range of the shaft 723. The movable range of the shaft 723, in turn, determines the maximum gap between the fold rollers 3*a* and 3*b*. A path 760 along which a folded sheet stack is conveyed is positioned at the center of the above gap. The guide hole 730, determining the movable range of the shaft 723, may be replaced with slots formed in the swing arms 720*a* and 720*b* and receiving members provided on the tie bars 724*a* and 724*b*.

In the above configuration, the movement of the movable shaft 720 in the direction of sheet discharge is limited by the dimension of the guide hole 730, so that the gaps or plays 723*a* and 723*b* are guaranteed between the swing arms 720*a* and 720*b* and the bearings 715*a* and 715*b*. This successfully limits the transfer of the bias of the first springs 712*a* and 712*b* to the fold rollers 3*a* and 3*b*.

The first springs 712*a* and 712*b* may be replaced with compression springs positioned in portions 722*a* and 722*b* where the swing arms 720*a* and 720*b* press the fold rollers 3*a* and 3*b*, respectively, exerting a weak bias on the fold rollers 3*a* and 3*b*. The dimension of each gap 723*a* or 723*b* is determined by the position of the downstream end of the guide slot 730 in the direction of sheet conveyance. Therefore, the gaps 723*a* and 723*b* and the maximum gap between the fold rollers 3*a* and 3*b* are determined by the position of the guide slot 730 and the dimension of the pressure cancel link 770 in the direction of movement.

Further, the movable shaft 723 is operatively connected to the pressure cancel link 770. Therefore, when the pressure cancel link 770 is moved in a direction indicated by an arrow Y in FIG. 53, the swing arms 720*a* and 720*b* each are moved in a direction indicated by an arrow V. As a result, gaps are formed between the swing arms 720*a* and 720*b* and the bearings 715*a* and 715*b*, interrupting the transfer of the bias of the second spring 721.

The center staple and bind mode available with the illustrative embodiment will be described with reference to FIG. 54 as well as to FIGS. 42 through 44. The center staple and bind mode of the illustrative embodiment is identical with the corresponding mode of the first embodiment described with reference to FIGS. 42 through 44 except for the following. In the illustrative embodiment, among the steps S501 through S528, the steps S526 and S527 are absent while, among the steps S529 through S539, the steps S531 through S534 are identical. Further, the steps S529 and S530 are replaced with steps S528*a*, S529*a* and S530*a* shown in FIG. 54.

Figure 54:
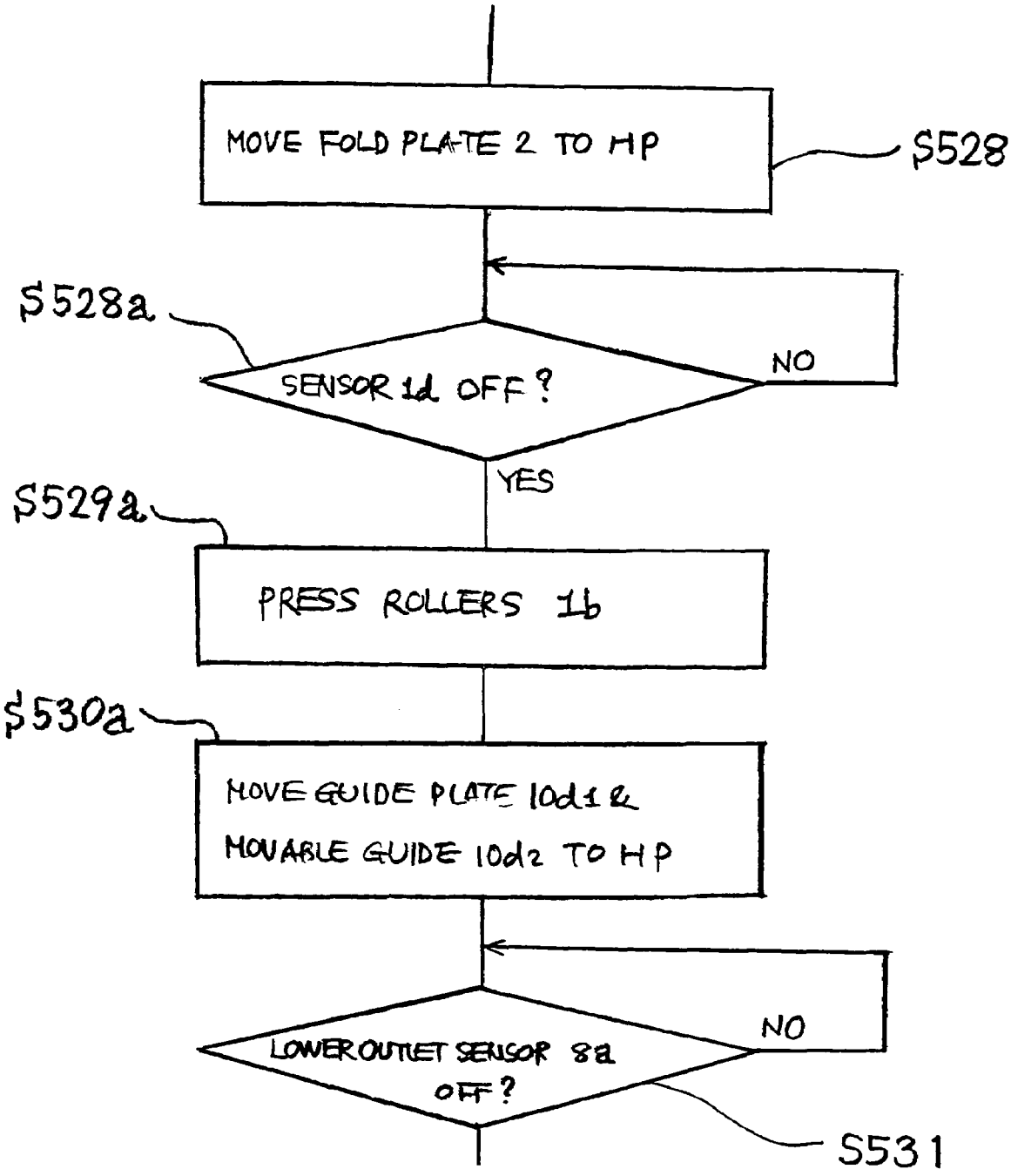
FIG. 54 is a flowchart demonstrating a center staple mode available with the third embodiment.

As shown in FIG. 54, in the step S528, the CPU 16*a* causes the fold plate 2 to move to its home position. When the arrival sensor 1*d* turns off (YES, step S528*a*), the CPU 61*a* causes the lower roller pair 1*b* to be pressed (step S529*a* and causes the guide plate 10*d*1 and movable guide 10*d*2 to move to their home positions (step S5230*a*).

Figure 55:
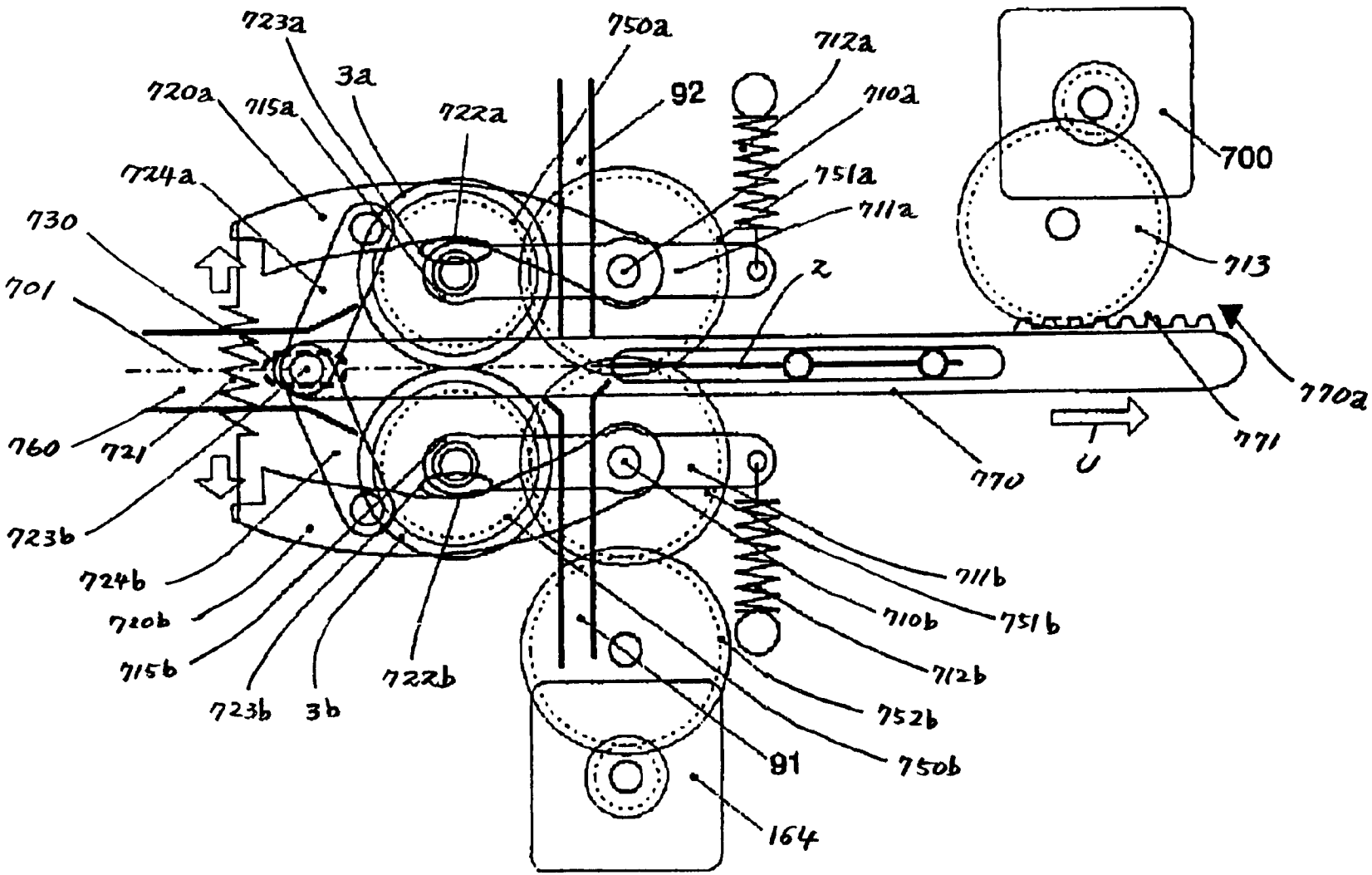
FIG. 55 is a view showing a first modification of the third embodiment in a pressure canceling condition.

FIG. 55 shows a first modification of the illustrative embodiment shown in FIGS. 52 and 53. As shown, the pressure cancel link 770 is provided with a rack 771. A gear 713 is held in mesh with the rack 771 for retracting the pressure cancel link 770 in the direction U when the pressure should be canceled. The gear 713 is held in mesh with the output shaft of a pressure cancel motor 700. A link HP sensor 770*a* is responsive to the home position of the pressure cancel link 770. The pressure cancel motor 700 stops rotating as soon as the sensor 770*a* senses the pressure cancel link 770 returned to the home position. As for the rest of the configuration, the first modification is identical with the illustrative embodiment.

In the illustrative embodiment, the pressure cancel link 770 moves back and forth in interlocked relation to the fold plate 2. As soon as the pressure cancel link 770 retracts to a preselected position, the tie bars 724*a* and 724*b* move the swing arms 720*a* and 720*b* away from each other for thereby interrupting the transfer of the bias of the second spring 721 to the fold rollers 3*a* and 3*b*. By contrast, in the first modification described above, the pressure cancel link 770 is caused to retract independently of the movement of the fold plate 2, canceling the pressure of the fold rollers 3*a* and 3*b* at preselected timing.

Figure 56A:
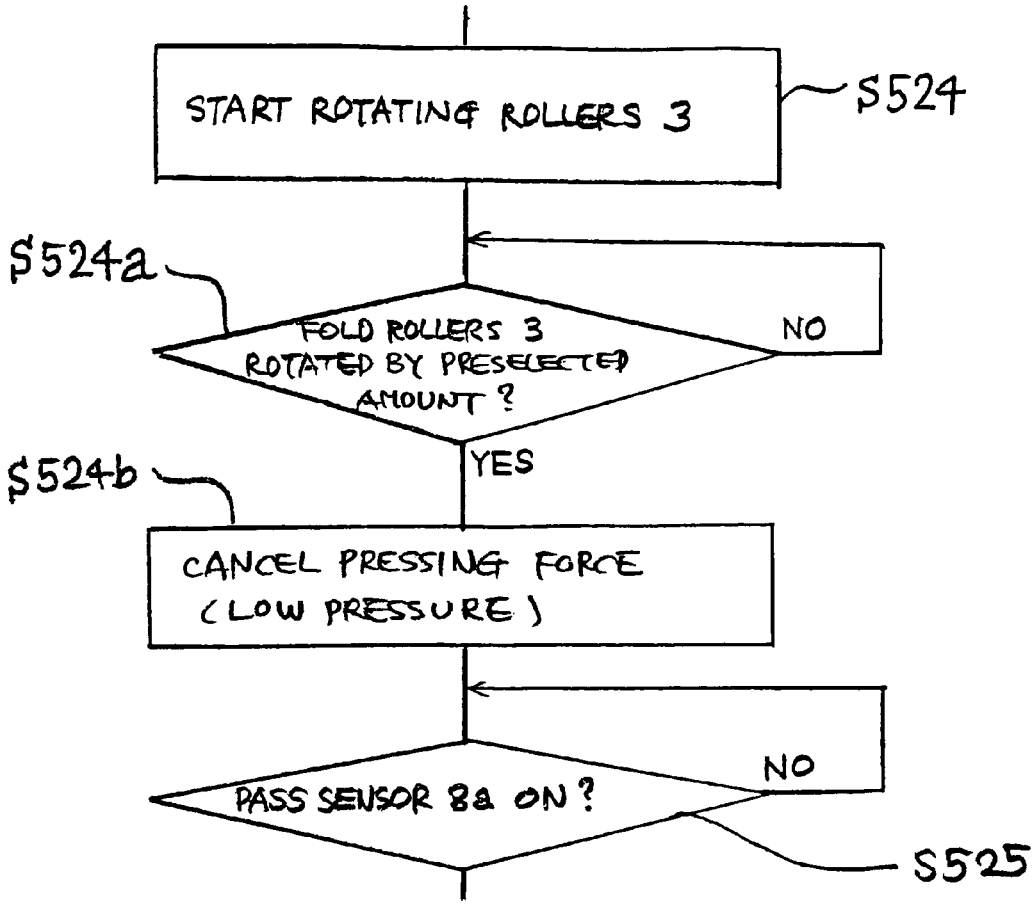
FIGS. 56A and 56B are flowcharts demonstrating part of center staple mode operation available with the first modification of FIG. 55.
Figure 56B:
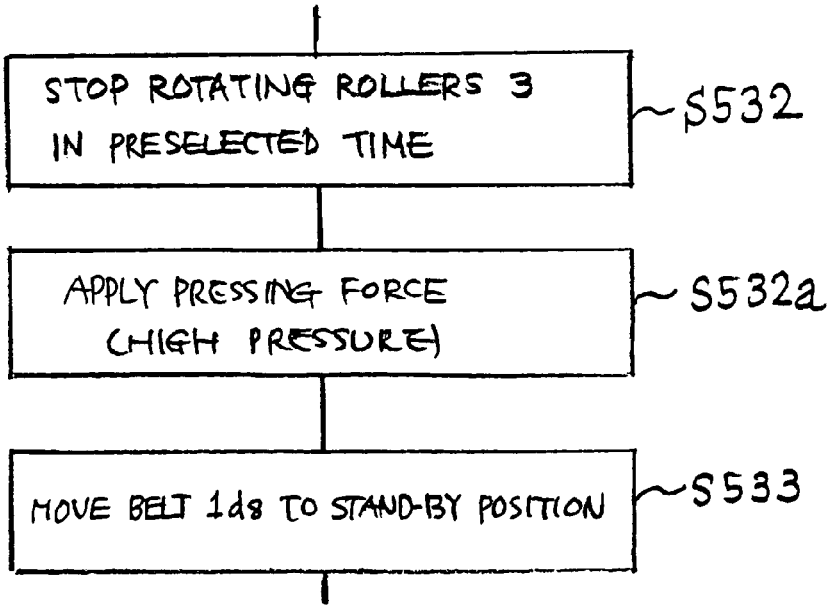

As shown in FIGS. 56A and 56B, as for the center staple and bind mode, the first modification is identical with the illustrative embodiment except that two steps S524*a* and 524*b* intervene between the steps S524 and S525 and that a step S532*a* intervenes between the steps S532 and S533.

More specifically, in the step S524 shown in FIG. 56A, the CPU 16*a* causes the fold rollers 3*a* and 3*b* and lower outlet roller 12*a* to start rotating. When the fold rollers 3*a* and 3*b* have rotated by an amount large enough to sufficiently fold the leading edge of the sheet stack (YES, step 524*a*), the CPU 16*a* causes the pressure cancel motor 700 to rotate to retract the pressure cancel link 770. Consequently, the movable shaft 723 moves, as stated earlier, with the result that the tie bars 724*a* and 724*b* open the swing arms 720*a* and 720*b* for thereby canceling the pressure acting on the fold rollers 3*a* and 3*b* (step S524*b*).

When the leading edge of the sheet stack moves away from the pass sensor 8*a* (YES S525), the CPU 16*a* returns the fold plate 2 to the home position, as shown in FIG. 54 (step S528). Subsequently, when the arrival sensor 1*d* turns off (YES, step S529*a*), the CPU 16*a* presses the lower roller pair 1*b* (step S529*a*) and returns the guide plate 10*d*1 and movable guide 10*d*2 to the home positions (step S530*a*).

Subsequently, as shown in FIG. 56B, when the trailing edge of the sheet stack moves away from the pass sensor 8*a* (YES, step S531), the CPU 16*a* causes the fold roller pair 3 and lower roller pair 12*a* to further rotate for a preselected period of time and then stop (step S532). The CPU 16*a* then turns off the pressure cancel motor 700 with the result that the swing arms 720*a* and 720*b* respectively press the fold rollers 3*a* and 3*b* under the action of the second spring 721 (step S532*a*). Further, the CPU 16*a* causes the belt 11*d*8 and jogger fence 11*d*6 to move to their stand-by positions. This is followed by the sequence of steps S535 through S539 stated previously.

As stated above, in the first modification, the pressure cancel motor 700 selectively cancels the pressure acting on the fold rollers 3*a* and 3*b* independently of the movement of the fold motor 2, so that the portions that press a sheet stack can be accurately controlled. The leading edge of a sheet stack is surely introduced into the nip between the fold rollers 3*a* and 3*b* by low pressure, then folded by high pressure, and then conveyed by low pressure, as stated in relation to the illustrative embodiment. The thicker the sheet stack, the longer the portion of the sheet stack to be folded in the direction of conveyance. In light of this, the range over which a sheet stack is to be folded should preferably be controlled in accordance with the thickness of a sheet stack, as will be described hereinafter.

In the first modification, the timing for driving the pressure cancel motor 700 is so set as to immediately cancel the pressure at preselected timing. It suffices to strongly press a sheet stack by 3 mm to 25 mm, particularly 3 mm to 10 mm, as measured from the leading edge of the sheet stack, as stated earlier. In light of this, when a sheet stack has moved over a pressing range set in accordance with its thickness, as counted by a timer, the CPU 16*a* turns on the pressure cancel motor 700. This allows the pressing range to be accurately set.

It is to be noted that a sheet stack should be strongly pressed at least over a range of 3 mm from the leading edge of the innermost sheet of the sheet stack. By so pressing a sheet stack, it is possible to surely, neatly folding the sheet stack.

Figure 57:
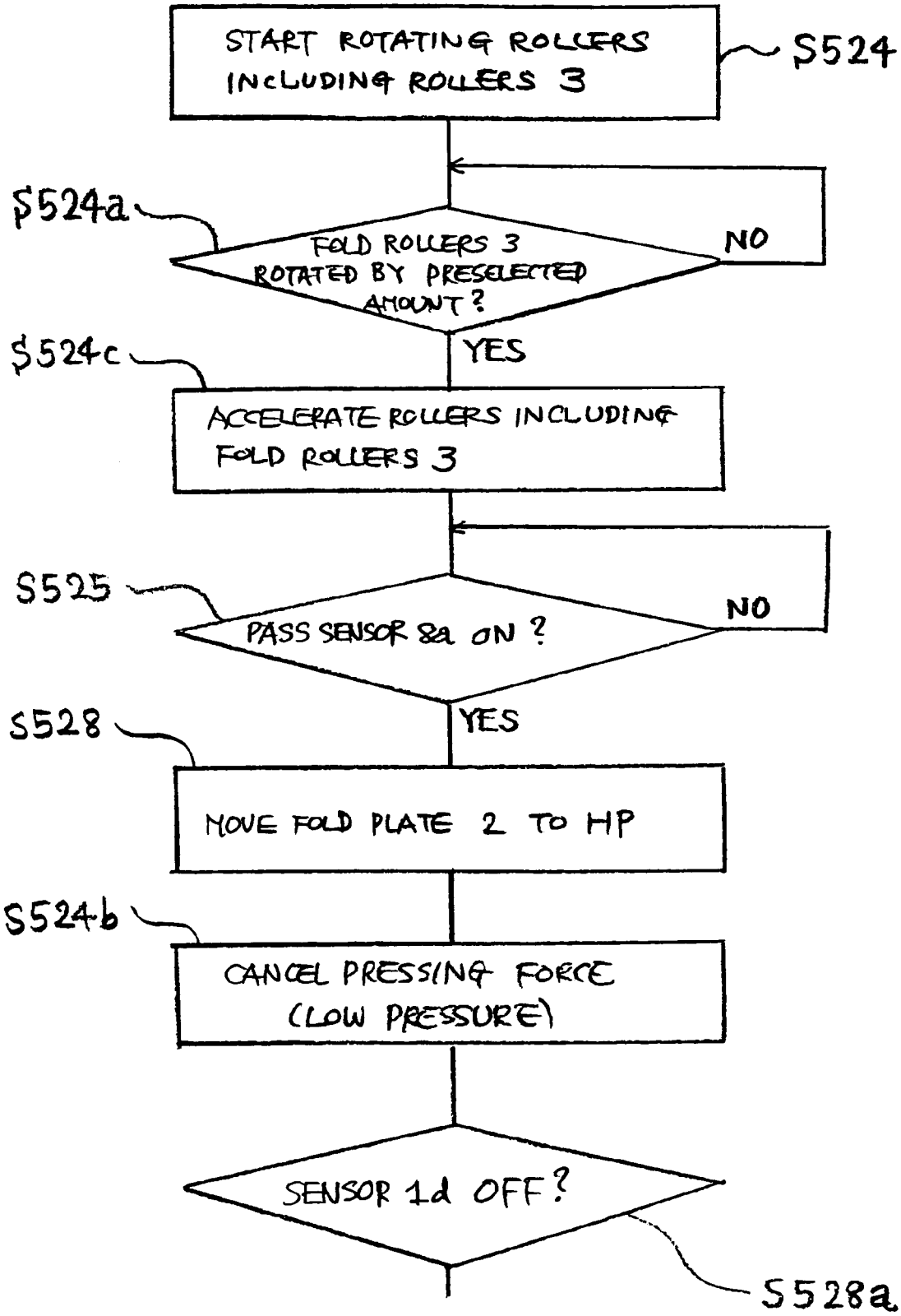
FIG. 57 is a flowchart demonstrating part of center staple mode operation representative of a second modification of the third embodiment.

A second modification of the illustrative embodiment will be described with reference to FIG. 57. The second modification is identical with the first modification, FIG. 55, as to the fold roller pair 3 and the pressure applying and canceling mechanism and identical with the illustrative embodiment as to the rest of the configuration. The second modification takes account of the conveying time in order to effect efficient processing, compared to the first modification.

The second modification differs from the first modification as to the processing between the steps S524 and S528*a* shown in FIGS. 42 through 44, 54, 56A and 56B. More specifically, as shown in FIG. 57, assume that after the fold rollers 3*a* and 3*b* and lower outlet roller 12*a* have started rotating (step S524), the fold rollers 3*a* and 3*b* complete the folding operation (YES, step S524*a*). Then, the CPU 16*a* increase the rotation speed of the fold rollers 3*a* and 3*b* and that of the lower outlet roller 12*a* (step S524*c*). As soon as the leading edge of the sheet stack moves away from the pass sensor 8*a* (YES, step S525), the CPU 16*a* returns the fold plate 2 to the home position (step S528). As soon as the fold plate 2 leaves the leading edge of the sheet stack and the sheet stack is surely folded, the CPU 16*a* turns on the pressure cancel motor 700 for thereby retracting the pressure cancel link 770. As a result, the swing arms 720*a* and 720*b* are moved away from the fold rollers 3*a* and 3*b* (step S524*b*). This is followed by the step S528*a* and successive steps.

As stated above, the second modification folds a sheet stack at low speed in the same manner as in the illustrative embodiment and first modification, but accelerates the conveyance of the sheet stack as soon as the sheet stack is surely folded. This allows the sheet stack to be driven out to the lower tray 12*b* in a short period of time for thereby reducing the interval between consecutive jobs. For example, when the number of sheets constituting a sheet stack to be folded is relatively small, the first embodiment obviates or minimizes a waiting time otherwise necessary for a sheet stack to wait on the staple tray 10*d*.

Figure 58:
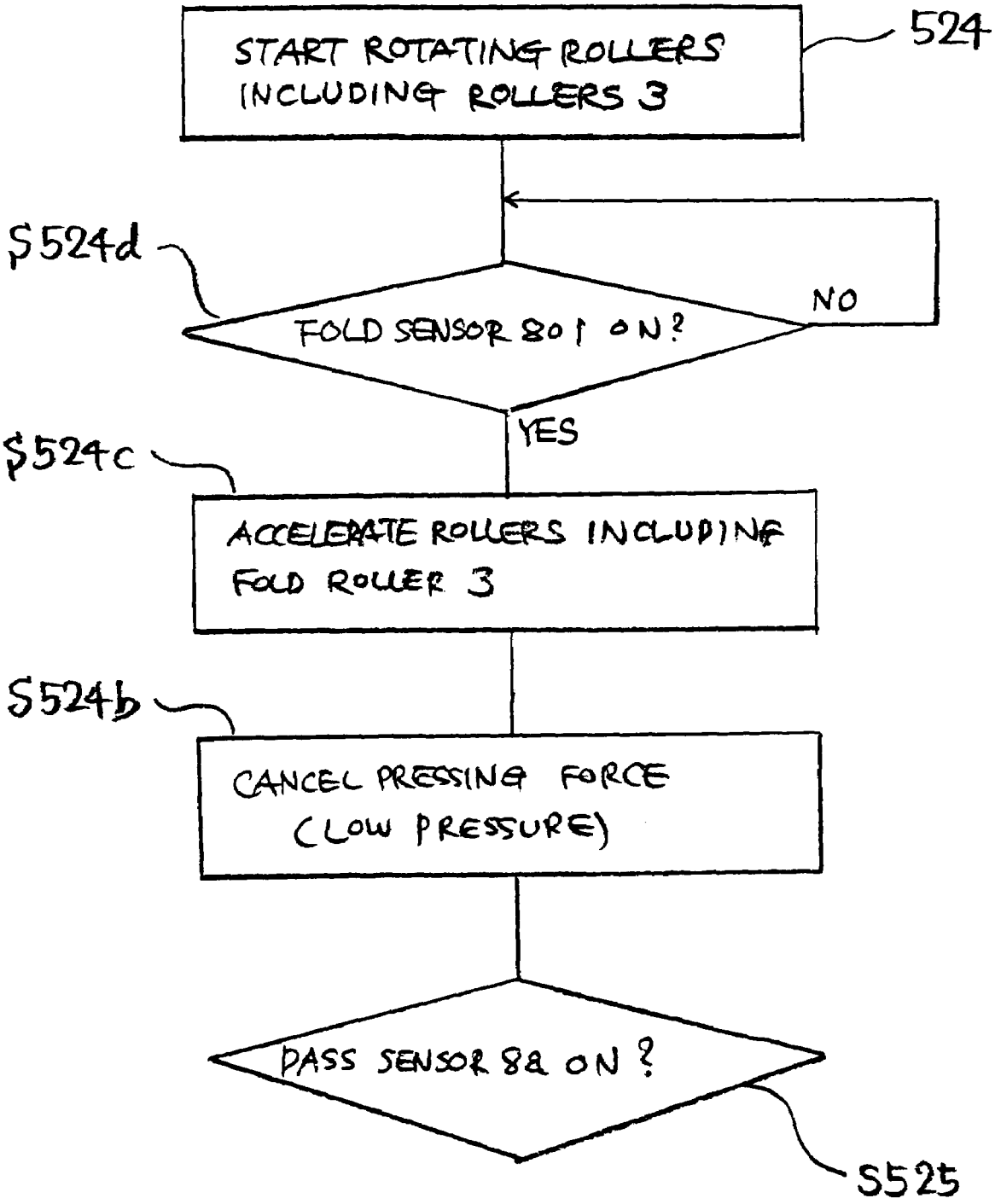
FIG. 58 is a flowchart demonstrating part of center staple mode operation representative of a third modification of the third embodiment.

FIG. 58 shows a third modification of the illustrative embodiment. This third modification is identical with the first modification as to the fold roller pair 3 and pressure applying and canceling mechanism and identical with the illustrative embodiment as for the rest of the configuration. The third embodiment is capable of conveying a sheet stack at high speed in response to the output of a fold sensor 801 shown in FIG. 51, compared to the first modification. As shown in FIG. 51, the fold sensor 801 is responsive to the leading edge of a folded sheet or sheet stack. The timing for canceling the nip pressure between the fold rollers 3*a* and 3*b* is determined in accordance with the output of the fold sensor 801.

Regarding the folding procedure, the third embodiment differs from the first modification, FIGS. 42 through 44, 54, 56A, 56B and 57, as to the processing between the steps S524 and S525. As shown in FIG. 58, assume that the fold sensor 801, positioned just downstream of the nip between the fold rollers 3*a* and 3*b*, turns on by sensing the folded sheet stack moved away from the nip between the fold rollers 3*a* and 3*b* (YES, step S524*d*). Then, the CPU 16*a* increases the rotation speed of the fold rollers 3*a* and 3*b* and that of the lower fold roller pair 12*a* (step S524*c*). After the sheet stack has been surely folded, the CPU 16*a* turns on the pressure cancel motor 700 to thereby retract the pressure cancel link 770. As a result, the pressure of the swing arms 720*a* and 720*b*, acting on the fold rollers 3*a* and 3*b*, is canceled (step S524*b*). This is followed by the step S525 and successive steps.

As stated above, the third modification folds a sheet stack at low speed as in the illustrative embodiment and first modification, but accelerates the conveying speed as soon as the fold sensor 801 senses the leading edge of the folded sheet stack. This also allows the sheet stack to be driven out to the lower tray 12*b* in a short period of time for thereby reducing the interval between consecutive jobs. For example, when the number of sheets constituting a sheet stack to be folded is relatively small, the first embodiment obviates or minimizes a waiting time otherwise necessary for a sheet stack to wait on the staple tray 10*d*.

As stated above, the illustrative embodiment and modifications thereof are also capable of sharply, neatly folding a sheet stack while causing the folded position to accurately coincide with the stapled position.

Figure 59:
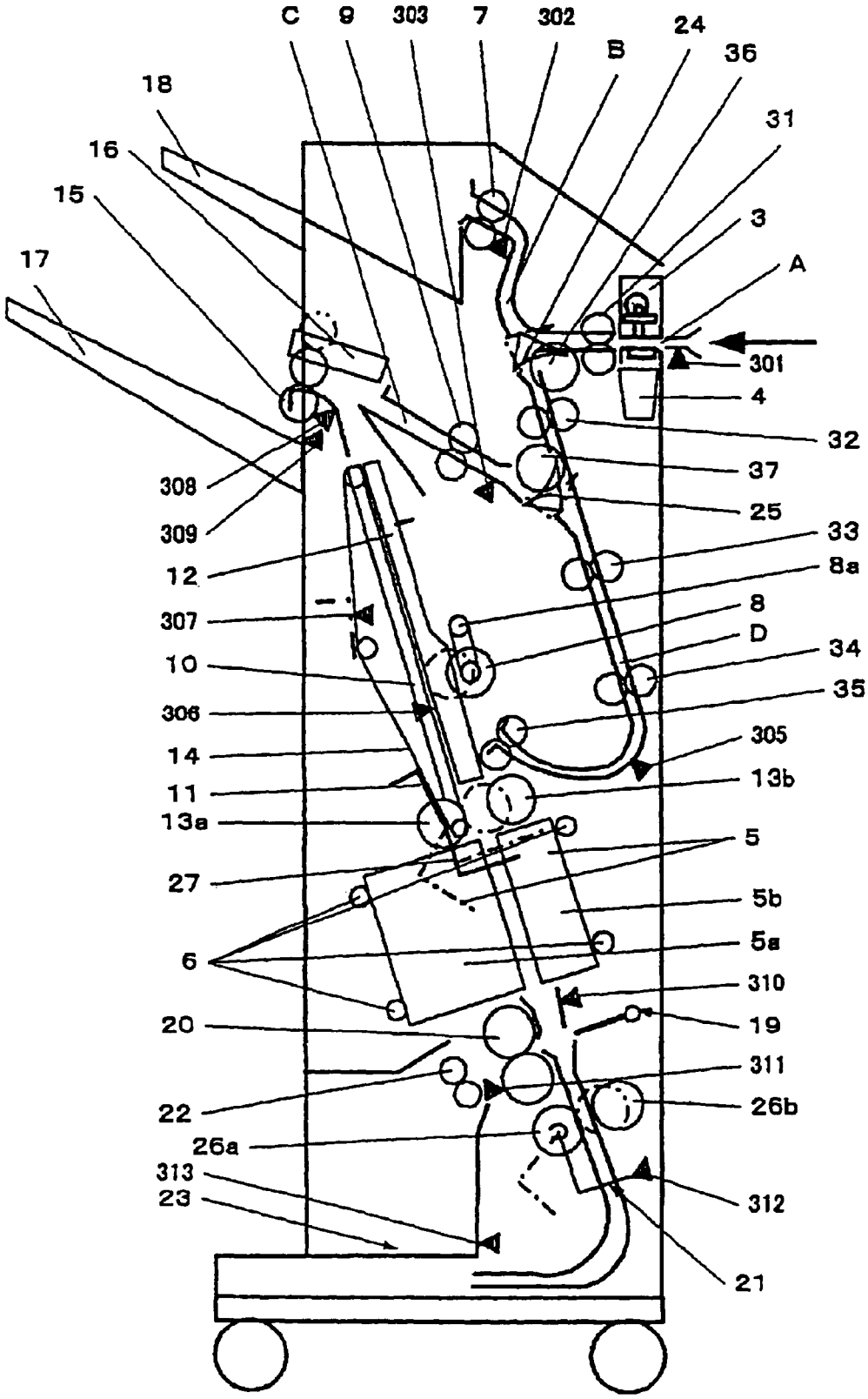
FIG. 59 is a view showing a sheet finisher different from the sheet finishers of FIGS. 6, 48 and 51 and to which the present invention is similarly applicable.

Various modifications will become possible for those skilled in the art after receiving the teachings of the present disclosure without departing from the scope thereof. For example, the present invention is similarly applicable to a sheet finisher shown in FIG. 59 of Japanese Patent Application assigned to the same assignee as the present application.

What is claimed is:

1. A sheet folding device for folding a sheet or a sheet stack conveyed thereto, said folding device comprising:

a path along which the sheet or the sheet stack to be folded is conveyed;

a fold plate movable in a direction substantially perpendicular to said path for forming a fold in the sheet or the sheet stack;

tie bars;

a movable shaft;

a pair of first rotatable fold rollers facing said fold plate, positioned one above the other, and connected by the tie bars to the movable shaft;

pressing means for exerting, when the fold is to be formed, a pair of equal pressing forces on said pair of first fold rollers to thereby maintain a nip between said pair of first fold rollers on a line including a locus of movement of said fold plate;

pressure varying means for varying the pressing force in accordance with a condition in which the sheet stack is conveyed; and first support means supporting said pair of first fold rollers, wherein said pair of first fold rollers have the nip positioned on the locus of movement of said fold plate or an extension of said locus when not folding the sheet or the sheet stack and wherein the pair of first fold rollers are movable substantially symmetrically to each other with respect to said locus or said extension when folding said sheet or said sheet stack.

2. The device as claimed in claim 1, wherein the sheet stack, stapled by stapling means, is conveyed along said path.

3. The device as claimed in claim 1, wherein the sheet stack, stapled at a center by a center stapler, is conveyed along said path.

4. The device as claimed in claim 1, wherein the sheet stack, stapled at an edge by an edge stapler, is conveyed along said path.

5. The device as claimed in claim 1, wherein said pair of first fold rollers stop rotating when a leading edge of the sheet or the sheet stack folded enters the nip between said first fold rollers.

6. The device as claimed in claim 5, wherein said pair of first fold rollers rotate, after stopping rotating, in opposite directions within a range that prevents a leading edge of the sheet or the sheet stack from moving out of the nip.

7. The device as claimed in claim 1, further comprising a pair of second fold rollers positioned downstream of said pair of first fold rollers in a direction of movement of said fold plate and positioned one above the other.

8. The device as claimed in claim 7, wherein said pair of first fold rollers and said pair of second fold rollers stop rotating when a leading edge of the sheet or sheet stack formed with the fold enters a nip between said pair of second fold rollers.

9. The device as claimed in claim 8, wherein said pair of first fold rollers and said pair of second fold rollers each rotate, after stopping rotating, in opposite directions within a range that prevents a leading edge of the sheet or the sheet stack from moving out of the nip.

10. The device as claimed in claim 1, wherein said pressing means comprises compression springs.

11. The device as claimed in claim 10, wherein said pressing means comprises upper pressing means and lower pressing means respectively pressing said pair of first fold rollers and said pair of second fold rollers.

12. The device as claimed in claim 11, wherein said upper pressing means and said lower pressing means have a same spring constant.

13. The device as claimed in claim 12, wherein said pressing means further comprises pressure adjusting means for adjusting pressing forces to act on said pair of first fold rollers.

14. The device as claimed in claim 13, wherein said pressure adjusting means varies a loaded length of the compression springs.

15. A sheet folding device for folding a sheet or a sheet stack, said sheet folding device comprising:

a pair of first fold rollers configured to form a fold in the sheet or the sheet stack;

a fold plate configured to contact the sheet or the sheet stack substantially perpendicularly to a surface of said sheet or said sheet stack for thereby pushing said sheet or said sheet stack into a nip between said pair of first fold rollers;

first support means comprising tie bars respectively connecting shafts of said pair of first fold rollers to a movable shaft and supporting said pair of first fold rollers such that said pair of first fold rollers have, when not folding the sheet or the sheet stack, the nip positioned on a locus of movement of said fold plate or an extension of said locus or are movable, when folding said sheet or said sheet stack, substantially symmetrically to each other with respect to said locus or said extension; and pressure varying means for varying the pressing force in accordance with a condition in which the sheet stack is conveyed.

16. The device as claimed in claim 15, further comprising:

a pair of second fold rollers positioned downstream of said pair of first fold rollers in a direction of movement of said fold plate for reinforcing the fold formed by said pair of first fold rollers; and second support means supporting said pair of second fold rollers such that said pair of second fold rollers have, when not folding the sheet or the sheet stack, a nip thereof positioned on a locus of movement of said fold plate or an extension of said locus or are movable, when folding said sheet or said sheet stack, substantially symmetrically to each other with respect to said locus or said extension.

17. The device as claimed in claim 16, wherein said path is configured such that the extension of the locus aligns with a center, in a direction of width, of a path following said pair of second fold rollers.

18. The device as claimed in claim 15, wherein:

said movable shaft is movable along the locus or the extension of said locus; and said first support means comprises limiting members configured to limit a direction in which said shafts moves.

19. The device as claimed in claim 18, further comprising biasing means for constantly biasing said limiting members toward each other.

20. The device as claimed in claim 18, wherein said limiting members comprises a pair of movable members angularly movably supported by respective shafts and respectively supporting said roller shafts at preselected positions.

21. The device as claimed in claim 18, wherein said limiting members comprise:

a guide slot extending substantially perpendicularly to an extension of the direction of movement of said fold plate; and a slide member slidably received in said guide slot and supporting said roller shafts.

22. The device as claimed in claim 18, further comprising displacement limiting means for limiting a displacement of said movable shaft.

23. The device as claimed in claim 15, wherein said path is configured such that the extension of the locus aligns with a center, in a direction of width, of a path following said pair of first fold rollers.

24. A sheet finisher comprising:

stapling means for stapling a sheet stack; and a sheet folding device configured to fold the sheet stack stapled by said stapling means;

said sheet folding device comprising:

a pair of first fold rollers configured to form a fold in the sheet or the sheet stack;

a fold plate configured to contact the sheet or the sheet stack substantially perpendicularly to a surface of said sheet or said sheet stack for thereby pushing said sheet or said sheet stack into a nip between said pair of first fold rollers;

first support means comprising tie bars respectively connecting shafts of said pair of first fold rollers to a movable shaft and supporting said pair of first fold rollers such that said pair of first fold rollers have, when not folding the sheet or the sheet stack, the nip positioned on a locus of movement of said fold plate or an extension of said locus or are movable, when folding said sheet or said sheet stack, substantially symmetrically to each other with respect to said locus or said extension; and pressure varying means for varying the pressing force in accordance with a condition in which the sheet stack is conveyed.

25. A sheet folding device for folding a sheet or a sheet stack with a pair of rollers by conveying said sheet or said sheet stack via a nip between said pair of rollers, said folding device comprising:

angularly movable members;

a fold plate;

pressing means for pressing said pair of fold rollers to thereby apply a pressing force for folding the sheet or the sheet stack to maintain the nip between the pair of rollers on a line including a locus of movement of the fold plate, said pair of fold rollers being supported by the angularly movable members;

pressure varying means for varying the pressing force in accordance with a condition in which the sheet or the sheet stack is conveyed; and first support means supporting said pair of first fold rollers, wherein said pair of first fold rollers have the nip positioned on the locus of movement of said fold plate or an extension of said locus when not folding the sheet or the sheet stack and wherein the pair of first fold rollers are movable substantially symmetrically to each other with respect to said locus or said extension when folding said sheet or said sheet stack.

26. The device as claimed in claim 25, wherein said pressure varying means increases the pressing force when a leading edge of the sheet or the sheet stack passes through the nip between the pair of fold rollers.

27. The device as claimed in claim 26, wherein said pressure varying means decreases the pressing force after the leading edge of the sheet or the sheet stack has moved away from the nip between the pair of fold rollers.

28. The device as claimed in claim 26, wherein said pressure varying means increases the pressing force over a preselected range from the leading edge of the sheet or the sheet stack.

29. The device as claimed in claim 26, wherein said pressure varying means decreases the pressing force when the leading edge of the sheet or the sheet stack enters the nip between the pair of fold rollers.

30. The device as claimed in claim 25, wherein said pressure varying means increases the pressing force over a preselected range from a leading edge of an innermost sheet of the sheet stack folded.

31. The device as claimed in claim 25, wherein said pressing means comprises:

first elastic members positioned substantially symmetrically to each other with respect to a path along which the sheet or the sheet stack is conveyed for exerting relatively weak biasing forces;

first members configured to respectively transfer the biasing forces of said first elastic members to the pair of fold rollers;

a second elastic member configured to exert a relatively strong biasing force; and second members configured to transfer the biasing force of said second elastic member to the pair of fold rollers;

wherein said pressure varying means varies the pressing force by switching the pressing force transferred via said first members and the pressing force transferred via said second members.

32. The device as claimed in claim 31, wherein said pressure varying means causes said first members to exert relatively weak pressing forces when a leading edge of the sheet stack enters the nip between the pair of fold rollers or causes said second members to exert relatively strong pressing forces when said leading edge passes through said nip.

33. The device as claimed in claim 31, wherein said first members each support one of the pair of fold rollers at one end thereof while said second members each press one of said first members to thereby exert a relatively strong pressing force on associated one of said pair of fold rollers.

34. The device as claimed in claim 33, wherein said pressing means further comprises a third member connecting said second members to each other and preventing said second members from pressing said first members when relatively weak pressing forces should be exerted.

35. The device as claimed in claim 34, further comprising a fold plate contacting a position where the sheet or the sheet stack should be folded at an edge thereof and pushing said sheet or said sheet stack into the nip between the pair of fold rollers, wherein said third member allows, when said fold plate pushes said sheet or said sheet stack into said nip, said second members to press said first members or prevents, when said fold plate is retracted from said nip to a preselected position, said second members from pressing said first members.

36. The device as claimed in claim 35, wherein said fold plate contacts, when being retracted, said third member and causes said third member to move in a direction of retraction of said fold plate, and said third member prevents, in interlocked relation to a movement of said fold plate, said second members from pressing said first members.

37. The device as claimed in claim 35, further comprising:

a drive mechanism including a motor for operating said third member; and drive control means for controllably driving said motor;

wherein said drive control means turns on said motor at a preselected timing set independently of retraction of said fold plate to thereby cause said third member to prevent said second members from pressing said first members.

38. The device as claimed in claim 37, further comprising sensing means located at an outlet of the nip between the pair of fold rollers for sensing passage of the sheet or the sheet stack, wherein said preselected timing is set on the basis of an output of said sensing means representative of the passage of the sheet or the sheet stack.

39. A sheet folding device for folding a sheet or a sheet stack by causing a fold plate to contact a surface of said sheet or said sheet stack substantially perpendicularly to said surface and press said sheet or said sheet stack into a nip between a pair of fold rollers, said sheet folding device comprising:

a pair of first members respectively supporting the pair of fold rollers independently of each other;

support portions respectively supporting said pair of first members such that said pair of first members are angularly movable;

a pair of first elastic members respectively constantly biasing said pair of first members to thereby exert relatively weak pressing forces on the pair of fold rollers;

a pair of second members respectively angularly movably supported by said support portions and respectively pressing said pair of first members at intermediate portions thereof to thereby exert pressing forces on the pair of fold rollers;

a second elastic member constantly biasing said pair of second members toward each other to thereby exert relatively strong pressing forces on the pair of fold rollers;

a third member connecting said pair of second members to each other and controlling operations of said pair of second members for pressing said pair of first members; and a pressing force control member configured to cause said third member to operate in accordance with a condition in which the sheet or the sheet stack is conveyed;

wherein said pair of first members, said support portions, said pair of first elastic members, said pair of second members, said second elastic member and said third member are positioned substantially symmetrically with respect to a center of a path corresponding to a locus of movement of the fold plate and the nip is held between the pair of fold rollers on a line including the locus of movement of the fold plate.

40. The device as claimed in claim 39, wherein said third member is connected to said pair of second members at one end and connected to said pressing force control member at the other end, and said pressing force control member moves, in interlocked relation to retraction of said fold plate, along a center of said path from a preselected position to an upstream side in a direction of sheet conveyance to thereby release said pair of second members from said pair of first members.

41. The device as claimed in claim 40, further comprising limiting means for limiting a movable range of the other end of said third member.

42. The device as claimed in claim 40, wherein a delay is provided for delaying an operation of each of said pair of second pressing members for pressing associated one of said pair of first members.

43. The device as claimed in claim 39, further comprising:

a drive mechanism including a motor for moving said pressing force control member; and drive control means for controllably driving said motor;

wherein said third member is connected at one end to said pair of second members and connected to said pressing force control member at the other end, said pressing force control member is movable along a center of said path by being driven by said drive mechanism, said drive control means turns on said motor at a preselected timing set independently of retraction of the fold plate, and said pressing force control member releases said pair of second members from said pair of first members when moved to an upstream side in a direction of sheet conveyance by said drive mechanism.

44. The device as claimed in claim 43, further comprising limiting means for limiting a movable range of the other end of said third member.

45. The device as claimed in claim 43, wherein a delay is provided for delaying an operation of each of said pair of second pressing members for pressing associated one of said pair of first members.

46. The device as claimed in claim 43, further comprising sensing means located at an outlet of the nip between the pair of fold rollers for sensing passage of the sheet or the sheet stack, wherein said preselected timing is set on the basis of an output of said sensing means representative of the passage of the sheet or the sheet stack.

47. A sheet finisher comprising:

stapling means for stapling a center of a sheet stack;

a fold plate; and a sheet folding device for folding the sheet stack stapled by said stapling means with a pair of rollers by conveying said sheet stack via a nip between said pair of rollers;

said sheet folding device comprising:

angularly movable members;

pressing means for pressing said pair of fold rollers to thereby apply a pressing force for folding the sheet stack to hold the nip between the pair of rollers on a line including the locus of movement of the fold plate, said pair of fold rollers being supported by the angularly movable members;

pressure varying means for varying the pressing force in accordance with a condition in which the sheet stack is conveyed; and first support means supporting said pair of first fold rollers, wherein said pair of first fold rollers have the nip positioned on the locus of movement of said fold plate or an extension of said locus when not folding the sheet or the sheet stack and wherein the pair of first fold rollers are movable substantially symmetrically to each other with respect to said locus or said extension when folding said sheet or said sheet stack.

48. A sheet finisher comprising:

stapling means for stapling a center of a sheet stack; and a sheet folding device for folding the sheet stack stapled by said stapling means by causing a fold plate to contact a surface of said sheet stack substantially perpendicularly to said surface and press said sheet stack into a nip between a pair of fold rollers to hold the nip on a line including a locus of movement of the fold plate;

said folding device comprising:

a pair of first members respectively supporting the pair of fold rollers independently of each other;

support portions respectively supporting said pair of first members such that said pair of first members are angularly movable;

a pair of first elastic members respectively constantly biasing said pair of first members to thereby exert relatively weak pressing forces on the pair of fold rollers;

a pair of second members respectively angularly movably supported by said support portions and respectively pressing said pair of first members at intermediate portions thereof to thereby exert pressing forces on the pair of fold rollers;

a second elastic member constantly biasing said pair of second members toward each other to thereby exert relatively strong pressing forces on the pair of fold rollers;

a third member connecting said pair of second members to each other and controlling operations of said pair of second members for pressing said pair of first members; and a pressing force control member configured to cause said third member to operate in accordance with a condition in which the sheet stack is conveyed;

wherein said pair first members, said support portions, said pair of first elastic members, said pair of second members, said second elastic member and said third member are positioned substantially symmetrically with respect to a center of a path corresponding to the locus of movement of the fold plate.

49. A sheet folding device for folding a sheet or a sheet stack conveyed thereto, said folding device comprising:

a path along which the sheet or the sheet stack to be folded is conveyed;

a fold plate movable in a direction substantially perpendicular to said path for forming a fold in the sheet or the sheet stack;

tie bars;

a movable shaft;

a pair of first rotatable fold rollers facing said fold plate, positioned one above the other, and connected by the tie bars to the movable shaft;

adjustable compression springs configured to exert, when the fold is to be formed, a pair of equal pressing forces on said pair of first fold rollers to thereby maintain a nip between said pair of first fold rollers on a line including a locus of movement of said fold plate;

pressure adjusters configured to vary the pressing force in accordance with a condition in which the sheet or the sheet stack is conveyed; and first support means supporting said pair of first fold rollers, wherein said pair of first fold rollers have the nip positioned on the locus of movement of said fold plate or an extension of said locus when not folding the sheet or the sheet stack and wherein the pair of first fold rollers are movable substantially symmetrically to each other with respect to said locus or said extension when folding said sheet or said sheet stack.

50. A sheet finisher for finishing a sheet or a sheet stack conveyed thereto and each carrying an image thereon, said sheet finisher comprising:

a path along which the sheet or the sheet to be finished is conveyed;

a sheet folding device configured to fold the sheet or the sheet stack conveyed along said path; and a sheet discharger configured to discharge the sheet or the sheet stack folded by said folding device;

said sheet folding device comprising:

a path along which the sheet or the sheet stack to be folded is conveyed;

a fold plate movable in a direction perpendicular to said path for forming a fold in the sheet or the sheet stack;

tie bars;

a movable shaft;

a pair of first rotatable fold rollers facing said fold plate, positioned one above the other, and connected by the tie bars to the movable shaft;

adjustable compression springs configured to exert, when the fold is to be formed, a pair of equal pressing forces on said pair of first fold rollers to thereby maintain a nip between said pair of first fold rollers on a line including a locus of movement of said fold plate;

pressure adjusters configured to vary the pressing force in accordance with a condition in which the sheet or the sheet stack is conveyed; and first support means supporting said pair of first fold rollers, wherein said pair of first fold rollers have the nip positioned on the locus of movement of said fold plate or an extension of said locus when not folding the sheet or the sheet stack and wherein the pair of first fold rollers are movable substantially symmetrically to each other with respect to said locus or said extension when folding said sheet or said sheet stack.

51. A sheet folding device for folding a sheet or a sheet stack, said sheet folding device comprising:

a movable shaft;

a pair of first fold rollers configured to form a fold in the sheet or the sheet stack;

a fold plate configured to contact the sheet or the sheet stack substantially perpendicularly to a surface of said sheet or said sheet stack for thereby pushing said sheet or said sheet stack into a nip between said pair of first fold rollers;

a first support comprising tie bars respectively connecting shafts of said pair of first fold rollers to the movable shaft and configured to support said pair of first fold rollers such that said pair of first fold rollers have, when not folding the sheet or the sheet stack, the nip positioned on a locus of movement of said fold plate or an extension of said locus or are movable, when folding said sheet or said sheet stack, substantially symmetrically to each other with respect to said locus or said extension; and pressure adjusters configured to vary the pressing force in accordance with a condition in which the sheet or the sheet stack is conveyed.

52. A sheet finisher comprising:

a stapler configured to staple a sheet stack; and a sheet folding device configured to fold the sheet stack stapled by said stapler;

said sheet folding device comprising:

a pair of first fold rollers configured to form a fold in the sheet or the sheet stack;

a fold plate configured to contact the sheet or the sheet stack substantially perpendicularly to a surface of said sheet or said sheet stack for thereby pushing said sheet or said sheet stack into a nip between said pair of first fold rollers;

a movable shaft;

a first support comprising tie bars respectively connecting shafts of said pair of first fold rollers to the movable shaft and configured to support said pair of first fold rollers such that said pair of first fold rollers have, when not folding the sheet or the sheet stack, the nip positioned on a locus of movement of said fold plate or an extension of said locus or are movable, when folding said sheet or said sheet stack, substantially symmetrically to each other with respect to said locus or said extension; and pressure adjusters configured to vary the pressing force in accordance with a condition in which the sheet or the sheet stack is conveyed.

53. A sheet folding device for folding a sheet or a sheet stack with a pair of rollers by conveying said sheet or said sheet stack via a nip between said pair of rollers, said folding device comprising:

compression springs configured to press said pair of fold rollers to thereby apply a pressing force for folding the sheet or the sheet stack and to hold the nip between the pair of rollers on a line including a locus of movement of a fold plate, said pair of fold rollers being supported by angularly movable members;

pressure adjusters configured to vary the pressing force in accordance with a condition in which the sheet or the sheet stack is conveyed; and first support means supporting said pair of first fold rollers, wherein said pair of first fold rollers have the nip positioned on the locus of movement of said fold plate or an extension of said locus when not folding the sheet or the sheet stack and wherein the pair of first fold rollers are movable, substantially symmetrically to each other with respect to said locus or said extension when folding said sheet or said sheet stack.

54. A sheet finisher comprising:

a stapler configured to staple a center of a sheet stack; and a sheet folding device for folding the sheet stack stapled by said stapler with a pair of fold rollers by conveying said sheet stack via a nip between said pair of rollers;

said sheet folding device comprising:

angularly movable members;

compression springs configured to press said pair of fold rollers to thereby apply a pressing force for folding the sheet stack and to hold the nip between the pair of rollers on a line including a locus of movement of a fold plate, said pair of fold rollers being supported by the angularly movable members;

pressure adjusters configured to vary the pressing force in accordance with a condition in which the sheet stack is conveyed; and first support means supporting said pair of first fold rollers, wherein said pair of first fold rollers have the nip positioned on the locus of movement of said fold plate or an extension of said locus when not folding the sheet or the sheet stack and wherein the pair of first fold rollers are movable substantially symmetrically to each other with respect to said locus or said extension when folding said sheet or said sheet stack.

55. A sheet finisher comprising:

a stapler configured to staple a center of a sheet stack;

a fold plate; and a sheet folding device for folding the sheet stack stapled by said stapler by causing the fold plate to contact a surface of said sheet stack substantially perpendicularly to said surface and press said sheet stack into a nip between a pair of fold rollers, the nip being held between the pair of rollers on a line including a locus of movement of the fold plate;

said folding device comprising:

a pair of first members respectively supporting the pair of fold rollers independently of each other;

support portions respectively supporting said pair of first members such that said pair of first members are angularly movable;

a pair of first elastic members respectively constantly biasing said pair of first members to thereby exert relatively weak pressing forces on the pair of fold rollers;

a pair of second members respectively angularly movably supported by said support portions and respectively pressing said pair of first members at intermediate portions thereof to thereby exert pressing forces on the pair of fold rollers;

a second elastic member constantly biasing said pair of second members toward each other to thereby exert relatively strong pressing forces on the pair of fold rollers;

a third member connecting said pair of second members to each other and controlling operations of said pair of second members for pressing said pair of first members; and a pressing force control member configured to cause said third member to operate in accordance with a condition in which the sheet stack is conveyed;

wherein said pair of first members, said support portions, said pair of first elastic members, said pair of second members, said third elastic member and said third member are positioned substantially symmetrically with respect to a center of a path corresponding to the locus of movement of the fold plate.

* * * * *